US007279272B2

(12) United States Patent
Ohshima et al.

(10) Patent No.: US 7,279,272 B2
(45) Date of Patent: Oct. 9, 2007

(54) SILVER HALIDE EMULSION AND SILVER HALIDE PHOTOSENSITIVE MATERIAL

(75) Inventors: Naoto Ohshima, Kanagawa (JP); Osamu Yonekura, Kanagawa (JP); Satoshi Aiba, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 10/153,184

(22) Filed: May 23, 2002

(65) Prior Publication Data

US 2003/0104326 A1 Jun. 5, 2003

(30) Foreign Application Priority Data

May 23, 2001 (JP) ..... 2001-154476
Sep. 26, 2001 (JP) ..... 2001-293636
Nov. 22, 2001 (JP) ..... 2001-357995
Dec. 27, 2001 (JP) ..... 2001-397683

(51) Int. Cl.
*G03C 1/005* (2006.01)

(52) U.S. Cl. ..... 430/567; 430/569; 430/604

(58) Field of Classification Search ..... 430/567, 430/604, 569

See application file for complete search history.

(56) References Cited

U.S. PATENT DOCUMENTS 5,173,395 A * 12/1992 Asami ..... 430/376
5,240,824 A * 8/1993 Takada et al. ..... 430/567
5,415,991 A * 5/1995 Kase et al. ..... 430/600
5,496,689 A 3/1996 Ogawa
6,248,507 B1 * 6/2001 Budz et al. ..... 430/363
6,727,054 B2 * 4/2004 Aiba et al. ..... 430/567

FOREIGN PATENT DOCUMENTS

JP 10-153838 A 6/1998
JP 10-197977 A 7/1998
JP 2000-171928 A 6/2000
JP 2000-352794 A 12/2000
JP 2001-188311 A 7/2001
JP 2001-281782 A 10/2001

* cited by examiner

*Primary Examiner*—Thorl Chea
(74) *Attorney, Agent, or Firm*—Sughrue Mion, PLLC

(57) ABSTRACT

The present invention provides a silver halide emulsion containing silver halide particles, wherein a content of silver chloride in the silver halide particles is at least 89 mol %, and wherein the silver halide particles comprising at least one of (i) at least one phase selected from the group consisting of a laminar phase containing silver bromide, a laminar phase comprising silver iodide and a phase comprising silver bromide and having a maximum point where a silver bromide content ratio is at a maximum value, which maximum point is inside the silver particles, and (ii) a phase comprising silver iodide and a phase comprising silver bromide, which phase comprising silver bromide is disposed further inside of the silver halide particles than the phase comprising silver iodide. Further, the present invention provides a silver halide photosensitive material comprising the silver halide emulsion.

34 Claims, 3 Drawing Sheets

SILVER HALIDE EMULSION AND SILVER HALIDE PHOTOSENSITIVE MATERIAL

BACKGROUND OF THE INVENTION

1. Field of the Invention

The present invention relates to a silver halide emulsion, and a silver halide photosensitive material. More specifically, the present invention relates to a silver halide emulsion which is suitable for quick processing and provides a high sensitivity and a high gradation even in digital exposure such as laser scanning exposure, and a silver halide photosensitive material using the silver halide emulsion.

2. Description of the Related Art

In recent years, digitization has been remarkably widespread in the field of a color print using a color photographic printing paper. For example, a digital exposure system using laser scanning exposure has been rapidly spread in comparison with an ordinary analog exposure system in which printing is directly conducted from a processed color negative film with a color printer. Such a digital exposure system is characterized in that a high image quality is obtained by image processing, and greatly contributes to improving qualities of a color print using a color photographic printing paper. Further, according to the rapid spread of digital cameras, it is also an important factor that a color print with a high image quality is easily obtained from these electronic recording mediums. It is believed that they will rapidly spread further.

With respect to a color print system, techniques such as an ink jet system, a sublimation system, a color xerography and the like have made progress, and these are being recognized as a color print system with a good photographic image quality. Of these, a digital exposure system using a color photographic printing paper has characteristics such as a high image quality, a high productivity and a high fastness of an image. It has been required to provide higher-quality photographs more easily at lower cost by making use of these characteristics. Further, unlike a silver halide sensitive material for photography of a color negative, a blank of a color printing paper to be directly observed tends to show clearly. Accordingly, for competition with other printing materials, it is important to decrease a blank density by reducing a residual color of a dye or a sensitization coloring matter to decrease a fog density.

As a silver halide emulsion used in a color photographic printing paper, a silver halide emulsion having a high content of silver chloride has been used mainly to meet a requirement of having a quick processability for increasing a productivity. Especially, the use of a silver halide emulsion having a high content of silver chloride and a small particle size further improves the quick processability and provides a high color formation efficiency, making it possible to provide a less costly color photographic printing paper. Accordingly, an increase in the performance of a silver halide emulsion having a high content of silver chloride and a small particle size is important for providing high-quality photographs more easily at lower cost. However, such a silver halide emulsion having a high content of silver chloride and a small particle size has been problematic in that it has a low sensitivity and is liable to induce a low sensitivity and a soft gradation through high-intensity exposure such as laser scanning exposure. Further, for quick return of a color print, it is important to conduct development for a short period of time after exposure in a mini-laboratory system. Nevertheless, the silver halide emulsion having a high content of silver chloride and a small particle size has been problematic in that a latent image stability is poor for several seconds to several dozen seconds after exposure.

It has been known that iridium can be doped for improving high intensity failure of a silver chloride emulsion. However, it has been also known that a silver chloride emulsion doped with iridium causes sensitization of a latent image for a short period of time after exposure. For example, JP-B No. 7-34103 discloses that a localized phase having a high content of silver bromide is provided and doped with iridium to solve the problem of latent image sensitization. A silver halide emulsion formed by this method provides a high sensitivity and a high gradation even by relatively high-intensity exposure for approximately 1/100 second without the problem of the latent image sensitization. However, it has been clarified that when an attempt is made to maintain a high sensitivity by ultrahigh-intensity exposure for 1 microsecond required in a digital exposure system by laser scanning exposure, a high gradation is hardly obtained. Moreover, U.S. Pat. No. 5,691,119 discloses a method of preparing an emulsion having a localized phase with a high content of silver bromide to provide a high gradation. However, it is problematic in that the effect is insufficient and a performance is not stabilized by repeated preparation.

U.S. Pat. Nos. 5,783,373 and 5,783,378 disclose that high intensity failure is decreased by using at least three types of dopants to provide a high gradation. However, a high gradation is obtained because of the use of a dopant having a low sensitivity and a high gradation which is in principle contrary to a high sensitivity.

U.S. Pat. Nos. 5,726,005 and 5,736,310 disclose that an emulsion having a high sensitivity with high intensity failure reduced is obtained with an emulsion containing I in which a concentration maximum is present on a sub-surface of a high silver chloride emulsion. Examples of EP 0,928,988A demonstrate that an emulsion excellent in reciprocity law failure, temperature dependence of exposure and pressure property is obtained by incorporating a specific compound in particles having a side length of 0.218 μm, namely, a sphere-equivalent diameter of approximately 0.27 μm in which an I band is formed in 93% of particle formation. In the silver halide emulsion having a high content of silver chloride and a small particle size as described in these documents, higher intensity exposure leads to a higher sensitivity. However, it has been found that ultrahigh-intensity exposure such as laser scanning exposure provides quite a soft gradation which is not suitable for digital exposure with a limited dynamic range of an amount of light and a latent image stability is poor for several seconds to several tens of seconds after exposure. Further, U.S. Pat. Nos. 5,728,516, 5,547,827 and 5,605,789 and JP-A No. 8-234354 disclose a method of decreasing a fog density of an emulsion containing I in which a concentration maximum is present on a sub-surface of a high silver chloride emulsion. However, satisfactory effects have not been provided when using it as a printing material.

JP-A Nos. 58-95736, 58-108533, 60-222844, 60-222845, 62-253143, 62-253144, 62-253166, 62-254139, 63-46440, 63-46441 and 63-89840 and U.S. Pat. Nos. 4,820,624, 4,865,962, 5,399,475 and 5,284,743 disclose that a high sensitivity is provided by localizing a phase having a high content of silver bromide in an emulsion having a high content of silver chloride in various modes. However, these documents do not disclose that a peculiar function of a high gradation is provided in ultrahigh-intensity exposure such as laser scanning exposure with a silver halide emulsion containing a silver bromide-containing phase and/or a silver iodide-containing phase and having a high content of silver chloride and a small particle size. Further, in these silver bromide-containing phases, the distribution inside the particle is not optimized. Thus, the effects have been unsatisfactory in ultrahigh-intensity exposure such as laser scanning exposure.

U.S. Pat. No. 5,049,485 discloses that a high sensitivity and a high gradation are provided by chemical sensitization with an Au (I) compound coordinated with a mesoion. U.S. Pat. No. 5,945,270 discloses that a high sensitivity and a high gradation are provided by chemical sensitization with an Au(I) compound coordinated with mercapto containing a water-soluble group. These compounds are known to be relatively stable Au (I) compounds. However, these documents do not disclose that a peculiar function of a high gradation is provided in high-intensity exposure with an emulsion containing a silver bromide-containing phase and/or a silver iodide-containing phase.

SUMMARY OF THE INVENTION

The first object of the present invention is to provide a silver halide emulsion in which a high sensitivity and a high gradation are obtained even in digital exposure such as laser scanning exposure without causing a low sensitivity and a soft gradation, and a silver halide photosensitive material using the same.

The second object of the present invention is to provide a silver halide photosensitive material in which the cost can be reduced because of an excellent quick processability and a high color formation efficiency.

The third object of the present invention is to provide a silver halide emulsion excellent in latent image stability and dependence of exposure on temperature and humidity, and a silver halide color photosensitive material using the same.

A first embodiment of the present invention provides a silver halide emulsion containing silver halide particles, wherein a content of silver chloride in the silver halide particles is at least 89 mol %, and wherein the silver halide particles comprising at least one of (i) at least one phase selected from the group consisting of a laminar phase containing silver bromide, a laminar phase comprising silver iodide and a phase comprising silver bromide and having a maximum point where a silver bromide content ratio is at a maximum value, which maximum point is inside the silver particles, and (ii) a phase comprising silver iodide and a phase comprising silver bromide, which phase comprising silver bromide is disposed further inside of the silver halide particles than the phase comprising silver iodide.

A second embodiment of the present invention provides the silver halide emulsion of the first embodiment, wherein the silver halide particles are cubic or tetradecahedral particles.

A third embodiment of the present invention provides the silver halide emulsion of the first and second embodiments, wherein the silver halide particles are doped with a six-coordinate complex having iridium as a central metal.

A fourth embodiment of the present invention provides the silver halide emulsion of any of the first to third embodiments, wherein said six-coordinate complex having iridium as a central metal comprises a six-coordinate iridium complex in which all ligands are made of a halogen alone, and a six-coordinate iridium complex in which at least one ligand is neither a halogen nor a cyan.

A fifth embodiment of the present invention provides the silver halide emulsion of the fourth embodiment, wherein the silver bromide-containing phase comprises at least one of said six-coordinate iridium complex, in which all of the ligands are made of only a halogen.

A sixth embodiment of the present invention provides the silver halide emulsion of any of the first to fifth embodiments, wherein, in the silver halide particles, a content of the silver chloride is from 89 mol % to 99.7 mol %, a content of the silver bromide is from 0.25 mol % to 10 mol %, and a content of the silver iodide is from 0.05 mol % to 1 mol %.

A seventh embodiment of the present invention provides the silver halide emulsion of any of the first to sixth embodiments, wherein the silver halide emulsion is gold-sensitized with at least one of a colloidal gold sulfide and a gold sensitizer in which a complex stability constant log $\beta_2$ of gold is from 21 and to 35.

As a preferred embodiment (1-1), the present invention provides a silver halide photosensitive material comprising a silver halide emulsion that comprises silver halide particles, wherein a content of a silver chloride is at least 89 mol %, and wherein the silver halide particles comprising at least one of (i) at least one phase selected from the group consisting of a laminar phase containing silver bromide, a laminar phase comprising silver iodide and a phase comprising silver bromide and having a maximum point where a silver bromide content ratio is at a maximum value, which maximum point is inside the silver particles, and (ii) a phase comprising silver iodide and a phase comprising silver bromide, which phase comprising silver bromide is disposed further inside of the silver halide particles than the phase comprising silver iodide.

As a preferred embodiment (1-2), the present invention provides the silver halide photosensitive material of the embodiment (1-1), wherein said silver halide particles comprising at least one phase selected from the group consisting of a laminar phase containing silver bromide, a laminar phase comprising silver iodide and a phase comprising silver bromide and having a maximum point where a silver bromide content ratio is at a maximum value, which maximum point is inside the silver particles.

As a preferred embodiment (1-3), the present invention provides the silver halide photosensitive material of the embodiment (1-1), wherein the silver halide particles comprise the silver iodide-containing phase and the silver bromide-containing phase which is disposed further inside the silver halide particle than the silver iodide-containing phase, a content of the silver chloride is from 89 mol % to 99.7 mol %, a content of the silver bromide is from 0.25 mol % to 10 mol %, and a content of the silver iodide is from 0.05 mol % to 1 mol %.

As a preferred embodiment (1-4), an eighth embodiment of the present invention provides the silver halide emulsion of the first embodiment, wherein a content of the silver chloride in the silver halide particles is at least 90 mol % and the silver halide particles comprise silver bromide-containing phase which has the maximum point where the silver bromide content ratio is at a maximum value, which maximum point is inside the silver particles.

As a preferred embodiment (1-5), a ninth embodiment of the present invention provides the silver halide emulsion of the eighth embodiment, wherein a content of the silver bromide decreases in a direction from the maximum point toward the surface of the silver halide particles and the direction from the maximum point toward the inside of the silver halide particles.

As a preferred embodiment (1-6), a tenth embodiment of the present invention provides the silver halide emulsion of the eighth embodiment, wherein the silver bromide content is changed from decreasing to increasing in a direction from the maximum point toward the surface of the silver halide particles and the silver bromide content decreases in a direction toward the inside of the silver halide particles.

As a preferred embodiment (1-7), an eleventh embodiment of the present invention provides the silver halide emulsion of the eighth embodiment, wherein the silver bromide-containing phase is formed using silver halide fine particles containing silver bromide, which are formed by adding and mixing an aqueous solution of a water-soluble silver salt and an aqueous solution of a bromide ion-containing water-soluble halide in a mixer disposed separately from a reaction vessel for at least one of nucleating and growing silver halide particles.

As a preferred embodiment (1-8), the present invention provides the silver halide emulsion of the embodiment (1-6), wherein in the silver bromide-containing phase, an amount of silver bromide P of a point of change, where the amount of silver bromide is changed from decreasing to increasing in a direction from the maximum point toward the surface of the silver halide particle, relative to an amount of silver bromide content M at the maximum point, fulfills an equation $P \leqq 0.9 \times M$.

As a preferred embodiment (1-9), the present invention provides the silver halide emulsion of the embodiment (1-7), wherein an average projected particle diameter of the silver halide fine particles containing silver bromide is less than 0.06 μm.

As a preferred embodiment (1-10), the present invention provides the silver halide emulsion of the embodiments (1-5), (1-7) and (1-9), wherein in the silver bromide-containing phase, an amount of silver bromide F on the surface of the silver halide particle, relative to the amount of silver bromide M at the maximum point, fulfills an equation $F \leqq 0.9 \times M$.

As a preferred embodiment (1-11), the present invention provides the silver halide emulsion of the embodiments (1-5) to (1-10), wherein, in the decrease in the direction toward the surface and/or the inside of the silver halide particle in the silver bromide-containing phase, absolute values of tangential gradients of silver bromide content curves in positions showing half values of maximum concentrations are 0.1 to 50 mol %/nm.

As a preferred embodiment (1-12), the present invention provides the silver halide emulsion of the embodiments (1-5) to (1-11), wherein a distance d1 from the maximum point to the position showing the half value of the maximum concentration in the direction toward the surface of the silver halide particle is smaller than a distance d2 from the maximum point to the position showing the half value of the maximum concentration in the direction toward the inside of the silver halide particle.

As a preferred embodiment (1-13), the present invention provides the silver halide emulsion of the embodiment (1-12), wherein the total of the distance d1 and the distance d2 (d1+d2), relative to a radius R of the silver halide particle, fulfills an equation $(d1+d2)/R \leqq 0.2$.

As a preferred embodiment (1-14), the present invention provides the silver halide emulsion of the embodiments (1-5) to (1-13), wherein the amount of the silver bromide at the maximum point of the silver bromide-containing phase is 5 to 95 mol %.

As a preferred embodiment (1-15), the present invention provides the silver halide emulsion of the embodiments (1-5) to (1-14), wherein the main plane of the silver halide particle is formed by a surface (100).

As a preferred embodiment (1-16), the present invention provides the silver halide emulsion of the embodiments (1-5) to (1-15), wherein the silver halide particles contain at least one transition metal complex.

As a preferred embodiment (1-17), the present invention provides the silver halide emulsion of the embodiments (1-5) to (1-16), wherein the silver bromide-containing phase contains at least one transition metal complex.

As a preferred embodiment (1-18), the present invention provides the silver halide emulsion of the embodiments (1-7) to (1-17), wherein the silver bromide-containing phase of the silver halide particles is formed using silver halide fine particles containing the silver bromide containing at least one transition metal complex and formed with the mixer.

As a preferred embodiment (1-19), the present invention provides a silver halide color photosensitive material having at least one blue sensitive silver halide emulsion layer, at least one green sensitive silver halide emulsion layer and at least one red sensitive silver halide emulsion layer on a substrate, in which at least one of the blue sensitive silver halide emulsion layer, the green sensitive silver halide emulsion layer and the red sensitive silver halide emulsion layer contains the silver halide emulsion of the embodiments (1-5) to (1-18).

As a preferred embodiment (2-1), a twelfth embodiment of the present invention provides the silver halide emulsion of the first embodiment, wherein the silver halide particles comprise an amount of the silver chloride of at least 90 mol %, and the silver bromide-containing laminar phase, and are doped with a six-coordinate complex, which has iridium as a central metal.

As a preferred embodiment (2-2), the present invention provides the silver halide emulsion of the embodiment (2-1), wherein the silver bromide-containing phase is formed inside the particle.

As a preferred embodiment (2-3), the present invention provides the silver halide emulsion of the embodiment (2-1) or (2-2), wherein the silver bromochloride particles are cubic or tetradecahedral particles.

As a preferred embodiment (2-4), the present invention provides the silver halide emulsion of any of the embodiments (2-1) to (2-3), wherein the six-coordinate complex having iridium as a central metal has Cl, Br or I as a ligand.

As a preferred embodiment (2-5), the present invention provides the silver halide emulsion of the embodiment (2-4), wherein the six-coordinate complex having iridium as a central metal is contained in the silver bromide-containing phase.

As a preferred embodiment (2-6), the present invention provides the silver halide emulsion of any of the embodiments (2-1) to (2-3), wherein the six-coordinate complex having iridium as a central metal contains at least one non-halogen as a ligand.

As a preferred embodiment (2-7), the present invention provides the silver halide emulsion of any of the embodiments (2-1) to (2-6), wherein the silver halide emulsion is gold-sensitized.

As a preferred embodiment (2-8), the present invention provides the silver halide emulsion of the embodiment (2-7), wherein the silver halide emulsion is gold-sensitized with colloidal gold sulfide or a gold sensitizer, in which a complex stability constant log $\beta_2$ of gold is within a range from 21 to 35.

As a preferred embodiment (2-9), the present invention provides a silver halide photosensitive material containing the silver halide emulsion of any of the embodiments (2-1) to (2-8).

As a preferred embodiment (3-1), a thirteenth embodiment of the present invention provides the silver halide emulsion of the first embodiment, wherein a variation coefficient of a sphere-equivalent diameter for all of the particles is no more than 20%, and the silver chloride particles comprise a sphere-equivalent diameter of no more than 0.4 μm, at least one of the silver bromide-containing laminar phase and the silver iodide-containing laminar phase, a content of the silver chloride of at least 90 mol % and occupy at least 50% of total projected area of all of the particles.

As a preferred embodiment (3-2), a fourteenth embodiment of the present invention provides the silver halide emulsion of the thirteenth embodiment, wherein a variation coefficient of a sphere-equivalent diameter of all of the particles is no more than 20%, and the silver halide particles comprise a sphere-equivalent diameter of no more than 0.4 μm, the laminar silver bromide-containing the phase, a content of silver chloride of at least 90 mol % and occupy at least 50% of a total projected area of all of the particles.

As a preferred embodiment (3-3), a fifteenth embodiment of the present invention provides the silver halide emulsion of the fifteenth embodiment, wherein a variation coefficient of a sphere-equivalent diameter of all of the particles is no more than 20%, and the silver halide particles comprise a sphere-equivalent diameter of no more than 0.4 μm, the silver iodide-containing laminar phase, a content of the silver chloride of at least 90 mol % and occupy at least 50% of a total projected area of all of the particles.

As a preferred embodiment (3-4), a sixteenth embodiment of the present invention provides the silver halide emulsion of the sixteenth embodiment, wherein the silver halide particles comprise the silver bromide-containing laminar phase and the silver iodide-containing laminar phase.

As a preferred embodiment (3-5), the present invention provides the silver halide emulsion of the embodiment (3-1), wherein the silver bromide-containing phase is a silver bromide-containing phase in which a maximum density ratio of silver bromide is dispersed inside the particle.

As a preferred embodiment (3-6), the present invention provides the silver halide emulsion of the embodiment (3-3), wherein the silver iodide-containing phase is a silver iodide-containing phase in which a concentration maximum of silver iodide is provided on the surface of the particle.

As a preferred embodiment (3-7), the present invention provides the silver halide emulsion of the embodiment (3-4), wherein the silver bromide-containing phase is formed further inside the particle than the silver iodide-containing phase.

As a preferred embodiment (3-8), the present invention provides the silver halide emulsion of any of the embodiments (3-1) to (3-7), wherein the silver halide particles are cubic or tetradecahedral particles.

As a preferred embodiment (3-9), the present invention provides the silver halide emulsion of any of the embodiments (3-1) to (3-8), wherein an electron slow-release time of the silver halide particles is $10^{-5}$ second to 10 seconds.

As a preferred embodiment (3-10), the present invention provides the silver halide emulsion of any of the embodiments (3-1) to (3-9), wherein the silver halide particles contain a six-coordinate complex containing Cl, Br or I as a ligand and having Ir as a central metal.

As a preferred embodiment (3-11), the present invention provides the silver halide emulsion of the embodiment (3-10), wherein the six-coordinate complex is included in the silver bromide-containing phase.

As a preferred embodiment (3-12), the present invention provides the silver halide emulsion of any of the embodiments (3-1) to (3-11), wherein the silver halide particles contain a six-coordinate complex containing at least one ligand that is not a halogen or cyan and having Ir as a central metal.

As a preferred embodiment (3-13), the present invention provides the silver halide emulsion of any of the embodiments (3-1) to (3-12), wherein an oxidation potential of a latent image of the silver halide emulsion is higher than 70 mV.

As a preferred embodiment (3-14), the present invention provides the silver halide emulsion of any of the embodiments (3-1) to (3-13), wherein the silver halide emulsion is gold-sensitized.

As a preferred embodiment (3-15), the present invention provides the silver halide emulsion of the embodiment (3-14), wherein the silver halide emulsion is gold-sensitized with a colloidal gold sulfide or a gold sensitizer in which a complex stability constant log $\beta_2$ of gold is within a range from 21 to 35.

As a preferred embodiment (3-16), the present invention provides a silver halide photosensitive material containing the silver halide emulsion of any of the embodiments (3-1) to (3-15).

As a preferred embodiment (4-1), a seventeenth embodiment of the present invention provides the silver halide emulsion of the first embodiment, wherein in the silver halide particles, the silver chloride content is from 89 mol % to 99.7 mol %, the silver bromide content is from 0.25 mol % to 10 mol %, the silver iodide content is from 0.05 mol % to 1 mol %, and the silver bromide-containing phase is disposed further inside of the silver halide particles than the silver iodide-containing phase.

As a preferred embodiment (4-2), the present invention provides the silver halide emulsion of the embodiment (4-1), wherein the silver bromide-containing phase and the silver iodide-containing phase are adjacent to each other.

As a preferred embodiment (4-3), the present invention provides the silver halide emulsion of the embodiment (4-1) or (4-2), wherein the silver iodobromochloride particles are cubic or tetradecahedral particles.

As a preferred embodiment (4-4), the present invention provides the silver halide emulsion of any of the embodiments (4-1) to (4-3), wherein an electron slow-release time of the silver iodobromochloride particles is $1\times10^{-5}$ second to 10 seconds.

As a preferred embodiment (4-5), the present invention provides the silver halide emulsion of any of the embodiments (4-1) to (4-4), wherein the silver iodobromochloride particles contain a six-coordinate complex containing Cl, Br or I as a ligand and having Ir as a central metal.

As a preferred embodiment (4-6), the present invention provides the silver halide emulsion of the embodiment (4-5), wherein the six-coordinate complex is contained in the silver bromide-containing phase.

As a preferred embodiment (4-7), the present invention provides the silver halide emulsion of any of the embodiments (4-1) to (4-6), wherein the silver iodobromochloride particles contain a six-coordinate complex containing at least one ligand except for a halogen or a cyan and having Ir as a central metal.

As a preferred embodiment (4-8), the present invention provides the silver halide emulsion of any of the embodiments (4-1) to (4-7), wherein an oxidation potential of a latent image of the silver halide emulsion is higher than 70 mV.

As a preferred embodiment (4-9), the present invention provides the silver halide emulsion of any of the embodiments (4-1) to (4-8), which silver halide emulsion is gold-sensitized.

As a preferred embodiment (4-10), the present invention provides the silver halide emulsion of the embodiment (4-9), wherein the silver halide emulsion is gold-sensitized with colloidal gold sulfide or a gold sensitizer in which a complex stability constant log $\beta_2$ of gold is within a range from 21 to 35.

As a preferred embodiment (4-11), the present invention provides a silver halide photosensitive material containing the silver halide emulsion of any of the embodiments (4-1) to (4-10).

DETAILED DESCRIPTION OF THE INVENTION

Figure 1:
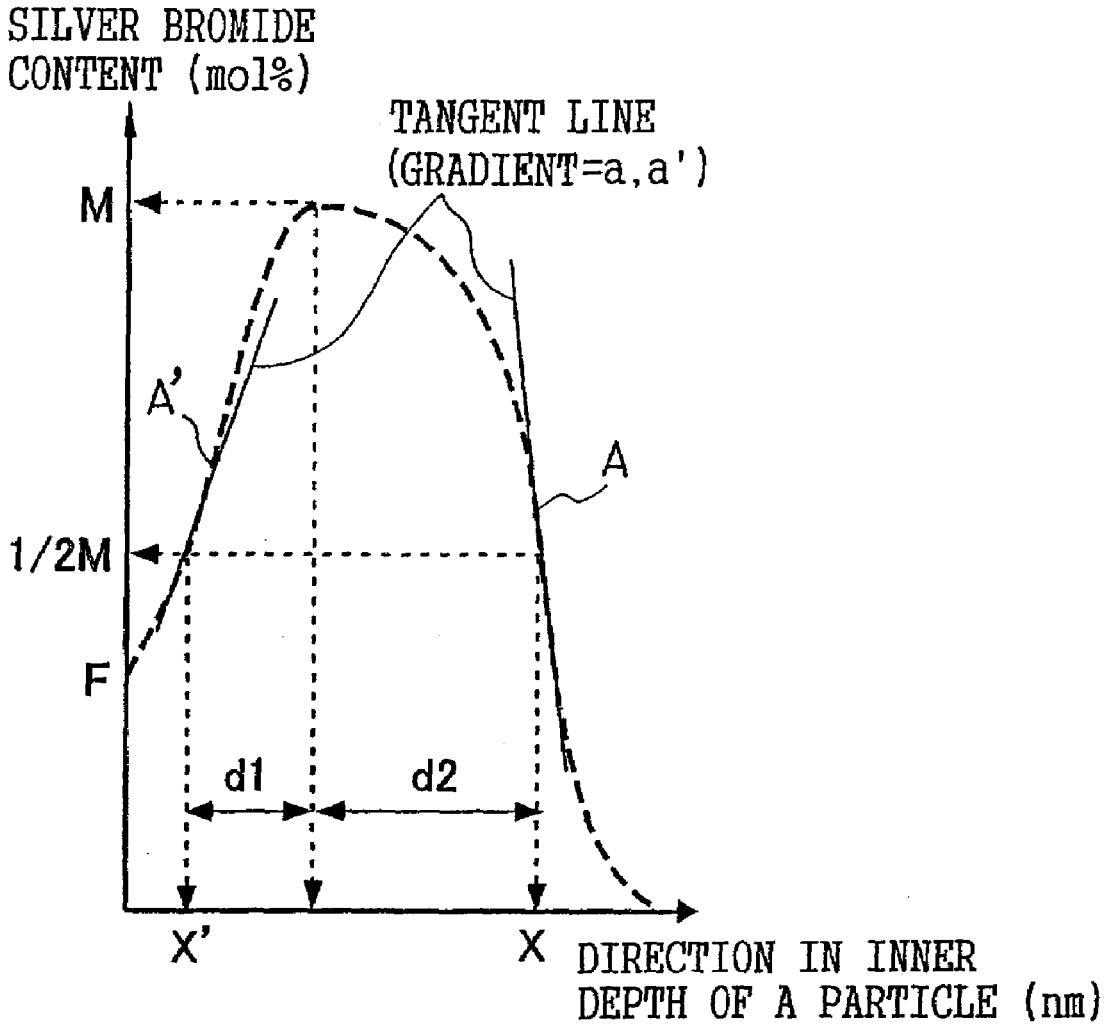
FIG. 1 shows an example of a graph of a curve of the silver bromide content contained in the silver bromide chloride particles of the present invention.

The present invention is described in detail below.

Silver Halide Emulsion

The particle form of the specific silver halide particles in the silver halide emulsion of the present invention is not particularly limited. Preferable examples of the particles include cubic particles substantially having {100} surface, tetrahedral crystal particles (these may have round particle tips and a higher surface), octahedral crystal particles and tabular particles in which a main plane has {100} surface or {111} surface and which have an aspect ratio of at least 2. The aspect ratio is a value obtained by dividing a diameter of a circle equivalent to a protect area by a thickness of a particle. In the present invention, cubic particles or tetrahedral particles are more preferable.

In the silver halide emulsion of the present invention, it is preferable that silver halide particles in which a variation coefficient of a sphere-equivalent diameter of all particles is 20% or less, a sphere-equivalent diameter is 0.4 μm or less, a silver bromide-containing phase and/or a silver iodide-containing phase is formed in laminar shape, and a silver bromide content is at least 90 mol % (hereinafter sometimes referred to as "specific silver halide particles") occupies at least 50% of a total project area of the all particles.

Here, the terms "all particles" means "all silver halide particles" contained in the silver halide emulsion of the present invention.

The specific silver halide particles in the present invention contain silver chloride, and the silver chloride content has to be at least 89 mol %. In view of a quick processability, the silver chloride content is preferably at least 93 mol %, more preferably at least 95 mol %. When greater stress is laid on the quick processability, the silver chloride content is preferably 89 to 99.7 mol %, more preferably 93 to 99.5 mol %, further preferably 95 to 98.5 mol %.

Further, the specific silver halide particles have to contain silver bromide and/or silver iodide. The silver bromide content has to be 0.25 to 10 mol %. For obtaining a high gradation and a low fogging, the silver bromide content is preferably 0.1 to 7 mol %, more preferably 0.5 to 5 mol %, further preferably 1 to 4 mol %. The silver iodide content is preferably 0.02 to 1 mol %, more preferably 0.05 to 1 mol %, further preferably 0.05 to 0.50 mol %, most preferably 0.07 to 0.40 mol %.

The specific silver halide particles of the present invention are preferably silver iodobromochloride particles or silver bromochloride particles. Silver iodochloride particles or silver bromochloride particles having the foregoing halogen composition are more preferable.

The specific silver halide particles in the silver halide emulsion of the present invention has a silver bromide-containing phase and/or a silver iodide-containing phase. The silver bromide-containing phase or the silver iodide-containing phase means a site in which the silver bromide content or the silver iodide content is higher than that in the surroundings. The halogen compositions of the silver bromide-containing phase or the silver iodide-containing phase and the surroundings may be changed either continuously or abruptly. Such a silver bromide-containing phase or silver iodide-containing phase may form a layer having a concentration with a nearly constant width in a certain portion within particles or may be a maximum point without a width. A local silver bromide content of the silver bromide-containing phase is preferably at least 5 mol %, more preferably 10 to 80 mol %, most preferably 15 to 50 mol %. A local silver iodide content of the silver iodide-containing phase is preferably at least 0.3 mol %, more preferably 0.5 to 8 mol %, most preferably 1 to 5 mol %. With respect to such a silver bromide-containing phase or silver iodide-containing phase, plural phases may be present in laminar shape within each particle, and the silver bromide or silver iodide content may be different in each particle. However, it is necessary to provide at least one of the silver bromide-containing phase and the silver iodide-containing phase, preferably at least one silver bromide-containing phase and at least one silver iodide-containing phase.

It is important that the silver bromide-containing phase or the silver iodide-containing phases of the silver halide emulsion in the present invention are present in laminar shape to surround the particle. A preferable embodiment is that each of the silver bromide-containing phases or the silver iodide-containing phases provided in laminar shape to surround the particle has a uniform concentration distribution in the circumferential direction of the particle. However, some silver bromide-containing phases or silver iodide-containing phases provided in laminar shape to surround the particle may have a concentration distribution in which a maximum point or a minimum point of the concentration of silver bromide or silver iodide is present in the circumferential direction of the particle. For example, when the silver bromide-containing phases or the silver iodide-containing phases are present near the surface of the particle in laminar shape to surround the particle, the concentration of silver bromide or silver iodide in the corner or the edge of the particle is sometimes different from the concentration in the main plane. Further, separately from the silver bromide-containing phases and the silver iodide-containing phases provided in laminar shape to surround the particle, a silver bromide-containing phase or a silver iodide-containing phase may be provided which is present in a specific portion on the surface of the particle completely independently and does not surround the particle.

In a curve of a silver bromide content which is decreased from a maximum point of a silver bromide-containing phase toward a surface of a particle and/or an inside of a particle, as shown in FIG. 1, absolute values (|a| and |a'|) of tangential inclinations (lines A and A' in FIG. 1) in positions X and X' showing half values of a silver bromide content M in a maximum point are preferably 0.1 to 50 mol %/nm, more preferably 1 to 20 mol %/nm. The "curve of a silver bromide content" here refers to a curve of a silver bromide content in an inner direction of a silver chlorobromide particle relative to a width direction of a particle.

Figure 2:
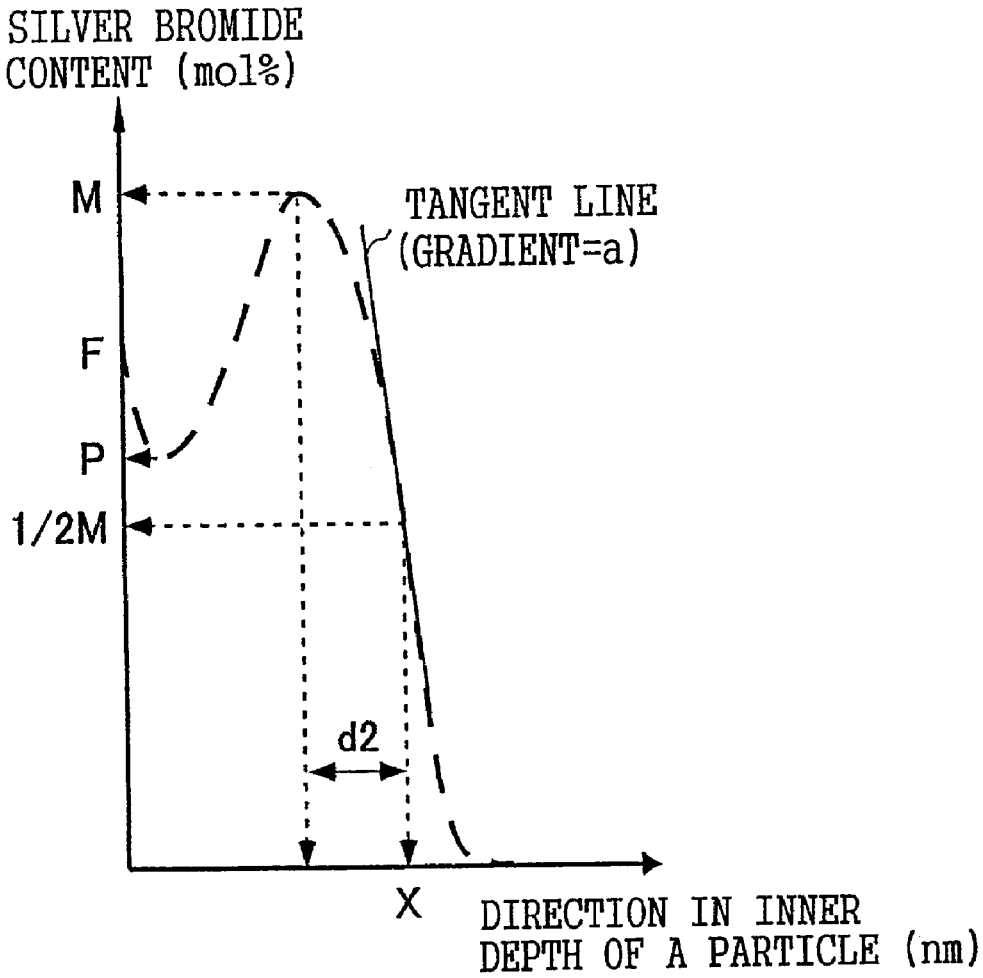
FIG. 2 shows an example of a graph of a curve of the silver bromide content contained in the silver bromide chloride particles of the present invention.

In the silver bromide-containing phase of the present invention, the change in the silver bromide content from the maximum point toward the surface of the particle is only decreased, or once decreased and then increased. In case of a silver bromide-containing phase having the latter change in the silver bromide content which is once decreased and then increased as shown in FIG. 2, a silver bromide content P in a point of change in which the content is changed from the decrease to the increase, relative to a silver bromide content M in a maximum point, preferably fulfills an equation $P \leqq 0.9 \times M$, more preferably $P \leqq 0.7 \times M$. Moreover, a silver bromide content F on the surface of the silver bromide particle (the "surface" here means a portion except the "inside" of the silver chlorobromide particle), relative to a silver bromide content M in a maximum point, preferably fulfills an equation $F \leqq 0.9 \times M$, more preferably $F \leqq 0.7 \times M$.

In the silver bromide-containing phase of the present invention, a distance d1 (distance in a particle surface direction) and d2 (distance in a particle inner direction) between a concentration maximum position (maximum point) of a bromide ion and positions X and X' showing half values of maximum concentrations is preferably $d1 < d2$, more preferably $d1 < 0.5 \times d2$. Further, the total of d1 and d2, relative to a radium R of a particle, preferably fulfills an equation $(d1+d2)/R \leqq 0.2$, more preferably $(d1 \times d2)/R \leqq 0.1$. A silver iodide content in a maximum point of the silver iodide-containing phase is preferably 5 to 95 mol %, more preferably 10 to 80 mol %.

When the silver halide emulsion of the present invention has the silver bromide-containing phase, it is preferable that the silver bromide-containing phase is provided in laminar shape such that a silver bromide concentration maximum exists inside the particle. Further, when the silver halide emulsion of the present invention has the silver iodide-containing phase, it is preferable that the silver iodide-containing phase is provided in laminar shape such that a silver iodide concentration maximum exists on the surface of the particle. In such a silver bromide-containing phase or silver iodide-containing phase, an amount of silver is preferably at least 3% and at most 30% of a particle volume, more preferably at least 3% and at most 15% of a particle volume in view of increasing a local concentration with the less content of silver bromide or silver iodide.

It is advisable that the silver halide emulsion of the present invention contains both of the silver bromide-containing phase and the silver iodide-containing phase. In this case, the silver bromide-containing phase and the silver iodide-containing phase may be present in the same position or different positions of the particle. For facilitating the control of the particle formation, it is preferable that they are present in different positions. Further, the silver bromide-containing phase may contain silver iodide, or the silver iodide-containing phase may contain silver bromide. Generally, since an iodide to be added during formation of high silver bromide particles is bled out on the surface of the particle more easily than a bromide, the silver iodide-containing phase tends to be formed near the surface of the particle. Accordingly, when the silver bromide-containing phase and the silver iodide-containing phase are present in different positions within the particle, it is advisable that the silver bromide-containing phase is formed more inside than the silver iodide-containing phase. In this case, another silver bromide-containing phase may be formed more outside than the silver iodide-containing phase near the surface of the particle.

The silver bromide content or the silver iodide content required to exhibit the effects such as a high sensitivity and a high gradation in the present invention is increased as the silver bromide-containing phase or the silver iodide-containing phase is formed inside the particle. The quick processability might be impaired by decreasing the silver chloride content more than as required. Accordingly, for intensifying these properties of controlling a photographic performance near the surface of the particle, it is advisable that the silver bromide-containing phase and the silver iodide-containing phase are adjacent to each other. In view of these points, it is preferable that the silver iodide-containing phase is formed in a position of 50 to 100% of the particle volume as measured from inside the particle and the silver iodide-containing phase is formed in a position of 85 to 100% of the particle volume. Further, it is more preferable that the silver iodide-containing phase is formed in a position of 70 to 95% of the particle volume and the silver iodide-containing phase is formed in a position of 90 to 100% of the particle volume.

In the introduction of a bromide or iodide ion for incorporating silver bromide or silver iodide in the silver halide emulsion of the present invention, a bromide or iodide solution may be added singly or in combination with addition of a silver salt solution and a high chloride solution. In the latter case, a bromide or iodide solution and a high chloride solution may be added separately or a mixed solution of a bromide or an iodide and a high chloride may be added. The bromide or the iodide is added in the form of a soluble salt such as an alkali metal or alkaline earth metal bromide or iodide. Alternatively, it can also be introduced by cleaving a bromide ion or an iodide ion from an organic molecule as described in U.S. Pat. No. 5,389,508. Further, silver bromide fine particles or silver iodide fine particles can also be used as another bromide or iodide source.

Moreover, silver halide fine particles containing silver bromide can also be used as a bromide ion source. The silver halide fine particles containing silver bromide can be formed by feeding and mixing an aqueous solution of a water-soluble silver salt and an aqueous solution of a bromide ion-containing water-soluble halide using a mixer described in JP-A No. 10-43570 separately from a reaction vessel for nucleation and/or growth of silver halide particles. In the mixer, the aqueous solution of the water-soluble silver salt, the bromide solution and the high chloride solution are introduced separately or the mixed solution of the bromide and the high chloride is introduced to form the silver bromide-containing silver halide fine particles. It is advisable that the silver bromide-containing silver halide fine particles formed in the mixer is added to the reaction vessel immediately after the formation. This is because after the formation, the particle size of the silver halide fine particles is increased by Ostward's aging and the particles are therefore hard to dissolve in the reaction vessel to suppress release of a bromide ion. Accordingly, the average project particle size of the silver bromide-containing silver halide fine particles is preferably less than 0.06 μm, more preferably 0.001 to 0.06 μm, further preferably 0.001 to 0.04 μm, most preferably 0.001 to 0.02 μm. With respect to the introduction of the bromide ion from the silver bromide-containing silver halide fine particles, the fine particles may be added to the reaction vessel independently or in combination with addition of the silver salt solution and the high chloride solution. Incidentally, as the silver bromide-containing silver halide fine particles, those having at least one transition metal complex to be described later may be used.

Further, the use of the silver bromide-containing silver halide fine particles as a silver bromide ion source can provide silver chlorobromide emulsion particles having a more uniform silver bromide-containing phase (with less unevenness of particles).

The addition of the bromide or iodide solution may be conducted intensively at some stage or over a fixed period of time during particle formation. The position in which to introduce an iodide ion into a high chloride emulsion is limited in view of obtaining an emulsion having a high sensitivity and a low fogging. In the introduction of the iodide ion, a sensitivity is less increased toward the inside of emulsion particles. Accordingly, the addition of the iodide solution is conducted from an outer portion of, preferably more than 50%, more preferably more than 70%, most preferably more than 85% of a particle volume. Moreover, the addition of the iodide solution is completed in an inner portion of, preferably less than 98%, more preferably less than 96% of a particle volume. An emulsion having a higher sensitivity and a lower fogging can be obtained by completing the addition of the iodide solution in a slightly inner portion from the particle surface.

Meanwhile, the addition of the bromide solution is conducted from an outer portion of, preferably more than 50%, more preferably more than 70% of a particle volume.

The distribution of the bromide or iodide ion concentration in the direction toward the depth direction within the particle can be measured by the etching/TOF-SIMS (Time of Flight-Secondary Ion Mass Spectrometry) method using, for example, TRIFT II model TOF-SIMS manufactured by Phi Evans. The TOF-SIMS method is specifically described in "*Hhyomen bunseki gijutsu sensho niji ion shitsuryo bunsekiho*" compiled by Nippon Hyomen Kagakukai, Maruzen (1999). Analysis of emulsion particles by the etching/TOF-SIMS method reveals that an iodide ion is bled out toward the particle surface even when the addition of the iodide solution is completed inside particles. In the emulsion of the present invention, it is preferable that in the analysis by the etching/TOF-SIMS method the iodide ion reaches the concentration maximum on the surface of the particle and the iodide ion concentration is decreased toward the inside of the particle and the bromide ion has the concentration maximum inside the particle. The local concentration of silver bromide can be measured by an X-ray diffraction method so long as the silver bromide content is high to some extent.

The sphere-equivalent diameter of each particle in the present specification is represented by a diameter of a sphere having a volume equivalent to a volume of each particle. It is advisable that the silver halide emulsion of the present invention is formed of particles having a monodispersed particle size distribution.

The variation coefficient of the sphere-equivalent diameter of all particles contained in the silver halide emulsion of the present invention is preferably 20% or less, more preferably 15% or less, further preferably 10% or less. The variation coefficient of the sphere-equivalent diameter is represented by percentage of a standard deviation of a sphere-equivalent diameter of each particle to an average sphere-equivalent diameter. At this time, for obtaining a wide latitude, it is preferable that the monodispersed emulsion is used by being blended in the same layer or coated through lamination.

The sphere-equivalent diameter of the specific silver halide particles contained in the silver halide emulsion of the present invention is preferably 0.4 μm or less, more preferably 0.35 μm or less, further preferably 0.3 μm or less. The lower limit of the sphere-equivalent diameter of the silver halide particles is preferably 0.05 μm, more preferably 0.1 μm. The particles having the sphere-equivalent diameter of 0.4 μm correspond to cubic particles having a side length of approximately 0.32 μm, the particles having the sphere-equivalent diameter of 0.35 μm to cubic particles having a side length of approximately 0.28 μm, and the particles having a sphere-equivalent diameter of approximately 0.3 μm to cubic particles having a side length of approximately 0.24 μM respectively.

The silver halide emulsion of the present invention may contain silver halide particles other than the specific silver halide particles. In the silver halide emulsion of the present invention, however, a ratio of the specific silver halide particles in the total project area of the all silver halide particles has to be at least 50%, and it is preferably at least 80%, more preferably at least 90%.

The electron slow-release time of the silver halide emulsion of the present invention is preferably between $10^{31\ 5}$ second and 10 seconds. The electron slow-release time here refers to a time that lapses from a time when photoelectrons generated in silver halide crystals are trapped in an electron trap present in the crystals to a time when they are released again. When the electron slow-release time is shorter than $10^{-5}$ second, a high sensitivity and a high gradation are hardly obtained in high-intensity exposure. When it is longer than 10 seconds, a problem of latent image sensitization occurs between exposure and processing for a short period time. The electron slow-release time is more preferably $10^{-4}$ second to 10 seconds, most preferably $10^{-3}$ second to 1 second.

The electron slow-release time can be measured by a double pulse photoconduction method. By a microwave photoconduction method or a radiofrequency wave photoconduction method, the first exposure for a short time is applied, and after a fixed period of time, the second exposure for a short time is then applied. In the first exposure, photoelectrons are trapped in an electron trap in silver halide crystals. Immediately after the first exposure, the second exposure is applied. Then, as the electron trap is filled with photoelectrons, a second photoconduction signal is enlarged. When the two exposures are conducted at a sufficient time interval and electrons trapped in the electron trap by the first exposure are already released, the second photoconduction signal is returned to approximately the original size. When the exposure interval between the two exposures is changed to take an exposure interval dependence of the second photoconduction signal strength, it is possible to measure the decrease in the second photoconduction signal strength according to the exposure interval. This is defined as the time of slowly releasing photoelectrons from the electron trap. The electron slow-release is sometimes continued for a fixed period of time after exposure. The slowly releasing is measured preferably for $10^{-5}$ second to 10 seconds, more preferably for $10^{-4}$ second to 10 seconds, further preferably for $10^{-3}$ second to 1 second.

The specific silver halide particles in the silver halide emulsion of the present invention contain iridium. Iridium is present preferably in the form of an iridium complex. A six-coordinate complex having 6 ligands and containing iridium as a central metal is preferable for uniformly incorporating iridium in a silver halide crystal. As an example of iridium used in the present invention, a six-coordinate complex having Cl, Br or I as ligands and containing Ir as a central metal is preferable. A six-coordinate complex in which all of six ligands are made of Cl, Br or I and Ir is a central metal is more preferable. In this case, Cl, Br or I may be contained in the six-coordinate complex. It is especially preferable that a six-coordinate complex having Cl, Br or I as ligands and containing Ir as a central metal is contained in a silver bromide-containing phase for obtaining a high gradation by high-intensity exposure.

Specific examples of the six-coordinate complex in which all of six ligands are made of Cl, Br or I and Ir is a central metal are listed below. However, iridium in the present invention is not limited thereto.

$[IrCl_6]^{2-}$
$[IrCl_6]^{3-}$
$[IrBr_6]^{2-}$
$[IrBr_6]^{3-}$
$[IrI_6]^{3-}$

As another example of iridium used in the present invention, a six-coordinate complex having at least one ligand except a halogen or a cyan and containing Ir as a central metal is preferable. A six-coordinate complex having $H_2O$, OH, O, OCN, thiazole or substituted thiazole as a ligand and containing Ir as a central metal is preferable. A six-coordinate complex in which at least one ligand is made of $H_2O$, OH, O, OCN, thiazole or substituted thiazole and the remaining ligands are made of Cl, Br or I and Ir is a central metal is more preferable. A six-coordinate complex in which one or two ligands are made of 5-methylthiazole and the remaining ligands are made of Cl, Br or I and Ir is a central metal is most preferable.

Specific examples of the six-coordinate complex in which at least one ligand is made of $H_2O$, OH, O, OCN, thiazole or substituted thiazole and the remaining ligands are made of Cl, Br or I and Ir is a central metal are listed below. However, iridium in the present invention is not limited thereto.

$[Ir(H_2O)Cl_5]^{2-}$
$[Ir(H_2O)_2Cl_4]^{-}$
$[Ir(H_2O)Br_5]^{2-}$
$[Ir(H_2O)Br_4]^{-}$
$[Ir(OH)Cl_5]^{3-}$
$[Ir(OH)_2Cl_4]^{3-}$
$[Ir(OH)Br_5]^{3-}$
$[Ir(OH)_2Br_4]^{3-}$
$[Ir(O)Cl_5]^{4-}$
$[Ir(O)_2Cl_4]^{5-}$
$[Ir(O)_2Br_5]^{4-}$
$[Ir(O)_2Br_4]^{5-}$
$[Ir(OCN)Cl_5]^{3-}$
$[Ir(OCN)Br_5]^{3-}$
$[Ir(thiazole)Cl_5]^{2-}$
$[Ir(thiazole)_2Cl_4]^{-}$
$[Ir(thiazole)_2Br_5]^{2-}$
$[Ir(thiazole)_2Br_4]^{-}$
$[Ir(5\text{-methylthiazole})Cl_5]^{2-}$
$[Ir(5\text{-methylthiazole})_2Cl_4]^{-}$
$[Ir(5\text{-methylthiazole})Br_5]^{2-}$
$[Ir(5\text{-methylthiazole})_2Br_4]^{31}$ The problem of the present invention is preferably attained by singly using either a six-coordinate complex in which all of six ligands are made of Cl, Br or I and Ir is a central metal or a six-coordinate complex having at least one ligand except a halogen or a cyan and containing Ir as a central metal. However, for more increasing the effects of the present invention, it is preferable to use a combination of a six-coordinate complex in which all of six ligands are made of Cl, Br or I and Ir is a central metal and a six-coordinate complex having at least one ligand except a halogen or a cyan and containing Ir as a central metal is preferable. Further, with respect to a six-coordinate complex in which at least one ligand is made of $H_2O$, OH, O, OCN, thiazole or substituted thiazole and the remaining ligands are made of Cl, Br or I and Ir is a central metal, it is preferable to use a complex made of two types of ligands (one type selected from $H_2O$, OH, O, OCN, thiazole and substituted thiazole and one type selected from Cl, Br and I).

The foregoing metal complexes are cationic ions. When these are formed into salts with anionic ions, counter anionic ions are preferably those which are soluble in water. Preferable examples thereof include alkali metal ions such as a sodium ion, a potassium ion, a rubidium ion, a cesium ion and a lithium ion, an ammonium ion and an alkylammonium ion. These metal complexes can be used by being dissolved in water or mixed solvents of water and appropriate water-miscible organic solvents (such as alcohols, ethers, glycols, ketones, esters and amides). These iridium complexes are added in amounts of, preferably $1\times10^{-10}$ mol to $1\times10^{-3}$ mol, most preferably $1\times10^{-8}$ mol to $1\times10^{-5}$ mol per mol of silver during particle formation.

In the present invention, it is advisable that the iridium complex is incorporated into the silver halide particles by directly adding the same to a reaction solution in the formation of the silver halide particles or to the halide aqueous solution for forming the silver halide particles or to other solution and then to the particle formation reaction solution. It is also advisable that the iridium complex is incorporated into the silver halide particles by physical aging with fine particles having the iridium complex previously incorporated therein. Further, it can also be contained into the silver halide particles by a combination of these methods.

When these complexes are incorporated into the silver halide particles, they are uniformly present within the particles. It is also advisable, as disclosed in JP-A Nos. 4-208936, 2-125245 and 3-188437, that they are present only on surface layers of the particles and that layers in which they are present only within the particles and are absent on surfaces of the particles are added. Further, as disclosed in U.S. Pat. Nos. 5,252,451 and 5,256,530, it is also advisable that the surface phase of the particles is modified by physical aging with fine particles having the complexes incorporated therein. Still further, a combination of these methods is also available, and plural types of the complexes may be incorporated into one silver halide particle. The halogen composition in the position in which the complex is contained is not particularly limited. It is preferable that a six-coordinate complex in which all of six ligands are made of Cl, Br or I and Ir is a central metal is contained in a position having a silver bromide concentration maximum.

In the present invention, a metal ion other than iridium can be doped in the inside and/or on the surface of the silver halide particle. As the metal ion used, a transition metal is preferable, and iron, ruthenium, osmium, lead, cadmium or zinc is especially preferable. It is more preferable that these metal ions are used in the form of a six-coordinate octahedral complex having ligands. When an inorganic compound is used as a ligand, it is preferable to use a cyanate ion, a halide ion, a thiocyan ion, a hydroxide ion, a peroxide ion, an azide ion, a nitrite ion, water, ammonia, a nitrosyl ion or a thionitrosyl ion. It is also preferably coordinated in the foregoing metal ion such as iron, ruthenium, osmium, lead, cadmium or zinc. It is also preferable to use plural ligands in one complex molecule. Moreover, an organic compound is also available as a ligand. As the organic compound, a chain compound having 5 or less carbon atoms in a main chain and/or a 5-membered or 6-membered heterocyclic compound is preferable. A compound having a nitrogen atom, a phosphorus atom, an oxygen atom or a sulfur atom in a molecule as a ligand to a metal is more preferable. Furan, thiophene, oxazole, iso-oxazole, thiazole, isothiazole, imidazole, pyrazole, triazole, furazane, pyran, pyridine, pyridazine, pyrimidine and pyrazine are especially preferable. Moreover, these compounds with substituents introduced are also preferable.

Preferable examples of the metal ion and the ligands include a combination of an iron ion and cyanate ions and a combination of a ruthenium ion and cyanate ions. In the present invention, the combined use of iridium and these compounds is preferable. In these combinations, it is preferable that the number of cyanate ions occupies more than half of the coordination number to iron or ruthenium as a central metal and the remaining coordination sites are occupied by thiocyan, ammonia, water, a nitrosyl ion, dimethyl sulfoxide, pyridine, pyrazine or 4,4'-bipyridine. It is most preferable that the six coordination sites of the central metal are all occupied by cyanate ions to form a hexacyano iron complex or a hexacyano ruthenium complex. The complex having these cyanate ions as ligands is added in an amount of, preferably $1\times10^{-8}$ mol to $1\times10^{-2}$ mol, more preferably $1\times10^{-6}$ mol to $5\times10^{-4}$ mol per mol of silver during particle formation. When ruthenium or osmium is used as a central metal, it is preferable to use a nitrosyl ion, a thionitrosyl ion or a water molecule and a chloride ion as ligands in combination. It is more preferable to form a pentachloronitrosyl complex, a pentachlorothionitrosyl complex or a pentachloroaquo complex and also to form a hexachloro complex. These complexes are added in amounts of, preferably $1\times10^{-10}$ mol to $1\times10^{-6}$ mol, more preferably $1\times10^{-9}$ mol to $1\times10^{-6}$ mol per mol of silver during particle formation.

The oxidation potential of the latent image of the silver halide emulsion in the present invention is preferably higher than 70 mV, more preferably higher than 100 mV. That the oxidation potential of the latent image is higher than 70 mV means that the oxidation resistance of the latent image is relatively high. The oxidation potential of the latent image can be measured by the method described in a known data, for example, Photographic Sensitivity, Oxford University Press, Tadaaki Tani, 1995, p. 103. Specifically, gradation exposure for 0.1 second is applied to a coating of a silver halide emulsion, and it is dipped in a redox bath having various potentials before development to measure a potential in which to bleach a latent image.

The silver halide emulsion of the present invention is usually subjected to chemical sensitization. As the chemical sensitization, sulfur sensitization typified by addition of an unstable sulfur compound, noble metal sensitization typified by gold sensitization and reduction sensitization can be used either singly or in combination. As a compound used in the chemical sensitization, those described in JP-A No. 62-215271, page 18, right lower column to page 22, right upper column are preferably used. Of these, compounds subjected to gold sensitization are more preferable because the gold sensitization can further minimize the change of the photographic performance in scanning exposure with a laser beam.

For the silver halide emulsion of the present invention to be subjected to gold sensitization, various inorganic gold compounds, gold (I) complexes having inorganic ligands and gold (I) compounds having organic ligands can be used. Preferable examples of the inorganic gold compounds include chloroauric acid and its salts, and preferable examples of the gold (I) complexes having inorganic ligands include dithiocyanic acid gold compounds such as gold (I) potassium dithiocyanate and dithiosulfuric acid gold compounds such as gold (I) trisodium dithiosulfate.

It is preferable that the silver halide emulsion of the present invention is subjected to gold sensitization with colloidal gold sulfide or a gold sensitizer having a complex stability constant log $\beta_z$ of gold, which means a stability constant of a gold complex contained in the gold sensitizer, being within a range from 21 to 35. A method of producing colloidal gold sulfide is described in "*Research Disclosure* 37154", *"Solid State Ionics"* vol. 79, pp. 60-66, 1995 and "*Compt. Rend. Hebt. Seances Acad. Sci. Sect. B"* vol. 263, p. 1328, 1996. As colloidal gold sulfide, those having various sizes can be used, and colloidal gold sulfide having a particle size of less than 50 nm is also available. The amount of colloidal gold sulfide can vary in a wide range as required. It is $5\times10^{-7}$ to $5\times10^{-3}$ mol, preferably $5\times10^{-6}$ to $5\times10^{-4}$ mol, as a gold atom, per mol of a silver halide. In the present invention, the gold sensitization may be combined with another sensitization, for example, sulfur sensitization, selenium sensitization, tellurium sensitization, reduction sensitization or noble metal sensitization using a noble metal other than a gold compound.

The gold sensitizer having a complex stability constant log $\beta_z$ of gold within a range from 21 to 35 is described below.

The measurement of the complex stability constant log $\beta_z$ of gold is described in "*Comprehensive Coordination Chemistry"* chap. 55, p. 864, 1987 and "*Encyclopedia of Electrochemistry of the Elements"* chap. IV-3, 1975, *"Journal of the Royal Netherlands Chemical Society"* vol. 101, p. 164, 1982, and other references. According to the measuring method described in these documents, the complex stability constant log $\beta_z$ of gold is obtained from a gold potential which is measured at a measurement temperature of 25° C. with an ionic strength of 0.1 M (KBr) by adjusting pH to 6.0 with a potassium dihydrogenphosphate/disodium hydrogenphosphate buffer. In this measurement, log $\beta_2$ of a thiocyanate ion is 20.5 which is close to 20, a value described in a literature ("*Comprehensive Coordination Chemistry"* (1987) chap. 55, p. 864, Table 2).

The gold sensitizer having the complex stability constant log $\beta_2$ of gold within a range from 21 to 35 in the present invention is preferably represented by formula (I).

$$\{L^1)\times(Au)_y(L^2)_z\cdot Q_q\}_p \qquad \text{formula (I).}$$

In formula (I), $L^1$ and $L^2$, independently from each other, represent a compound having log $\beta_2$ of 21 to 35. A compound having log $\beta_2$ of 22 to 31 is preferable, and a compound having log $\beta_2$ of 24 to 28 is more preferable.

Examples of $L^1$ and $L^2$ include a compound containing at least one unstable sulfur group capable of forming silver sulfide by a reaction with a silver halide, a hydantoin compound, a thioether compound, a mesoionic compound, —SR', a heterocyclic compound, a phosphine compound, amino acid derivatives, sugar derivatives or a thiocyano group. These may be the same or different. R' represents an aliphatic hydrocarbon group, an aryl group, a heterocyclic group, an acyl group, a carbamoyl group, a thiocarbamoyl group or a sulfonyl group.

Q represents a counter anion or a counter cation required for neutralizing a charge of a compound, x and z each represent an integer of 0 to 4, y and p each represent 1 or 2, and q represents a value of 0 to 1 including a decimal, provided x and z are not 0 at the same time.

With respect to preferable compounds represented by formula (I), $L^1$ and $L^2$ each represent a compound containing at least one unstable sulfur group capable of forming silver sulfide by are action with a silver halide, a hydantoin compound, a thioether compound, a mesoionic compound, —SR', a heterocyclic compound or a phosphine compound, and x, y and z each represent 1.

With respect to more preferable compounds represented by formula (I), $L^1$ and $L^2$ each represent a compound containing at least one unstable sulfur group capable of forming silver sulfide by a reaction with a silver halide, a mesoionic compound or —SR', and x, y, z and p each represent 1.

The gold compounds represented by formula (I) are described in more detail below.

In formula (I), examples of a compound containing at least one unstable sulfur group capable of forming silver sulfide by a reaction with a silver halide as represented by $L^1$ and $L^2$ include thioketones (such as thioureas, thioamides and rhodanines), thiophosphates and thiosulfates.

Preferable examples of a compound containing at least one unstable sulfur group capable of forming silver sulfide by a reaction with a silver halide include thioketones (preferably, thioureas and thioamides) and thiosulfates.

Next, in formula (I), examples of a hydantoin compound represented by $L^1$ and $L^2$ include unsubstituted hydantoin and N-methylhydantoin. Examples of a thioether compound include linear or cyclic thioethers having 1 to 8 thio groups which are bound with a substituted or unsubstituted linear or branched alkylene group (such as ethylene or triethylene) or a phenylene group. Specific examples thereof include bishydroxyethylthio ether, 3,6-dithia-1,8-octanediol and 1,4,8,11-tetracyclotetradecane. Examples of a mesoionic compound include mesoionic-3-mercapto-1,2,4-triazoles (such as mesoionic-1,4,5-trimethyl-3-mercapto-1,2,4-triazole).

When $L^1$ and $L^2$ in formula (I) represent —SR', examples of an aliphatic hydrocarbon group represented by R' include a substituted or unsubstituted linear or branched alkyl group having 1 to 30 carbon atoms (such as methyl, ethyl, isopropyl, n-propyl, n-butyl, t-butyl, 2-pentyl, n-hexyl, n-octyl, t-octyl, 2-ethylhexyl, 1,5-dimethylhexyl, n-decyl, n-dodecyl, n-tetradecyl, n-hexadecyl, hydroxyethyl, hydroxypropyl, 2,3-dihydroxypropyl, carboxymethyl, carboxyethyl, sodiumsulfoethyl, diethylaminoethyl, diethylaminopropyl, butoxypropyl, ethoxyethoxyethyl or n-hexyloxypropyl), a substituted or unsubstituted cyclic alkyl group having 3 to 18 carbon atoms (such as cyclopropyl, cyclopentyl, cyclohexyl, cyclooctyl, adamantyl or cyclododecyl), an alkenyl group having 2 to 16 carbon atoms (such as allyl, 2-butenyl or 3-pentenyl), an alkinyl group having 2 to 10 carbon atoms (such as propargyl or 3-pentinyl) and an aralkyl group having 6 to 16 carbon atoms (such as benzyl) Examples of an aryl group include substituted or unsubstituted phenyl and naphthyl groups (such as unsubstituted phenyl, unsubstituted naphthyl, 3,5-dimethylphenyl, 4-butoxyphenyl, 4-dimethylaminophenyl and 2-carboxyphenyl). Examples of the heterocyclic group include a substituted or unsubstituted 5-membered nitrogen-containing heterocyclic ring (such as imidazolyl, 1,2,4-triazolyl, tetrazolyl, oxadiazolyl, thiadiazolyl, benzoimidazolyl or purinyl), a substituted or unsubstituted 6-membered nitrogen-containing heterocyclic ring (such as pyridyl, piperidyl, 1,3,5-triazino or 4,6-dimercapto-1,3,5-triazino), a furyl group and a thiethyl group. Examples of an acyl group include acetyl and benzoyl. Examples of a carbamoyl group include dimethylcarbamoyl. Examples of a thiocarbamoyl group include diethylthiocarbamoyl. Examples of a sulfonyl group include a substituted or unsubstituted alkylsulfonyl group having 1 to 10 carbon atoms (such as methanesulfonyl and ethanesulfonyl), and a substituted or unsubstituted phenylsulfonyl group having 6 to 16 carbon atoms (such as phenylsulfonyl).

With respect to —SR' represented by $L^1$ and $L^2$, R' is preferably an aryl group or a heterocyclic group, more preferably a heterocyclic group, further preferably a 5-membered or 6-membered nitrogen-containing heterocyclic group, most preferably a nitrogen-containing heterocyclic group substituted with a water-soluble group (such as sulfo, carboxy, hydroxy or amino).

Examples of the heterocyclic compound represented by $L^1$ and $L^2$ in formula (I) include substituted or unsubstituted 5-membered nitrogen-containing heterocyclic compounds (such as pyrroles, imidazoles, pyrazoles, 1,2,3-triazoles, 1,2,4-triazoles, tetrazoles, oxazoles, iso-oxazoles, isothiazoles, oxadiazoles, thiadiazoles, pyrrolidines, pyrrolines, imidazolidines, imidazolines, pyrazolidines, pyrazolines and hydantoins), heterocyclic compounds containing a 5-membered ring (such as indoles, isoindoles, indolidines, indazoles, benzoimidazoles, purines, benzotriazoles, carbazoles, tetrazaindenes, benzothiazoles and indolines), substituted or unsubstituted 6-membered nitrogen-containing heterocyclic compounds (such as pyridines, pyrazines, pyrimidines, pyridazines, triazines, thiadiazines, piperidines, piperazines and morpholines), heterocyclic compounds containing a 6-membered ring (such as quinolines, isoquinolines, phthaladines, naphthylidines, quinoxalines, quinazolines, pteridines, phenathridines, acridines, phenanthrolines and phenazines), substituted or unsubstituted furans, substituted or unsubstituted thiophenes and benzothiazoliums.

Preferable examples of a heterocyclic compound represented by $L^1$ and $L^2$ include 5-membered or 6-membered unsaturated nitrogen-containing compounds and heterocyclic compounds containing the same. Specific examples thereof include pyrroles, imidazoles, pirazoles, 1,2,4-triazoles, oxazoles, thiadiazoles, imidazolines, indoles, indolidines, indazoles, benzoimidazoles, purines, benzotriazoles, carbazoles, tetrazaindenes, benzothiazoles, pyridines, pyrazines, pyrimidines, pyridazines, triazines, quinolines, isoquinolines and phtharazines. Further, heterocyclic compounds known to those skilled in the art as an anti-fogging agent (such as imidazoles, benzoimidazoles, benzotriazoles and tetraazaindenes) are preferable.

Examples of a phosphine compound represented by $L^1$ and $L^2$ in formula (I) include phosphines substituted with an aliphatic hydrocarbon group having 1 to 30 carbon atoms, an aryl group having 6 to 20 carbon atoms, a heterocyclic group (such as pyridyl), a substituted or unsubstituted amino group (such as dimethylamino) and/or an alkyloxy group (such as methyloxy or ethyloxy). Preferable are phosphines substituted with an alkyl group having 1 to 10 carbon atoms or an aryl group having 6 to 12 carbon atoms (such as triphenylphosphine and triethylphosphine).

Further, it is preferable that the mesoionic compound, —SR' and the heterocyclic compound represented by $L^1$ and $L^2$ are substituted with an unstable sulfur group capable of forming silver sulfide by a reaction with a silver halide (for example, a thioureido group).

Moreover, the compound represented by $L^1$ and $L^2$ in formula (I) may have as many substituents as possible. Examples of the substituent include a halogen atom (such as a fluorine atom, a chlorine atom or a bromine atom), an aliphatic hydrocarbon group (such as methyl, ethyl, isopropyl, n-propyl, t-butyl, n-octyl, cyclopentyl or cyclohexyl), an alkenyl group (such as allyl, 2-butenyl or 3-pentenyl), an alkinyl group (such as propargyl or 3-pentinyl), an aralkyl group (such as benzyl or phenetyl), an aryl group (such as phenyl, naphthyl or 4-methylphenyl), a heterocyclic group (such as pyridyl, furyl, imidazolyl, piperidinyl or morphoryl), an alkyloxy group (such as methoxy, ethoxy, butoxy, 2-ethylhexyloxy, ethoxyethoxy or methoxyethoxy), an aryloxy group (such as phenoxy or 2-naphthyloxy), an amino group (such as unsubstituted amino, dimethylamino, diethylamino, dipropylamino, dibutylamino, ethylamino, dibenzylamino or anilino), an acylamino group (such as acetylamino or benzoylamino), a ureido group (such as unsubstituted ureido, N-methylureido or N-phenylureido), a thioureido group (such as unsubstituted thioureido, N-methylthioureido or N-phenylthioureido), a selenoureido group (such as unsubstituted selenoureido), a phosphineselenido group (such as diphenylphosfineselenido), a telluroureido group (such as unsubstituted telluroureido) a urethane group (such as methoxycarbonylamino or phenoxycarbonylamino), a sulfonamido group (such as methylsulfonamide or phenylsulfonamide), a sulfamoyl group (such as unsubstituted sulfamoyl, N,N-dimethylsulfamoyl or N-phenylsulfamoyl), a carbamoyl group (such as unsubstituted carbamoyl, N,N-diethylcarbamoyl or N-phenylcarbamoyl), a sulfonyl group (such as methanesulfonyl or p-toluenesulfonyl), a sulfinyl group (such as methylsulfinyl or phenylsulfinyl), an alkyloxycarbonyl group (such as methoxycarbonyl or ethoxycarbonyl), an aryloxycarbonyl group (such as phenoxycarbonyl), an acyl group (such as acetyl, benzoyl, formyl or pivaloyl), an acyloxy group (such as acetoxy or benzoyloxy), a phosphoric acid amide group (such as N,N-diethylphosphoric acid amide), an alkylthio group (such as methylthio or ethylthio), an arylthio group (such as phenylthio), a cyano group, a sulfo group, a thiosulfonic acid group, a sulfinic acid group, a carboxy group, a hydroxy group, a mercapto group, a phosphono group, a nitro group, a sulfino group, an ammonio group (such as trimethylammonio), a phosphonio group, a hydrazino group, a thiazolino group, and a silyloxy group (such as t-butyldimethylsilyloxy or t-butyldiphenylsilyloxy). When there are two or more substituents, they may be the same or different.

Q and q in formula (I) are described below.

Examples of a counter anion represented by Q in formula (I) include a halogenium ion (such as $F^-$, $Cl^-$, $Br^-$ or $I^-$), a tetrafluoroborate ion ($BF_4^-$), a hexafluorophosphate ion ($PF_6^-$), a sulfate ion ($SO_4^{2-}$), an arylsulfonate ion (such as a p-toluenesulfonate ion or a naphthalene-2,5-disulphonate ion), and a carboxy ion (such as an acetate ion, a trifluoroacetate ion, an oxalate ion or a benzoate ion). Examples of a counter cation represented by Q include an alkali metal ion (such as a lithium ion, a sodium ion, a potassium ion, a rubidium ion or a cesium ion), an alkaline earth metal ion (such as a magnesium ion or a calcium ion), a substituted or unsubstituted ammonium ion (such as an unsubstituted ammonium ion, a triethylammonium ion or a tetramethylammonium ion), a an substituted or unsubstituted pyridinium ion (such as an unsubstituted pyridinium ion or a 4-phenylpyridinium ion), and a proton. Further, q is the number of Q for neutralizing a charge of a compound, and represents a value of 0 to 1, and its value may be a decimal.

Preferable examples of the counter anion represented by Q include a halogenium ion (such as $Cl^-$ or $Br^-$), a tetrafluoroborate ion, a hexafluorophosphate ion and a sulfate ion. Preferable examples of the counter cation represented by Q include an alkali metal ion (such as a sodium ion, a potassium ion, a rubidium ion or a cesium ion), a substituted or unsubstituted ammonium ion (such as an unsubstituted ammonium ion, a triethylammonium ion or a tetramethylammonium ion), and a proton.

Specific examples (L-1 to L-17) of the compound represented by $L^1$ or $L^2$ are listed below. However, the present invention is not limited thereto. Incidentally, the parenthesized value indicates log $\beta_2$.

(L-1)

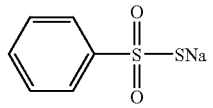

(22)

(L-2)

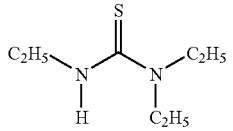

(24)

(L-3)

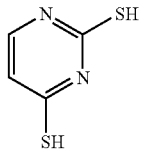

(25)

(L-4)

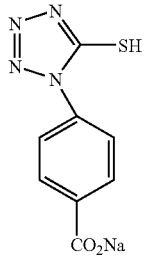

(25)

(L-5)

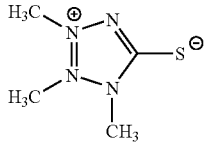

(26)

(L-6)

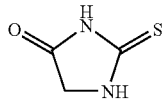

(27)

-continued (L-7)

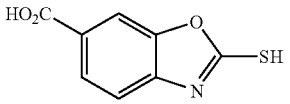

(27)

(L-8)

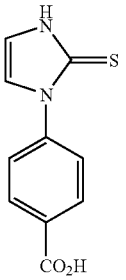

(27)

(L-9)

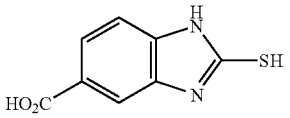

(27)

(L-10)

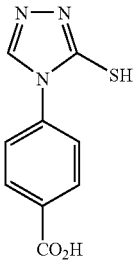

(27)

(L-11)

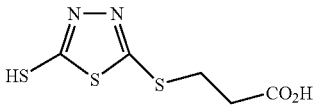

(27)

(L-12)

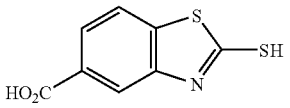

(27)

(L-13)

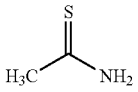

(28)

(L-14)

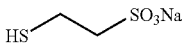

(28)

(L-15)

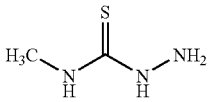

(29)

(L-16)

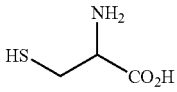

(29)

-continued (L-17)

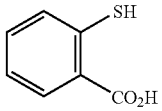

(30)

The compound represented by formula (I) can be formed according to a known method described in, for example, "*INORG. NUCL. CHEM. LETTERS*" vol. 10, p. 641, 1974, transition Met. Chem., p. 1248, 1976, Acta. Cryst. B32, p. 3321, 1976, JP-A No. 8-69075, JP-B No. 45-8831, EP 915371A1 and JP-A Nos. 6-11788, 6-501789, 4-267249 and 9-118685.

Specific examples (S-1 to S-19) of the compound represented by formula (I) are listed below. However, the present invention is not limited thereto.

(S-1)

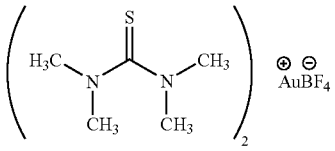

(S-2)

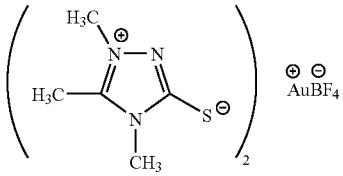

(S-3)

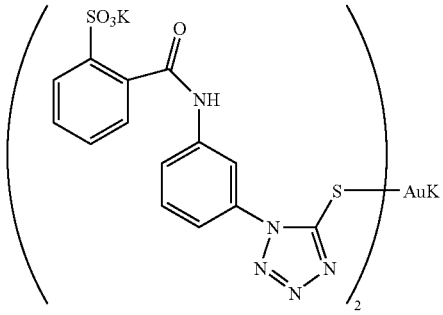

(S-4)

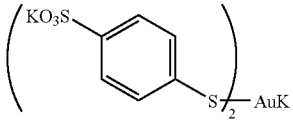

(S-5)

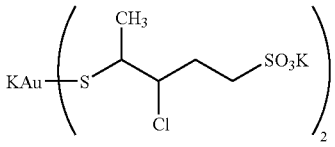

-continued
(S-6)
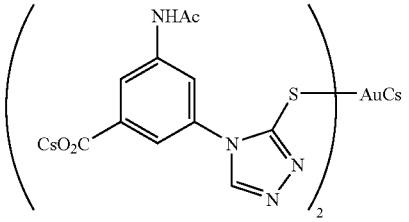
(S-7)
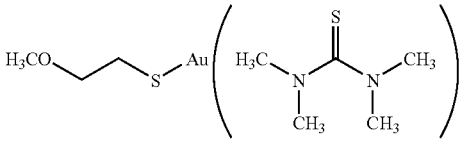
(S-8)
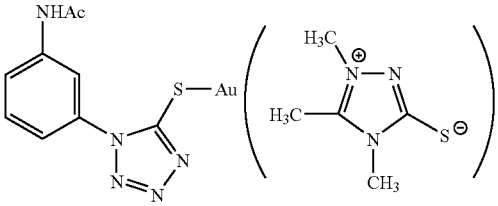
(S-9)
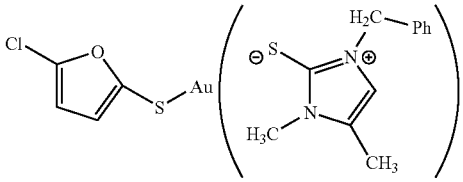
(S-10)
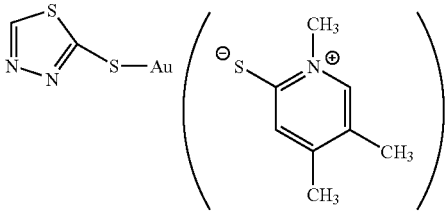
(S-11)
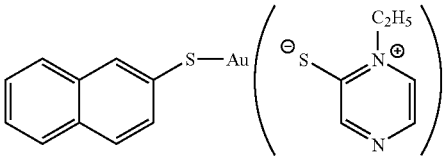
(S-12)
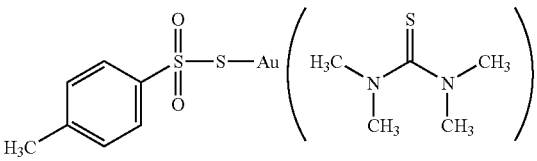
-continued
(S-13)
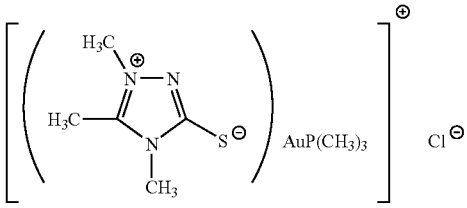
(S-14)
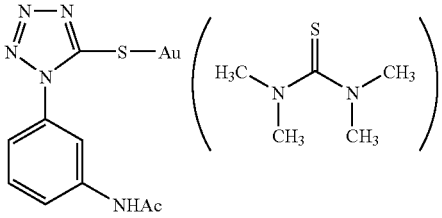
(S-15)
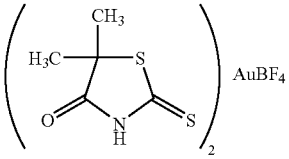
(S-16)
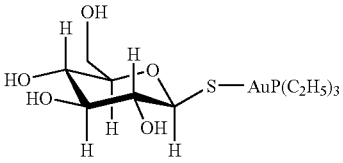
(S-17)
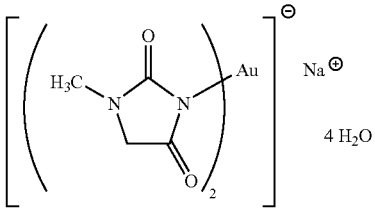
(S-18)
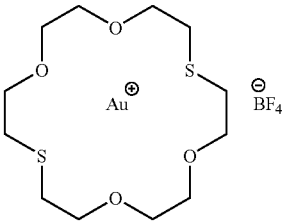
(S-19)
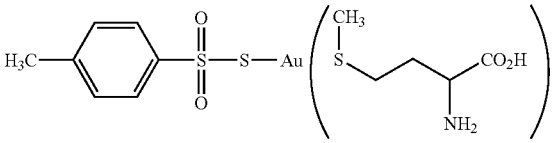

The gold sensitization in the present invention is usually conducted by adding a gold sensitizer and stirring an emulsion at a high temperature (preferably 40° C. or more) for a fixed period of time. The amount of the gold sensitizer varies with conditions. It is preferably at least $1\times10^{-7}$ mol and at most $1\times10^{-4}$ mol per mol of a silver halide.

As the gold sensitizer in the present invention, the foregoing compounds are available, and they can be used in combination with ordinary gold compounds (such as chloroaurates, potassium chloroaurate, auric trichloride, potassium auric thiocyanate, potassium iodoaurate, tetracyanoauric acid, ammonium aurothiocyanate, and pyridyl trichlorogold).

The silver halide emulsion of the present invention can be subjected to the gold sensitization and other chemical sensitization in combination. Examples of the chemical sensitization used in combination can include sulfur sensitization, selenium sensitization, tellurium sensitization, noble metal (except gold) sensitization and reduction sensitization. As a compound used in the chemical sensitization, those described in JP-A 62-215272, page 18, right lower column to page 22, right upper column are preferable.

The silver halide emulsion of the present invention can contain various compounds or precursors thereof for preventing fogging or stabilizing a photographic performance during production, storage or photographic processing of a photosensitive material. As the compounds, those described in JP-A No. 62-215272, pages 39 to 72 are preferably used. Further, 5-arylamino-1,2,3,4-thiatriazole compounds (the aryl residue has at least one electron attractive group) described in EP 0447647 are also preferably used.

In the present invention, for enhancing a storage stability of the silver halide emulsion, hydroxamic acid derivatives described in JP-A No. 11-109576, cyclic ketones having a double bond in which both ends adjacent to a carbonyl group are substituted with an amino group or a hydroxyl group as described in JP-A No. 11-327094 (especially those represented by formula (S1); the description in paragraphs [0036] to [0071] can be employed in the present specification), sulfo-substituted catecols or hydroquinones (such as 4,5-dihydroxy-1,3-benzenedisulfonic acid, 2,5-dihydroxy-1,4-benzenedisulfonic acid, 3,4-dihydroxybenzenesulfonic acid, 2,3-dihydroxybenzenesulfonic acid, 2,5-dihydroxybenzenesulfonic acid, 3,4,5-trihydroxybenzenesulfonic acid, and salts thereof) described in JP-A No. 11-143011, hydroxylamines represented by formula (A) of U.S. Pat. No. 5,556,741 (the description in U.S. Pat. No. 5,556,741, col. 4, line 56 to col. 11 line 22 can preferably be applied to the present invention and employed as a part of the present specification), and water-soluble reducing agents represented by formulas (I) to (III) of JP-A No. 11-102045 are preferably used also in the present invention.

Further, the silver halide emulsion of the present invention can contain a spectral sensitization dye for imparting a so-called spectral sensitivity which shows a sensitivity in a desired optical wavelength region. As spectral sensitization dyes used in spectral sensitizations in blue, green and red regions, for example, those described in F. M. Harmer, "*Heterocyclic compounds—Cyanine dyes and related compounds*", John Wiley & Sons, New York London, 1964 can be mentioned. With respect to specific examples of the compounds and a spectral sensitization method, those described in JP-A 62-215272, page 22, right upper column to page 38 are preferably employed. Further, as a red sensitive spectral sensitization dye of silver halide emulsion particles having a high content of silver chloride, spectral sensitization dyes described in JP-A No. 3-123340 are quite desirable in view of a stability, an adsorption strength and a temperature dependence of exposure.

The amounts of these spectral sensitization dyes are over a wide range, and preferably within a range from $0.5\times10^{-6}$ mol to $1.0\times10^{-2}$ mol, more preferably within a range from $1.0\times10^{-6}$ mol to $5.0\times10^{-3}$ mol per mol of a silver halide.

Silver Halide Photosensitive Material

The silver halide photosensitive material of the present invention is described below.

The silver halide photosensitive material of the present invention may be a monochromic material or a color material. Preferably, the silver halide emulsion of the present invention is used in a silver halide color photosensitive material.

The silver halide color photosensitive material (hereinafter simply referred to sometimes as a "photosensitive material") in which the silver halide emulsion of the present invention is preferably used is a silver halide color photosensitive material having at least one silver halide emulsion layer containing a yellow dye-forming coupler, at least one silver halide emulsion layer containing a magenta dye-forming coupler and at least one silver halide emulsion layer containing a cyan dye-forming coupler on a substrate, characterized in that at least one of the silver halide emulsion layers contains the silver halide emulsion of the present invention. In the present invention, the silver halide emulsion layer containing the yellow dye-forming coupler functions as a yellow-developing layer, the silver halide emulsion layer containing the magenta dye-forming coupler as a magenta-developing layer, and the silver halide emulsion layer containing the cyan dye-forming coupler as a cyan-developing layer respectively. It is preferable that the silver halide emulsions contained in the yellow-developing layer, the magenta-developing layer and the cyan-developing layer have sensitivities to lights having different wavelength regions (for example, lights having a blue region, a green region and a red region).

The photosensitive material of the present invention may have, other than the yellow-developing layer, the magenta-developing layer and the cyan-developing layer, a hydrophilic colloidal layer, an anti-halation layer, an intermediate layer and a color layer to be described later as required.

Known photographic materials and additives can be used in the photosensitive material of the present invention.

As a photographic substrate, for example, a transmission-type substrate or a reflection-type substrate can be used. As the transmission-type substrate, a substrate in which an information recording layer such as a magnetic layer is formed on a cellulose nitrate film, a transparent film of polyethylene terephthalate, a polyester film of 2,6-naphthalenedicarboxylic acid (NDCA) and ethylene glycol (EG) or a polyester film of DNCA, terephthalic acid and EG is preferably used. As the reflection-type substrate, a substrate laminated with plural polyethylene layers or polyester layers, in which at least one of such water-resistant resin layers (laminate layers) contains a white pigment such as titanium oxide, is preferable.

In the present invention, a more preferable reflection-type substrate is a substrate in which a polyolefin layer having micropores is provided on a paper base where a silver halide emulsion layer is formed. The polyolefin layer maybe formed of plural layers. In this case, it is especially preferable that a polyolefin (for example, polypropylene or polyethylene) layer adjacent to a gelatin layer on the side of the silver halide emulsion layer is free from micropores, and a polyolefin (for example, polypropylene or polyethylene)

layer having micropores is formed on the side close to the paper base. The density of the polyolefin multilayer or single layer located between the paper base and the photographic layer is preferably 0.40 to 1.0 g/ml, more preferably 0.50 to 0.70 g/ml. Further, the thickness of the polyolefin multilayer or single layer located between the paper base and the photographic layer is preferably 10 to 100 μm, more preferably 15 to 70 μm. Moreover, the thickness ratio of the polyolefin layer and the paper base is preferably 0.05 to 0.2, more preferably 0.1 to 0.15.

For increasing a rigidity of the reflection-type substrate, it is advisable that the polyolefin layer is formed on the opposite side (reverse surface) of the paper base to the photographic layer. In this case, as the polyolefin layer on the reverse surface, a polyethylene or polypropylene layer having a delustered surface is preferable. Of these, a polypropylene layer is more preferable. The thickness of the polyolefin layer on the reverse surface is preferably 5 to 50 μm, more preferably 10 to 30 μm. Moreover, the density is preferably 0.7 to 1.1 g/ml. In the reflection-type substrate of the present invention, preferable examples of the polyolefin layer formed on the paper base are described in JP-A Nos. 10-333277, 10-333278, 11-52513 and 11-65024, EP 0880065 and EP 0880066.

In addition, it is advisable that the water-resistant resin layer contains a fluorescent brightener. As a hydrophilic colloidal layer having the fluorescent brightener dispersed therein may be formed separately. As the fluorescent brightener, benzoxazole-based, coumalin-based and pyrazoline-based fluorescent brighteners are preferable. Of these, benzoxazolylnaphthalene-based and benzoxazolylstilben-based fluorescent brighteners are more preferable. The amount of the fluorescent brightener is not particularly limited, and it is preferably 1 to 100 mg/m$^2$. A mixing ratio of the fluorescent brightener when mixed in the water-resistant resin layer is preferably 0.0005 to 3% by mass, more preferably 0.001 to 0.5% by mass based on the resin.

The substrate may be the transmission-type substrate or the reflection-type substrate on which a hydrophilic colloidal layer containing a white pigment is coated. Further, the reflection-type substrate may be a substrate having a mirror reflection or class II diffuse reflection metal surface.

As the substrate used in the photosensitive material of the present invention, a white polyester substrate or a substrate in which a layer containing a white pigment is formed on the side of a silver halide emulsion layer may be used for display. Further, for improving a sharpness, it is advisable to coat an anti-halation layer on the side of the substrate on which the silver halide emulsion layer is coated or on the reverse surface. Especially, for viewing a display through reflected light or transmitted light, it is advisable to set a transmission density of the substrate at 0.35 to 0.8.

For improving a sharpness of an image, it is advisable that dyes (especially, oxonol dyes) capable of decoloration by treatment as described in EP 0337490A2, pages 27 to 76 are added to the hydrophilic colloidal layer in the photosensitive material of the present invention such that an optical reflection density of the photosensitive material at 680 nm reaches at least 0.70 or that titanium oxide surface-treated with dihydric to tetrahydric alcohols (for example, trimethylolethane) is incorporated in the water-resistant resin layer of the substrate in an amount of 12% by mass or more (preferably 14% by mass or more).

In the photosensitive material of the present invention, for preventing irradiation or halation and improving a safety of safe light, it is advisable that dyes (especially oxonol dyes and cyanine dyes) capable of decoloration by treatment as described in EP 0337490A2, pages 27 to 76 are added to the hydrophilic colloidal layer. Further, dyes described in EP 0819977 are also added preferably to the photosensitive material of the present invention. Some of these water-soluble dyes worsen color separation or a safety of safe light. As dyes which can be used without worsening color separation, water-soluble dyes described in JP-A Nos. 5-127324, 5-127325 and 5-216185 are more preferable.

In the present invention, a color layer capable of decoloration by treatment is used instead of water-soluble dyes or along with water-soluble dyes. The color layer capable of decoloration by treatment may be directly contacted with an emulsion layer or may be contacted therewith through an intermediate layer containing a color mixing inhibitor such as gelatin or hydroquinone. It is advisable that this color layer is formed on a lower layer (substrate side) of an emulsion layer that develops the same original color of the color layer. It is possible that color layers corresponding to respective original colors are all formed separately or that only some of color layers are selectively formed. It is also possible to form color layers having colors corresponding to plural original color regions. With respect to an optical reflection density of the color layer, an optical density value in a wavelength of the highest optical density is preferably at least 0.2 and at most 3.0, more preferably at least 0.5 and at most 2.5, especially preferably at least 0.8 and at most 2.0 in a wavelength region used in exposure (a visible light region of 400 nm to 700 nm in usual printer exposure and a wavelength region of a scanning exposure light source used in scanning exposure).

A known method can be applied to form the color layer. Examples thereof include a method in which dyes in the state of a solid fine particle dispersion, such as dyes described in JP-A No. 2-282244, page 3, right upper column to page 8 or dyes described in JP-A No. 3-7931, page 3, right upper column to page 11, left lower column, are incorporated in a hydrophilic colloidal layer, a method in which anionic dyes are moldanted with a cationic polymer, a method in which dyes are adsorbed on fine particles of a silver halide and fixed within a layer, and a method using colloidal silver as described in JP-A No. 1-239544. As a method of dispersing fine particles of the dye in a solid state, for example, a method in which a dye fine powder substantially water-insoluble at pH of at most 6 but water-soluble at pH of at least 8 is incorporated is described in JP-A No. 2-308244, pages 4 to 13. Further, a method in which the anionic dyes are moldanted with a cationic polymer is described in JP-A No. 2-84637, pages 18 to 26. A method of preparing colloidal silver as a light absorber is described in U.S. Pat. Nos. 2,688,601 and 3,459,563. Of these methods, a method in which a dye fine powder is incorporated and a method using colloidal silver are preferable.

The silver halide photosensitive material of the present invention is used as a color negative film, a color positive film, a color reversible film, a color reversible photographic printing paper and a color photographic printing paper. It is preferably used as a color photographic printing paper. The color photographic printing paper has preferably at least one yellow-developing silver halide emulsion layer, at least one magenta-developing silver halide emulsion layer and at least one cyan-developing silver halide emulsion layer. Generally, these silver halide emulsion layers are arranged such that the yellow-developing silver halide emulsion layer, the magenta-developing silver halide emulsion layer and the cyan-developing silver halide emulsion layer in this order are located closer to the substrate.

However, it is also possible to employ the different layer structure.

The silver halide emulsion layer containing a yellow coupler may be located in any position on the substrate. When silver halide tabular particles are present in the yellow coupler-containing layer, it is preferable that this layer is coated on a position which is more remote from the substrate than at least one of the magenta coupler-containing silver halide emulsion layer and the cyan coupler-containing silver halide emulsion layer. Further, in view of color developing acceleration, desilverization acceleration and decrease in residual color with a sensitization dye, it is preferable that the yellow coupler-containing silver halide emulsion layer is coated on a position which is most remote from the substrate relative to the other silver halide emulsion layers. Still further, in view of the decrease in Blix fading, it is preferable that the cyan coupler-containing silver halide emulsion layer is located as a central layer between the other silver halide emulsion layers. In view of the decrease in light fading, it is preferable that the cyan coupler-containing silver halide emulsion layer is located as the lowermost layer. Moreover, each of the yellow-, magenta- and cyan-developing layers may be made of two or three layers. For example, as described in JP-A Nos. 4-75055, 9-114035 and 10-246940 and U.S. Pat. No. 5,576,159, it is also preferable that a coupler layer free from a silver halide emulsion is formed adjacent to a silver halide emulsion layer as a color-developing layer.

As the silver halide emulsion employed in the present invention, the other materials (additives and the like) and the photographic layer (layer arrangement and the like) and a method and additives used to process the photosensitive material, those described in JP-A Nos. 62-215272 and 2-33144 and EP 0355660A2 are preferably used, and those described in EP 0355660A2 are especially preferably used. Further, a silver halide color photosensitive material and its processing method described in JP-A Nos. 5-34889, 4-359249, 4-313753, 4-270344, 5-66527, 4-34548, 4-145433, 2-854, 1-158431, 2-90145, 3-194539 and 2-93641 and European Patent Laid-Open No. 0520457A2 are also preferable.

Especially, in the present invention, with respect to the reflection-type substrate, the silver halide emulsion, the various metal ions doped in the silver halide particles, the storage stabilizer or the anti-fogging agent of the silver halide emulsion, the chemical sensitization method (sensitizer), the spectral sensitization method (spectral sensitizer), the cyan, magenta and yellow couplers, the emulsion dispersion method thereof, the color image preserving agent (anti-staining agent or anti-fading agent), the dyes (color layers), the gelatins, the layer structure of the photosensitive material and the coating pH of the photosensitive material, those described in patents shown in Table 1 below are especially preferable.

TABLE 1

| Item | JP-A No. 7-104448 | JP-A No. 7-77775 | JP-A No. 7-301895 |
|---|---|---|---|
| Reflection-type substrate | column 7 line 12-column 12 line 19 | column 35 line 43-column 44 line 1 | column 5 line 40-column 9 line 26 |
| Silver halide emulsion | column 72 line 29-column 74 line 18 | column 44 line 36-column 46 line 29 | column 77 line 48-column 80 line 28 |
| Various metal ions | column 74 lines 19-44 | column 46 line 30-column 47 line 5 | column 80 line 29-column 81 line 6 |
| Storage stabilizer or anti-fogging agent | column 75 lines 9-18 | column 47 lines 20-29 | column 18 line 11-column 31 line 37 (especially mercapto-heterocyclic compounds) |
| Chemical sensitization method (chemical sensitizer) | column 74 line 45-column 75 line 6 | column 47 lines 7-17 | column 81 lines 9-17 |
| Spectral sensitization method (spectral sensitizer) | column 75 line 19-column 76 line 45 | column 47 line 30-column 49 line 6 | column 81 line 21-column 82 line 48 |
| Cyan coupler | column 12 line 20-column 39 line 49 | column 62 line 50-column 63 line 16 | column 88 line 49-column 89 line 16 |
| Yellow coupler | column 87 line 40-column 88 line 3 | column 63 lines 17-30 | column 89 lines 17-30 |
| Magenta coupler | column 88 lines 4-18 | column 63 line 3-column 64 line 11 | column 31 line 34-column 77 line 44 & column 88 lines 32-46 |
| Coupler emulsion dispersion method | column 71 line 3-column 72 line 11 | column 61 lines 36-49 | column 87 lines 35-48 |
| Color image preserving agent (anti-staining agent) | column 39 line 50-column 70 line 9 | column 61 line 50-column 62 line 49 | column 87 line 49-column 88 line 48 |
| Anti-fading agent | column 70 line 10-column 71 line 2 | | |
| Dye (colorant) | column 77 line 42-column 78 line 41 | column 7 line 14-column 19 line 42 & column 50 line 3-column 51 line 14 | column 9 line 27-column 18 line 10 |
| Gelatins | column 78 lines 42-48 | column 51 lines 15-20 | column 83 lines 13-19 |
| Layer structure of photosensitive material | column 39 lines 11-26 | column 44 lines 2-35 | column 31 line 38-column 32 line 33 |
| Coating pH of photosensitive material | column 72 lines 12-28 | | |
| Scanning exposure | column 76 line 6-column 77 line 41 | column 49 line 7-column 50 line 2 | column 82 line 49-column 83 line 12 |
| Preservative in developing solution | column 88 line 19-column 89 line 22 | | |

As the cyan, magenta and yellow couplers used in the present invention, couplers described in JP-A No. 62-215272, page 91, right upper column, line 4 to page 121, left upper column, line 6, JP-A No. 2-33144, page 3, right upper column, line 14 to page 18, left upper column, last line and page 30, right upper column, line 6 to page 35, right lower column, line 11, and EP 0355660A2, page 4 lines 15 to 27, page 5 line 30 to page 28 last line, page 45 lines 29 to 31 and page 47 line 23 to page 63 line 50 are also available.

Further, in the present invention, compounds represented by formulas (II) and (III) as described in WO-98/33760 and compounds represented by formula (D) as described in JP-A No. 10-221825 are preferably used.

As the cyan dye-forming coupler (hereinafter sometimes referred to simply as "cyan coupler") available in the present invention, pyrrolotriazole-based couplers are preferably used, and couplers represented by formula (I) or (II) as described in JP-A No. 5-313324, couplers represented by formula (I) as described in JP-A No. 6-347960 and couplers listed in these documents are especially preferable. Further, phenol-based and naphthol-based cyan couplers are also preferable. For example, cyan couplers represented by formula (ADF) as described in JP-A No. 10-333297 are preferable. As other couplers, pyrroloazole-based cyan couplers described in EP 0488248 and EP 0491197A1, 2,5-diacylaminophenol couplers described in U.S. Pat. No. 5,888,716 and pyrazoloazole-based cyan couplers having an electron attractive group and a hydrogen bonding group in the 6-position as described in U.S. Pat. Nos. 4,873,183 and 4,916,051 are preferable. Especially, pyrazoloroazole-based cyan couplers having a carbamoyl group in the 6-position as described in JP-A Nos. 8-171185, 8-311360 and 8-339060 are also preferable.

Further, diphenylimidazole-based cyan couplers described in JP-A No. 2-33144, 3-hydroxypyridine-based cyan couplers described in EP 0333185A2 (of these, a 2-equivalent coupler obtained by introducing a chlorine leaving group into 4-equivalent coupler (42), coupler (6) and coupler (9) listed specifically are especially preferable), cyclic active methylene-based cyan couplers described in JP-A No. 64-32260 (of these, couplers 3, 8 and 34 listed specifically are especially preferable), pyrrolopyrazole-based cyan couplers described in EP 0456226A1 and pyrroloimidazole-based cyan couplers described in EP 0484909 can also be used.

Incidentally, of these cyan couplers, pyrroloazole-based cyan couplers represented by formula (I) as described in JP-A No. 11-282138 are especially preferable. Those described in paragraphs [0012] to [0059] of the same document, including cyan couplers (1) to (4), are applied as such to the present invention, and preferably employed as a part of the present specification.

As the magenta dye-forming coupler (hereinafter sometimes referred to simply as "magenta coupler") available in the present invention, 5-pyrazolone-based magenta couplers and pyrazoloazole-based magenta couplers described in a known literature shown in Table 1 are used. Of these, pyrazolotriazole couplers with a secondary or tertiary alkyl group directly bound to the 2-, 3- or 6-position of a pyrazolotriazole ring as described in JP-A No. 61-65245, pyrazoloazole couplers containing a sulfonamide group in a molecule as described in JP-A No. 61-65246, pyrazoloazole couplers having an alkoxyphenylsulfonamide ballast group as described in JP-A No. 61-147254 and pyrazoloazole couplers having an alkoxy group or an aryloxy group in the 6-position as described in EP 226849A and EP 294785A are preferably used in view of a hue, an image stability and color development. Especially, as the magenta coupler, pyrazoloazole couplers represented by formula (M-I) as described in JP-A No. 8-122984 are preferable, and those listed in paragraphs [0009] to [10026] of the same document are applied as such to the present invention, and employed as a part of the present specification. In addition, pyrazoloazole couplers having steric hindrance groups in both the 3- and 6-positions as described in EP 854384 and 884640 are also preferably used.

As the yellow dye-forming coupler (hereinafter sometimes referred to simply as "yellow coupler"), besides the compounds shown in Table 1, acylacetamide-based yellow couplers having a 3- to 5-membered cyclic structure in an acyl group as described in EP 0447969A1, malondianilide-based yellow couplers having a cyclic structure as described in EP 0482552A1, pyrrol-2-yl, pyrrol-3-yl, indol-2-ylorindol-3-yl carbonylacetanilide-based couplers described in European Patent Laid-Open Nos. 953870A1, 953871A1, 953872A1, 953873A1, 953874A1 and 953875A1, and acylacetamide-based yellow couplers having a dioxane structure as described in U.S. Pat. No. 5,118,599 are preferably used. Of these, acylacetamide-based yellow couplers in which an acyl group is a 1-alkylcyclopropane-1-carbonyl group and malondianilide-based yellow couplers in which one anilide forms an indoline ring are especially preferable. These couplers can be used either singly or in combination.

It is advisable that the couplers used in the present invention are emulsion-dispersed in a hydrophilic colloidal aqueous solution by being dipped in a loadable latex polymer (for example, those described in U.S. Pat. No. 4,203,716) in the presence (or in the absence) of a high-boiling organic solvent as shown in Table 1 or by being dissolved with a water-insoluble and organic solvent-soluble polymer. As the water-insoluble and organic solvent-soluble polymer, homopolymers and copolymers described in U.S. Pat. No. 4,857,449, columns 7 to 15 and International Laid-Open WO 88/00723, pages 12 to 30 are preferable. Of these, methacrylate-based or acrylamide-based polymers are more preferable, and acrylamide-based polymers are especially preferable in view of a color image stability.

In the present invention, known color mixing inhibitors can be used. Those described in the following patents are preferable.

For example, high-molecular redox compounds described in JP-A No. 5-333501, phenidone-based and hydrazine-based compounds described in WO 98/33760 and U.S. Pat. No. 4,923,787 and white couplers described in JP-A Nos. 5-249637 and 10-282615 and German Patent No. 19629142A1 can be used. Further, when the pH of the developing solution is increased to expedite the development, redox compounds described in German Patent No. 19618786A1, EP 839623A1, EP 842975A1, German Patent No. 19806846A1 and French Patent No. 2760460A1 are preferably used.

In the present invention, it is advisable that a compound having a triazine structure with a high molar absorptivity is used as an ultraviolet absorber. For example, compounds described in the following known documents are available. These are preferably added to a photosensitive layer or/and a non-photosensitive layer. For example, compounds described in JP-A Nos. 46-3335, 55-152776, 5-197074, 5-232630,5-307232, 6-211813, 8-53427, 8-234364, 8-239368, 9-31067, 10-115898, 10-147577 and 10-182621, German Patent No. 19739797A, EP 711804A and JP-Y No. 8-501291.

As the binder or the protecting colloid which can be used in the photosensitive material of the present invention, gelatins are advantageous. Other hydrophilic colloids can be used either singly or in combination with gelatins. Gelatins in which a heavy metal such as iron, copper, zinc or manganese is contained as an impurity in an amount of 5 ppm or less are preferable, and gelatins containing the heavy metal in an amount of 3 ppm or less are more preferable. Further, an amount of calcium contained in the photosensitive material is preferably 20 $mg/m^2$ or less, more preferably 10 $mg/m^2$ or less, most preferably 5 $mg/m^2$ or less.

In the present invention, in order to inhibit fungi or bacteria that are grown in a hydrophilic colloidal layer to degrade an image, it is advisable to add fungicides or bactericides described in JP-A No. 63-271247. Moreover, the coating pH of the photosensitive material is preferably 4.0 to 7.0, more preferably 4.0 to 6.5.

In the present invention, in view of improving a coating stability, preventing generation of static electricity and adjusting a charge amount on the photosensitive material, a surfactant can be added to the photosensitive material. Examples of the surfactant include an anionic surfactant, a cationic surfactant, a betaine-based surfactant and a non-ionic surfactant. For example, those described in JP-A No. 5-333492 are proposed. As the surfactant used in the present invention, fluorine-containing surfactants are preferably used. These fluorine-containing surfactants may be used either singly or in combination with other known surfactants. The combined use of the same with other known surfactants is preferable. The amounts of these surfactants added to the photosensitive material are, though not particularly limited, generally $1\times10\times^{-5}$ to 1 $g/m^2$, preferably $1\times10^{-4}$ to $1\times10^{-2}$ $g/m^2$, more preferably $1\times10^{-3}$ to $1\times10^{2}$ g/m.

The photosensitive material of the present invention can form an image by an exposure step of applying light according to an image information and a development step of developing the photosensitive material with light applied.

The photosensitive material of the present invention is used in an ordinary printing system using a negative printer, and it is also suitable for a scanning exposure system using a cathode ray tube (CRT). A cathode ray tube exposure device is simple and compact compared with a device using a laser, which leads to cost reduction. Further, it is also easy to adjust an optical axis or a color. In the cathode ray tube used in the image exposure, various luminous materials that show luminescence in spectral regions as required are used. For example, a red luminous material, a green luminous material and a blue luminous material are used either singly or in combination. The spectral regions are not limited to the red, green and blue regions. A fluorescent material that shows luminescence in a yellow, orange, purple or infrared region is also used. Especially, a cathode ray tube that shows white luminescence by mixing these luminous materials is often used.

When the photosensitive material has plural photosensitive layers different in spectral sensitivity distribution and the cathode ray tube has a fluorescent material that shows luminescence in plural spectral regions, it is possible to allow luminescence from the surface of the cathode ray tube by exposing plural colors at a time, namely by inputting image signals of plural colors into the cathode ray tube. It is also possible to employ a method in which image signals of respective colors are successively inputted to successively allow luminescence of these colors and exposure is conducted through a film that cuts other colors (surface successive exposure). Generally, the surface successive exposure is preferable in view of a high image quality because a high-resolution cathode ray tube can be used.

The photosensitive material of the present invention is preferably used in a digital scanning exposure system using a monochromic high-density light such as a gas laser, a light-emitting diode, a semiconductor laser or a second harmonics generating (SHG) light source which is a combination of a semiconductor laser or a solid state laser using a semiconductor laser as an excitation light source and non-linear optical crystals. In order to make the system compact and less costly, it is preferable to use a semiconductor laser or a harmonics generating light source (SHG) which is a combination of a semiconductor laser or a solid state laser and non-linear optical crystals. Especially for designing a device which is compact, less costly, long in life and high in stability, it is preferable to use a semiconductor laser. It is preferable that at least one of exposure light sources is a semiconductor laser.

In case of using such a scanning exposure light source, a maximum wavelength of a spectral sensitivity in the photosensitive material of the present invention can optionally be determined depending on a wavelength of a scanning exposure light source used. An SHG light source which is a combination of a solid state laser using a semiconductor laser as an excitation light source or a semiconductor laser and non-linear optical crystals can halve an oscillation wavelength of a laser to obtain blue light and green light. Accordingly, a maximum spectral sensitivity of the photosensitive material can be provided in ordinary three wavelength regions of blue, green and red. When a pixel size at a pixel density of 400 dpi is defined as an exposure time, the exposure time in this scanning exposure is preferably $10^{-4}$ second or less, more preferably $10^{-6}$ second or less.

The silver halide color photosensitive material of the present invention can preferably be used in combination with exposure and development systems described in the following known data. Examples of the development system include an automatic printing and developing systems described in JP-A No. 10-333253, a photosensitive material feeding device described in JP-A No. 2000-10206, a recording system including an image read-out unit as described in JP-A 11-215312, an exposure system comprising a color image recording system as described in JP-A No. 11-88619 and JP-A No. 10-202950, a digital photoprint system including a remote control diagnostic method as described in JP-A No. 10-210206, and a photoprint system including an image recording device as described in JP-A No. 10-159187.

The preferable scanning exposure system that can be applied to the present invention is described in detail in the patents shown in Table 1.

When the photosensitive material of the present invention is subjected to printer exposure, it is preferable to use a band stop filter described in U.S. Pat. No. 4,880,726. Light color mixing is thereby eliminated to markedly improve a color reproducibility.

In the present invention, copying regulation may be applied by subjecting a yellow microdot pattern to pre-exposure before providing an image information as described in EP 0789270A1 and EP 0789480A1.

For processing the photosensitive material of the present invention, processing materials and processing methods described in JP-A No. 2-207250, page 26, right lower column, line 1 to page 34, right upper column, line 9 and JP-A No. 4-97355, page 5, left upper column, line 17 to page 18, right lower column, line 20 can preferably be employed.

Further, as a preservative used in the developing solution, the compounds described in the patents shown in Table 1 are preferably used.

The present invention is preferably applied to a photosensitive material having a quick processability. When the quick processing is conducted in the present invention, the color developing time is preferably at most 60 seconds, more preferably at most 50 seconds and at least 6 seconds, most preferably at most 30 seconds and at least 6 seconds. Likewise, the bleach-fixing time is preferably at most 60 seconds, more preferably at most 50 seconds and at least 6 seconds, most preferably at most 30 seconds and at least 6 seconds. Further, the water-washing or stabilization time is preferably at most 150 seconds, more preferably at most 130 seconds and at least 6 seconds.

Incidentally, a color developing time refers to a time that lapses from charging of the photosensitive material in the color developing solution till charging of the same in a bleach-fixing solution in the subsequent processing step. For example, in the processing with an automatic developing machine, a total of a time for which the photosensitive material is dipped in a color developing solution (so-called a solution time) and a time for which the photosensitive material is separated from the color developing solution and transported in air toward a bleach-fixing bath in the next processing step (so-called an air time) is called a color developing time. Likewise, a bleach-fixing time refers to a time that lapses from charging of the photosensitive material in a bleach-fixing solution till subsequent water-washing or charging of the same in a stabilization bath. Further, a water-washing or stabilization time refers to a time that lapses during residence of the photosensitive material in a solution toward a drying step from charging of the same in a water-washing or stabilization solution (so-called a solution time).

As a method of developing the photosensitive material of the present invention after exposure, ordinary wet methods such as a method in which a photosensitive material is developed with a developing solution containing an alkali agent and a developing agent and a method in which a photosensitive material containing a developing agent therein is developed with an activator solution such as an alkaline solution free from a developing agent, and a thermal developing method without using a processing solution can be employed. Especially, the activator method makes it easy to control or handle a processing solution because the processing solution is free from a developing agent, and it is also preferable in view of environmental preservation because of less load in disposal of an effluent.

In the activator method, as the developing agent or its precursor incorporated in the photosensitive material, for example, hydrazine-based compounds described in JP-A Nos. 8-234388, 9-152686, 9-152693, 9-211814 and 9-160193 are preferable.

Further, a developing method in which a coating amount of silver in the photosensitive material is decreased and image amplifying processing (image intensifying processing) is conducted with hydrogen peroxide is also preferably used. It is especially preferable to use this method in the activator method. Specifically, an image forming method using an activator solution containing hydrogen peroxide as described in JP-A Nos. 8-297354 and 9-152695 is preferably employed. In the activator method, the photosensitive material is processed with the activator solution, and then subjected to ordinary desilverization. However, in the image amplifying processing method using a photosensitive material having a low silver content, it is possible to conduct a simple method such as water-washing or stabilization with desilverization omitted. Moreover, in a method in which an image information is read out from a photosensitive material using a scanner, processing in which desilverization is dispensed with can be employed even in case of using a photosensitive material having a high silver content, such as a photosensitive material for photography.

As the activator solution, the desilverization solution (bleach-fixing solution), the processing materials of the water-washing solution and the stabilization solution and the processing method used in the present invention, known ones can be used. Those described in Research Disclosure Item 36544 (September 1994), pp. 536-541 and JP-A No. 8-234388 can preferably be employed.

In the foregoing description, an especially preferred embodiment (embodiment (1-4)) of the invention is the silver halide emulsion, wherein a content of the silver chloride in the silver halide particles is at least 90 mol % and the silver halide particles comprise silver bromide-containing phase which has the maximum point where the silver bromide content ratio is at a maximum value, which maximum point is inside the silver particles.

In the foregoing description, an especially preferred embodiment (embodiment (1-5)) of the invention is the silver halide emulsion of the embodiment (1-4), wherein a content of the silver bromide decreases in a direction from the maximum point toward the surface of the silver halide particles and the direction from the maximum point toward the inside of the silver halide particles.

In the foregoing description, an especially preferred embodiment (embodiment (1-6)) of the invention is the silver halide emulsion of the embodiment (1-4), wherein the silver bromide content is changed from decreasing to increasing in a direction from the maximum point toward the surface of the silver halide particles and the silver bromide content decreases in a direction toward the inside of the silver halide particles.

In the foregoing description, an especially preferred embodiment (embodiment (1-7)) of the invention is the silver halide emulsion of the embodiment (1-4), wherein the silver bromide-containing phase is formed using silver halide fine particles containing silver bromide, which are formed by adding and mixing an aqueous solution of a water-soluble silver salt and an aqueous solution of a bromide ion-containing water-soluble halide in a mixer disposed separately from a reaction vessel for at least one of nucleating and growing silver halide particles.

In the foregoing description, an especially preferred embodiment (embodiment (1-8)) of the invention is the silver halide emulsion of the embodiment (1-6), wherein in the silver bromide-containing phase, an amount of silver bromide P of a point of change, where the amount of silver bromide is changed from decreasing to increasing in a direction from the maximum point toward the surface of the silver halide particle, relative to an amount of silver bromide content M at the maximum point, fulfills an equation $P \leqq 0.9 \times M$.

In the foregoing description, an especially preferred embodiment (embodiment(1-9)) of the invention is the silver halide emulsion of the embodiment (1-7), wherein an average projected particle diameter of the silver halide fine particles containing silver bromide is less than 0.06 μm.

In the foregoing description, an especially preferred embodiment (embodiment 1-10), of the invention is the silver halide emulsion of the embodiments (1-5), (1-7) and (1-9), wherein in the silver bromide-containing phase, an amount of silver bromide F on the surface of the silver halide particle, relative to the amount of silver bromide M at the maximum point, fulfills an equation $F \leqq 0.9 \times M$.

In the foregoing description, an especially preferred embodiment (embodiment (1-11)) of the invention is the silver halide emulsion of the embodiments (1-5) to (1-10), wherein, in the decrease in the direction toward the surface and/or the inside of the silver halide particle in the silver bromide-containing phase, absolute values of tangential gradients of silver bromide content curves in positions showing half values of maximum concentrations are 0.1 to 50 mol %/nm.

In the foregoing description, an especially preferred embodiment (embodiment (1-12)) of the invention is the silver halide emulsion of the embodiments (1-5) to (1-11), wherein a distance d1 from the maximum point to the position showing the half value of the maximum concentration in the direction toward the surface of the silver halide particle is smaller than a distance d2 from the maximum point to the position showing the half value of the maximum concentration in the direction toward the inside of the silver halide particle.

In the foregoing description, an especially preferred embodiment (embodiment 1-13)) of the invention is the silver halide emulsion of the embodiment (1-12), wherein the total of the distance d1 and the distance d2 (d1+d2), relative to a radius R of the silver halide particle, fulfills an equation $(d1+d2)/R<0.2$.

In the foregoing description, an especially preferred embodiment (embodiment (1-14)) of the invention is the silver halide emulsion of the embodiments (1-5) to (1-13), wherein the amount of the silver bromide at the maximum point of the silver bromide-containing phase is 5 to 95 mol %.

In the foregoing description, an especially preferred embodiment (embodiment (1-15)) of the invention is the silver halide emulsion of the embodiments (1-5) to (1-14), wherein the main plane of the silver halide particle is formed by a surface (100).

In the foregoing description, an especially preferred embodiment (embodiment (1-16)) of the invention is the silver halide emulsion of the embodiments (1-5) to (1-15), wherein the silver halide particles contain at least one transition metal complex.

In the foregoing description, an especially preferred embodiment (embodiment (1-17)) of the invention is the silver halide emulsion of the embodiments (1-5) to (1-16), wherein the silver bromide-containing phase contains at least one transition metal complex.

In the foregoing description, an especially preferred embodiment (embodiment (1-18)) of the invention is the silver halide emulsion of the embodiments (1-7) to (1-17), wherein the silver bromide-containing phase of the silver halide particles is formed using silver halide fine particles containing the silver bromide containing at least one transition metal complex and formed with the mixer.

In the foregoing description, an especially preferred embodiment (embodiment (1-19)) of the invention is a silver halide color photosensitive material having at least one blue sensitive silver halide emulsion layer, at least one green sensitive silver halide emulsion layer and at least one red sensitive silver halide emulsion layer on a substrate, in which at least one of the blue sensitive silver halide emulsion layer, the green sensitive silver halide emulsion layer and the red sensitive silver halide emulsion layer contains the silver halide emulsion of the embodiments (1-5) to (1-18).

In the foregoing description, an especially preferred embodiment (embodiment (2-1)) of the invention is the silver halide emulsion, wherein the silver halide particles comprise an amount of the silver chloride of at least 90 mol %, and the silver bromide-containing laminar phase, and are doped with a six-coordinate complex, which has iridium as a central metal.

In the foregoing description, an especially preferred embodiment (embodiment 2-2)) of the invention is the silver halide emulsion of the embodiment (2-1), wherein the silver bromide-containing phase is formed inside the particle.

In the foregoing description, an especially preferred embodiment (embodiment (2-3)) of the invention is the silver halide emulsion of the embodiment (2-1) or (2-2), wherein the silver bromochloride particles are cubic or tetradecahedral particles.

In the foregoing description, an especially preferred embodiment (embodiment (2-4)) of the invention is the silver halide emulsion of any of the embodiments (2-1) to (2-3), wherein the six-coordinate complex having iridium as a central metal has Cl, Br or I as a ligand.

In the foregoing description, an especially preferred embodiment (embodiment (2-5)) of the invention is the silver halide emulsion of the embodiment (2-4), wherein the six-coordinate complex having iridium as a central metal is contained in the silver bromide-containing phase.

In the foregoing description, an especially preferred embodiment (embodiment (2-6)) of the invention is the silver halide emulsion of any of the embodiments (2-1) to (2-3), wherein the six-coordinate complex having iridium as a central metal contains at least one non-halogen as a ligand.

In the foregoing description, an especially preferred embodiment (embodiment (2-7)) of the invention is the silver halide emulsion of any of the embodiments (2-1) to (2-6), wherein the silver halide emulsion is gold-sensitized.

In the foregoing description, an especially preferred embodiment (embodiment (2-8)) of the invention is the silver halide emulsion of the embodiment (2-7), wherein the silver halide emulsion is gold-sensitized with colloidal gold sulfide or a gold sensitizer, in which a complex stability constant log $\beta_2$ of gold is within a range from 21 to 35.

In the foregoing description, an especially preferred embodiment (embodiment (2-9)) of the invention is a silver halide photosensitive material containing the silver halide emulsion of any of the embodiments (2-1) to (2-8).

In the foregoing description, an especially preferred embodiment (embodiment (3-1)) of the invention is the silver halide emulsion, wherein a variation coefficient of a sphere-equivalent diameter for all of the particles is no more than 20%, and the silver chloride particles comprise a sphere-equivalent diameter of no more than 0.4 μm, at least one of the silver bromide-containing laminar phase and the silveriodide-containing laminar phase, a content of the silver chloride of at least 90 mol % and occupy at least 50% of total projected area of all of the particles.

In the foregoing description, an especially preferred embodiment (embodiment (3-2)) of the invention is the silver halide emulsion of the embodiment (3-1), wherein a variation coefficient of a sphere-equivalent diameter of all of the particles is no more than 20%, and the silver halide particles comprise a sphere-equivalent diameter of no more than 0.4 μm, the laminar silver bromide-containing the phase, a content of silver chloride of at least 90 mol % and occupy at least 50% of a total projected area of all of the particles.

In the foregoing description, an especially preferred embodiment (embodiment (3-3)) of the invention is the silver halide emulsion of the embodiment (3-1), wherein a variation coefficient of a sphere-equivalent diameter of all of the particles is no more than 20%, and the silver halide particles comprise a sphere-equivalent diameter of no more than 0.4 μm, the silver iodide-containing laminar phase, a content of the silver chloride of at least 90 mol % and occupy at least 50% of a total projected area of all of the particles.

In the foregoing description, an especially preferred embodiment (embodiment (3-4)) of the invention is the silver halide emulsion of the embodiment (3-1), wherein the silver halide particles comprise the silver bromide-containing laminar phase and the silver iodide-containing laminar phase.

In the foregoing description, an especially preferred embodiment (embodiment (3-5)) of the invention is the silver halide emulsion of the embodiment (3-1), wherein the silver bromide-containing phase is a silver bromide-containing phase in which a maximum density ratio of silver bromide is dispersed inside the particle.

In the foregoing description, an especially preferred embodiment (embodiment (3-6)) of the invention is the silver halide emulsion of the embodiment (3-3), wherein the silver iodide-containing phase is a silver iodide-containing phase in which a concentration maximum of silver iodide is provided on the surface of the particle.

In the foregoing description, an especially preferred embodiment (embodiment (3-7)) of the invention is the silver halide emulsion of the embodiment (3-4), wherein the silver bromide-containing phase is formed further inside the particle than the silver iodide-containing phase.

In the foregoing description, an especially preferred embodiment (embodiment (3-8)) of the invention is the silver halide emulsion of any of the embodiments (3-1) to (3-7), wherein the silver halide particles are cubic or tetradecahedral particles.

In the foregoing description, an especially preferred embodiment (embodiment (3-9)) of the invention is the silver halide emulsion of any of the embodiments (3-1) to (3-8), wherein an electron slow-release time of the silver halide particles is in a range from $10^{-5}$ second to 10 seconds.

In the foregoing description, an especially preferred embodiment (embodiment (3-10)) of the invention is the silver halide emulsion of any of the embodiments (3-1) to (3-9), wherein the silver halide particles contain a six-coordinate complex containing Cl, Br or I as a ligand and having Ir as a central metal.

In the foregoing description, an especially preferred embodiment (embodiment (3-11)) of the invention is the silver halide emulsion of the embodiment (3-10), wherein the six-coordinate complex is included in the silver bromide-containing phase.

In the foregoing description, an especially preferred embodiment (embodiment (3-12)) of the invention is the silver halide emulsion of any of the embodiments (3-1) to (3-11), wherein the silver halide particles contain a six-coordinate complex containing at least one ligand that is not a halogen or cyan and having Ir as a central metal.

In the foregoing description, an especially preferred embodiment (embodiment (3-13)) of the invention is the silver halide emulsion of any of the embodiments (3-1) to (3-12), wherein an oxidation potential of a latent image of the silver halide emulsion is higher than 70 mV.

In the foregoing description, an especially preferred embodiment (embodiment (3-14)) of the invention is the silver halide emulsion of any of the embodiments (3-1) to (3-13), which silver halide emulsion is gold-sensitized.

In the foregoing description, an especially preferred embodiment (embodiment (3-15)) of the invention is the silver halide emulsion of the embodiment (3-14), wherein the silver halide emulsion is gold-sensitized with a colloidal gold sulfide or a gold sensitizer in which a complex stability constant log $\beta_2$ of gold is within a range from 21 to 35.

In the foregoing description, an especially preferred embodiment (embodiment (3-16)) of the invention is a silver halide photosensitive material containing the silver halide emulsion of any of the embodiments (3-1) to (3-15).

In the foregoing description, an especially preferred embodiment (4-1) of the invention is the silver halide emulsion, wherein in the silver halide particles, the silver chloride content is from 89 mol % to 99.7 mol %, the silver bromide content is from 0.25 mol % to 10 mol %, the silver iodide content is from 0.05 mol % to 1 mol %, and the silver bromide-containing phase is disposed further inside of the silver halide particles than the silver iodide-containing phase.

In the foregoing description, an especially preferred embodiment (embodiment (4-2)) of the invention is the silver halide emulsion of the embodiment (4-1), wherein the silver bromide-containing phase and the silver iodide-containing phase are adjacent to each other.

In the foregoing description, an especially preferred embodiment (embodiment (4-3)) of the invention is the silver halide emulsion of the embodiment (4-1) or (4-2), wherein the silver iodobromochloride particles are cubic or tetradecahedral particles.

In the foregoing description, an especially preferred embodiment (embodiment (4-4)) of the invention is the silver halide emulsion of any of the embodiments (4-1) to (4-3), wherein an electron slow-release time of the silver iodobromochloride particles is $1\times10^{-5}$ second to 10 seconds.

In the foregoing description, an especially preferred embodiment (embodiment (4-5)) of the invention is the silver halide emulsion of any of the embodiments (4-1) to (4-4), wherein the silver iodobromochloride particles contain a six-coordinate complex containing Cl, Br or I as a ligand and having Ir as a central metal.

In the foregoing description, an especially preferred embodiment (embodiment (4-6)) of the invention is the silver halide emulsion of the embodiment (4-5), wherein the six-coordinate complex is contained in the silver bromide-containing phase.

In the foregoing description, an especially preferred embodiment (embodiment (4-7)) of the invention is the silver halide emulsion of any of the embodiments (4-1) to (4-6), wherein the silver iodobromochloride particles contain a six-coordinate complex containing at least one ligand except for a halogen or a cyan and having Ir as a central metal.

In the foregoing description, an especially preferred embodiment (embodiment (4-8)) of the invention is the silver halide emulsion of any of the embodiments (4-1) to (4-7), wherein an oxidation potential of a latent image of the silver halide emulsion is higher than 70 mV.

In the foregoing description, an especially preferred embodiment (embodiment (4-9)) of the invention is the silver halide emulsion of any of the embodiments (4-1) to (4-8), wherein the silver halide emulsion is gold-sensitized.

In the foregoing description, an especially preferred embodiment (embodiment (4-10)) of the invention is the silver halide emulsion of the embodiment (4-9), wherein the silver halide emulsion is gold-sensitized with colloidal gold sulfide or a gold sensitizer in which a complex stability constant log $\beta_2$ of gold is within a range of 21 to 35.

In the foregoing description, an especially preferred embodiment (embodiment (4-11)) of the invention is a silver halide photosensitive material containing the silver halide emulsion of any of the embodiments (4-1) to (4-10).

EXAMPLES

The present invention is illustrated specifically below by referring to Examples. However, the present invention is not limited to these Examples.

Example 1

Preparation of a Silver Halide Emulsion

Preparation of Emulsion B-1

One thousand milliliters of a lime-treated gelatin 3% aqueous solution was adjusted to pH of 5.5 and pCl of 1.7, and an aqueous solution containing 2.12 mols of silver nitrate and an aqueous solution containing 2.2 mols of sodium chloride were simultaneously added at 66° C. with vigorous stirring for mixing. While the addition of silver nitrate reached 80% to 90%, potassium bromide was added in an amount of 2 mol % per mol of a final silver halide with vigorous mixing. While the addition of silver nitrate reached 80% to 90%, a $K_4[Ru(CN)_6]$ aqueous solution was added in an Ru amount of $3\times10^{-5}$ mol per mol of a final silver halide. While the addition of silver nitrate reached 83% to 88%, a $K_2[IrCl_6]$ aqueous solution was added in an Ir amount of $3\times10^{-8}$ mol per mol of a final silver halide. When the addition of silver nitrate was completed by 90%, a potassium iodide aqueous solution was added in an I amount of 0.2 mol % per mol of a final silver halide with vigorous stirring. While the addition of silver nitrate reached 92% to 98%, a $K_2[Ir(5\text{-methylthiazole})Cl_5]$ aqueous solution was added in an Ir amount of $1\times10^{-6}$ mol per mol of a final silver halide. After desalting was conducted at 40° C., 168 g of lime-treated gelatin was added to adjust pH to 5.5 and pCl to 1.8. A silver halide emulsion was obtained in which silver iodobromochloride cubic particles having a sphere-equivalent diameter of 0.75 μm and a variation coefficient of 11% occupied approximately 100% of a total project area.

This emulsion was dissolved at 40° C., and sodium thiosulfonate was added in an amount of $2\times10^{-5}$ mol per mol of the silver halide. Sodium thiosulfate 5-hydrate was used was a sulfur sensitizer and (S-2) as a gold sensitizer, and the mixture was aged at 60° C. for optimum conditions. After the temperature was decreased to 40° C., sensitization dye A was added in an amount of $2\times10^{-4}$ mol per mol of the silver halide, sensitization dye B in an amount of $1\times10^{-4}$ mol per mol of the silver halide, 1-phenyl-5-mercaptotetrazole in an amount of $2\times10^{-4}$ mol per mol of the silver halide, 1-(5-methylureidophenyl)-5-mercaptotetrazole in an amount of $2\times10^{-4}$ mol per mol of the silver halide and potassium bromide in an amount of $2\times10^{-3}$ mol per mol of the silver halide respectively. The thus-obtained emulsion was designated emulsion B-1.

Sensitization dye A

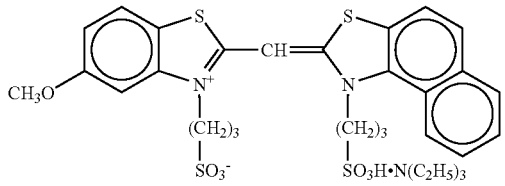

Sensitization dye B

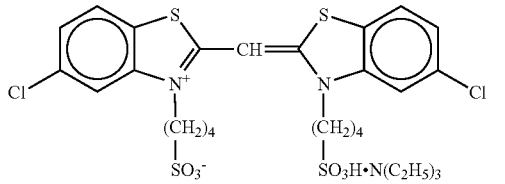

Preparation of Emulsion G-1

One thousand milliliters of a lime-treated gelatin 3% aqueous solution was adjusted to pH of 5.5 and pCl of 1.7, and an aqueous solution containing 2.12 mols of silver nitrate and an aqueous solution containing 2.2 mols of sodium chloride were simultaneously added at 45° C. with vigorous stirring for mixing. While the addition of silver nitrate reached 80% to 90%, a $K_4[Ru(CN)_6]$ aqueous solution was added in an Ru amount of $3\times10^{-5}$ mol per mol of a final silver halide. While the addition of silver nitrate reached 83% to 88%, a $K_2[IrCl_6]$ aqueous solution was added in an Ir amount of $5\times10^{-8}$ mol per mol of a final silver halide. While the addition of silver nitrate reached 92% to 95%, a $K_2[Ir(5\text{-methylthiazole})Cl_5]$ aqueous solution was added in an Ir amount of $5\times10^{-7}$ mol per mol of a final silver halide. Further, while the addition of silver nitrate reached 95% to 98%, a $K_2[Ir(H_2O)Cl_5]$ aqueous solution was added in an Ir amount of $5\times10^{-7}$ mol per mol of a final silver halide. After desalting was conducted at 40° C., 168 g of lime-treated gelatin was added to adjust pH to 5.5 and pCl to 1.8. A silver halide emulsion was obtained in which silver chloride cubic particles having a sphere-equivalent diameter of 0.35 μm and a variation coefficient of 10% occupied approximately 100% of a total project area.

This emulsion was dissolved at 40° C., and sodium thiosulfonate was added in an amount of $2\times10^{-5}$ mol per mol of the silver halide. Sodium thiosulfate 5-hydrate was used as a sulfur sensitizer and (S-2) as a gold sensitizer, and the mixture was aged at 60° C. for optimum conditions. After the temperature was decreased to 40° C., sensitization dye D was added in an amount of $6\times10^{-4}$ mol per mol of the silver halide, 1-phenyl-5-mercaptotetrazole in an amount of $2\times10^{-4}$ mol per mol of the silver halide, 1-(5-methylureidophenyl)-5-mercaptotetrazole in an amount of $8\times10^{-4}$ mol per mol of the silver halide and potassium bromide in an amount of $7\times10^{-3}$ mol per mol of the silver halide respectively. The thus-obtained emulsion was designated emulsion G-1.

Sensitization dye D

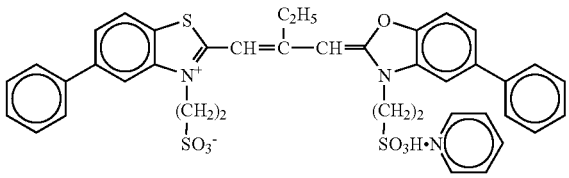

Preparation of Emulsion G-2

An emulsion was prepared in the same manner as emulsion G-1 except that when the addition of silver nitrate was completed by 90%, the potassium iodide aqueous solution was added in an I amount of 0.1 mol per mol of a final silver halide with vigorous stirring. A silver halide emulsion was obtained in which silver iodochloride cubic particles having a sphere-equivalent diameter of 0.35 μm and a variation coefficient of 10% occupied approximately 100% of a total project area. The thus-obtained emulsion was designated emulsion G-2.

Preparation of Emulsion G-3

An emulsion was prepared in the same manner as emulsion G-1 except that while the addition of silver nitrate reached 80% to 90%, potassium bromide was added in an amount of 2 mol % per mol of a final silver halide with vigorous stirring. A silver halide emulsion was obtained in which silver bromochloride cubic particles having a sphere-equivalent diameter of 0.35 μm and a variation coefficient of 10% occupied approximately 100% of a total project area. The thus-obtained emulsion was designated emulsion G-3.

Preparation of Emulsion G-4

An emulsion was prepared in the same manner as emulsion G-1 except that while the addition of silver nitrate reached 90% to 100%, potassium bromide was added in an amount of 2 mol % per mol of a final silver halide with vigorous stirring. A silver halide emulsion was obtained in which silver bromochloride cubic particles having a sphere-equivalent diameter of 0.35 μm and a variation coefficient of 10% occupied approximately 100% of a total project area. The thus-obtained emulsion was designated emulsion G-4.

Preparation of Emulsion G-5

An emulsion was prepared in the same manner as emulsion G-1 except that while the addition of silver nitrate reached 80% to 100%, potassium bromide was added in an amount of 4 mol % per mol of a final silver halide with vigorous stirring. A silver halide emulsion was obtained in which silver bromochloride cubic particles having a sphere-equivalent diameter of 0.35 μm and a variation coefficient of 10% occupied approximately 100% of a total project area. The thus-obtained emulsion was designated emulsion G-5.

Preparation of Emulsion G-6

An emulsion was prepared in the same manner as emulsion G-1 except that while the addition of silver nitrate reached 80% to 90%, potassium bromide was added in an amount of 2 mol % per mol of a final silver halide with vigorous stirring and further when the addition of silver nitrate was completed by 90%, a potassium iodide aqueous solution was added in an I amount of 0.1 mol % per mol of a final silver halide with vigorous stirring. A silver halide emulsion was obtained in which silver iodobromochloride cubic particles having a sphere-equivalent diameter of 0.35 μm and a variation coefficient of 10% occupied approximately 100% of a total project area. The thus-obtained emulsion was designated emulsion G-6.

The distribution of the bromide and iodide ion concentrations of emulsion G-6 in the depth direction was measured by the etching/TOF-SIMS method. Even when the addition of the iodide solution was completed inside the particles, the iodide ions were bled out toward the surfaces of the particles. The concentration maximum was provided on the uppermost surfaces, and the concentration was decreased toward the inside. Meanwhile, the concentration maximum of the bromide ions was provided inside the particles. From this fact, it is considered that the silver bromide-containing phases are formed in laminar shape in a further inside position of the particles than the silver iodide-containing phases.

Preparation of Emulsion G-7

An emulsion was prepared in the same manner as emulsion G-1 except that while the addition of silver nitrate reached 90% to 100%, potassium bromide was added in an amount of 2 mol % per mol of a final silver halide with vigorous stirring and further when the addition of silver nitrate was completed by 90%, a potassium iodide aqueous solution was added in an I amount of 0.1 mol % per mol of a final silver halide with vigorous stirring. A silver halide emulsion was obtained in which silver iodobromochloride cubic particles having a sphere-equivalent diameter of 0.35 μm and a variation coefficient of 10% occupied approximately 100% of a total project area. The thus-obtained emulsion was designated emulsion G-7.

The distribution of the bromide and iodide ion concentrations of emulsion G-7 in the depth direction was measured by the etching/TOF-SIMS method. Even when the addition of the iodide solution was completed inside the particles, the iodide ions were bled out toward the surfaces of the particles. The concentration maximum was provided on the uppermost surfaces, and the concentration was decreased toward the inside. Meanwhile, the concentration of the bromide ions was more gently decreased toward the inner portions from the surfaces of the particles than the iodide ions. From this fact, it is considered that the silver bromide-containing phases are formed in laminar shape in a further inside position of the particles than the silver iodide-containing phases.

Preparation of Emulsion G-8

An emulsion was prepared in the same manner as emulsion G-1 except that while the addition of silver nitrate reached 80% to 100%, potassium bromide was added in an amount of 4 mol % per mol of a final silver halide with vigorous stirring and further when the addition of silver nitrate was completed by 90%, a potassium iodide aqueous solution was added in an I amount of 0.1 mol % per mol of a final silver halide with vigorous stirring. A silver halide emulsion was obtained in which silver iodobromochloride cubic particles having a sphere-equivalent diameter of 0.35 μm and a variation coefficient of 10% occupied approximately 100% of a total project area. The thus-obtained emulsion was designated emulsion G-8.

The distribution of the bromide and iodide ion concentrations of emulsion G-8 in the depth direction was measured by the etching/TOF-SIMS method. Even when the addition of the iodide solution was completed inside the particles, the iodide ions were bled out toward the surfaces of the particles. The concentration maximum was provided on the uppermost surfaces, and the concentration was decreased toward the inside. Meanwhile, the concentration of the bromide ions was much more gently decreased toward the inner portions from the surfaces of the particles than the iodide ions. From this fact, it is considered that the silver bromide-containing phases are formed in laminar shape in a further inside position of the particles than the silver iodide-containing phases.

Preparation of Emulsion R-1

One thousand milliliters of a lime-treated gelatin 3% aqueous solution was adjusted to pH of 5.5 and pCl of 1.7, and an aqueous solution containing 2.12 mols of silver nitrate and an aqueous solution containing 2.2 mols of sodium chloride were simultaneously added at 45° C. with vigorous stirring for mixing. While the addition of silver nitrate reached 80% to 100%, potassium bromide was added in an amount of 4 mol % per mol of a final silver halide with vigorous stirring. While the addition of silver nitrate reached 80% to 90%, a $K_4[Ru(CN)_6]$ aqueous solution was added in an Ru amount of $3\times10^{-5}$ mol per mol of a final silver halide. While the addition of silver nitrate reached 83% to 88%, a $K_2[IrCl_6]$ aqueous solution was added in an Ir amount of $5\times10^{-8}$ mol per mol of a final silver halide. When the addition of silver nitrate was completed by 90%, a potassium iodide aqueous solution was added in an I amount of 0.1 mol % per mol of a final silver halide with vigorous stirring. While the addition of silver nitrate reached 92% to 95%, a $K_2[Ir(5\text{-methylthiazole})Cl_5]$ aqueous solution was added in an Ir amount of $5\times10^{-7}$ mol per mol of a final silver halide. Further, while the addition of silver nitrate reached 95% to 98%, a $K_2[Ir(H_2O)Cl_5]$ aqueous solution was added in an Ir amount of $5\times10^{-7}$ mol per mol of a final silver halide. After desalting was conducted at 40° C., 168 g of lime-treated gelatin was added to adjust pH to 5.5 and pCl to 1.8. A silver halide emulsion was obtained in which silver iodobromochloride cubic particles having a sphere-equivalent diameter of 0.35 μm and a variation coefficient of 10% occupied approximately 100% of a total project area.

This emulsion was dissolved at 40° C., and sodium thiosulfonate was added in an amount of $2\times10^{-5}$ mol per mol of the silver halide. Sodium thiosulfate 5-hydrate was used as a sulfur sensitizer and (S-2) as a gold sensitizer, and the mixture was aged at 60° C. for optimum conditions. After the temperature was decreased to 40° C., sensitization dye H was added in an amount of $2\times10^{-4}$ mol per mol of the silver halide, 1-phenyl-5-mercaptotetrazole in an amount of $2\times10^{-4}$ mol per mol of the silver halide, 1-(5-methylureidophenyl)-5-mercaptotetrazole in an amount of $8\times10^{-4}$ mol per mol of the silver halide, compound I in an amount of $1\times10^{-3}$ mol per mol of the silver halide and potassium bromide in an amount of $7\times10^{-3}$ mol per mol of the silver halide respectively. The thus-obtained emulsion was designated emulsion R-1.

Sensitization dye H

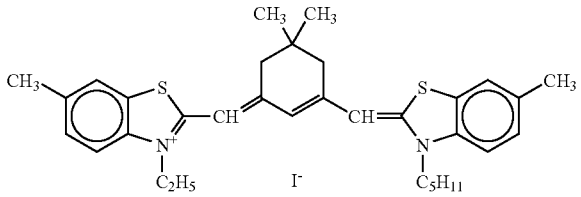

-continued

Compound I

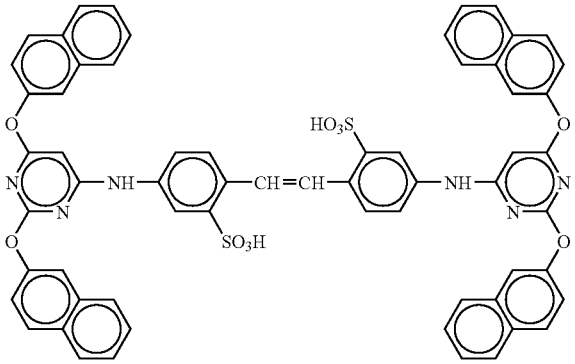

Production of a Silver Halide Photosensitive Material

A surface of a substrate obtained by coating both sides of paper with a polyethylene resin was subjected to corona discharge treatment. Then, a gelatin undercoat layer containing sodium dodecylbenzenesulfonate was formed, and first to seventh photographic layers were further coated in order to produce a sample of a silver halide color photosensitive material having the following layer structure. Coating solutions of the respective photographic layers were prepared as follows.

Preparation of a First Layer Coating Solution

Yellow coupler (ExY) (57 g), 7 g of color image stabilizer (Cpd-1), 4 g of color image stabilizer (Cpd-2), 7 g of color image stabilizer (Cpd-3) and 2 g of color image stabilizer (Cpd-8) were dissolved in 21 g of solvent (Solv-1) and 80 ml of ethyl acetate. This solution was emulsion-dispersed in a 23.5 mass % gelatin aqueous solution with a high-speed stirring emulsifier (dissolver), and water was added to form 900 g of emulsion dispersion A.

Meanwhile, emulsion dispersion A and emulsion B-1 were mixed and dissolved to prepare a first layer coating solution having the following composition. A coating amount of the emulsion is expressed in terms of a coating amount of silver.

Preparation of Second to Seventh Layer Coating Solutions

Second to seventh layer coating solutions were also prepared in the same manner as the first layer coating solution. As gelatin hardening agents of the respective layers, 1-oxy-3,5-dichloro-s-triazine sodium salts (H-1), (H-2) and (H-3) were used. Further, Ab-1, Ab-2, Ab-3 and Ab-4 were added to the respective layers such that the total amounts were 15.0 mg/m$^2$, 60.0 mg/m$^2$, 5.0 mg/m$^2$ and 10.0 mg/m$^2$ respectively.

(H-1) hardening agent

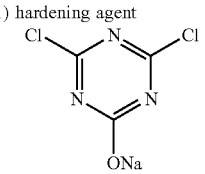

(H-2) hardening agent

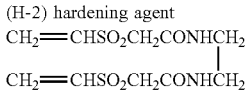

(using 1.4% by mass based on gelatin)

-continued (H-3) hardening agent

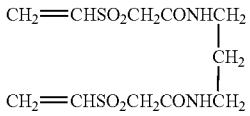

(Ab-1) preservative

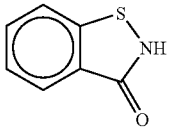

(Ab-2) preservative

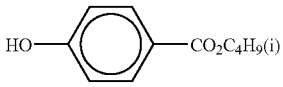

(Ab-3) preservative

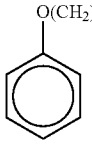

(Ab-4) preservative

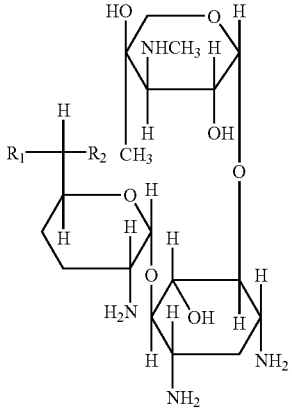

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

Mixture of a, b, c and d at a molar ratio of 1:1:1:1

Further, 1-phenyl-5-mercaptotetrazole was added to a green sensitive emulsion layer and a red sensitive emulsion layer in amounts of $1.0\times10^{-3}$ mol and $5.9\times10^{-4}$ mol per mol of a silver halide.

Still further, 1-phenyl-5-mercaptotetrazole was also added to the second, fourth and sixth layers in amounts of 0.2 mg/m$^2$, 0.2 mg/m$^2$ and 0.6 mg/m$^2$ respectively.

Furthermore, a copolymer latex (mass ratio 1:1, average molecular weight 200,000 to 400,000) of methacrylic acid and butyl acrylate was added to a red sensitive emulsion layer in an amount of 0.05 g/m$^2$.

Moreover, disodium catecol-3,5-disulfonate was added to the second, fourth and sixth layers in amounts of 6 mg/m$^2$, 6 mg/m$^2$ and 18 mg/m$^2$ respectively.

In addition, the following dyes (a parenthesized value indicates a coating amount) were added to prevent irradiation.

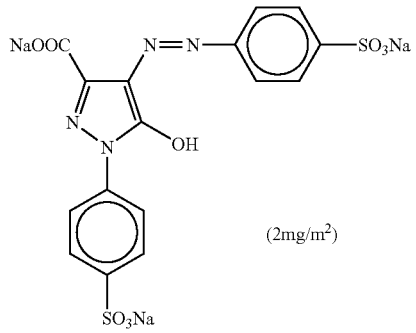

(2mg/m$^2$)

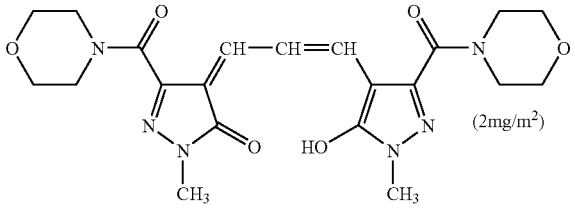

(2mg/m$^2$)

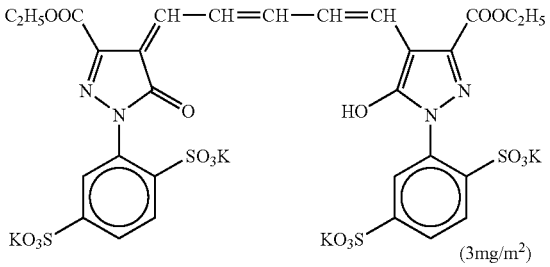

(3mg/m$^2$)

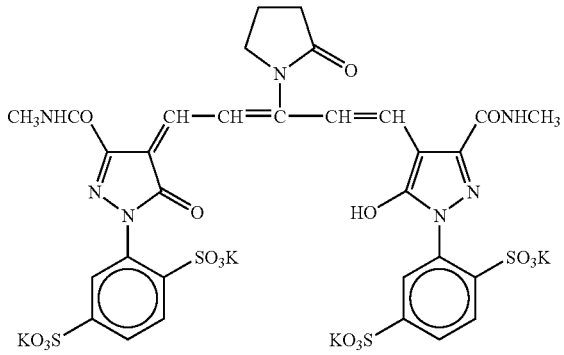

(7mg/m$^2$)

Layer Structure

The structure of each layer is shown below. A figure indicates a coating amount (g/m$^2$). An amount of a silver halide emulsion is expressed in terms of a coating amount of silver.

Substrate

Polyethylene Resin Laminated Paper

[A polyethylene resin on the first layer side contained a white pigment ($TiO_2$: content 16% by mass, ZnO: content 4% by mass), a fluorescent brightener (4,4'-bis(5-methylbenzoxazolyl)stilbene: content 0.03% by mass) and a blue dye (ultramarine).]

| | |
|---|---|
| **First layer (blue sensitive emulsion layer)** | |
| emulsion B-1 | 0.24 |
| gelatin | 1.25 |
| yellow coupler (ExY) | 0.57 |
| color image stabilizer (Cpd-1) | 0.07 |
| color image stabilizer (Cpd-2) | 0.04 |
| color image stabilizer (Cpd-3) | 0.07 |
| color image stabilizer (Cpd-8) | 0.02 |
| solvent (Solv-1) | 0.21 |
| **Second layer (color mixing inhibition layer)** | |
| gelatin | 0.99 |
| color mixing inhibitor (Cpd-4) | 0.09 |
| color image stabilizer (Cpd-5) | 0.018 |
| color image stabilizer (Cpd-6) | 0.13 |
| color image stabilizer (Cpd-7) | 0.01 |
| solvent (Solv-1) | 0.06 |
| solvent (Solv-2) | 0.22 |
| **Third layer (green sensitive emulsion layer)** | |
| emulsion G-1 | 0.14 |
| gelatin | 1.36 |
| magenta coupler (ExM) | 0.15 |
| ultraviolet absorber (UV-A) | 0.14 |
| color image stabilizer (Cpd-2) | 0.02 |
| color image stabilizer (Cpd-4) | 0.002 |
| color image stabilizer (Cpd-6) | 0.09 |
| color image stabilizer (Cpd-8) | 0.02 |
| color image stabilizer (Cpd-9) | 0.03 |
| color image stabilizer (Cpd-10) | 0.01 |
| color image stabilizer (Cpd-11) | 0.0001 |
| solvent (Solv-3) | 0.11 |
| solvent (Solv-4) | 0.22 |
| solvent (Solv-5) | 0.20 |
| **Fourth layer (color mixing inhibition layer)** | |
| gelatin | 0.71 |
| color mixing inhibition layer (Cpd-4) | 0.06 |
| color image stabilizer (Cpd-5) | 0.013 |
| color image stabilizer (Cpd-6) | 0.10 |
| color image stabilizer (Cpd-7) | 0.007 |
| solvent (Solv-1) | 0.04 |
| solvent (Solv-2) | 0.16 |
| **Fifth layer (red sensitive emulsion layer)** | |
| emulsion R-1 | 0.12 |
| gelatin | 1.11 |
| cyan coupler (ExC-2) | 0.13 |
| cyan coupler (ExC-3) | 0.03 |
| color image stabilizer (Cpd-1) | 0.05 |
| color image stabilizer (Cpd-6) | 0.06 |
| color image stabilizer (Cpd-7) | 0.02 |
| color image stabilizer (Cpd-9) | 0.04 |
| color image stabilizer (Cpd-10) | 0.01 |
| color image stabilizer (Cpd-14) | 0.01 |
| color image stabilizer (Cpd-15) | 0.12 |
| color image stabilizer (Cpd-16) | 0.03 |
| color image stabilizer (Cpd-17) | 0.09 |
| color image stabilizer (Cpd-18) | 0.07 |
| solvent (Solv-5) | 0.15 |
| solvent (Solv-8) | 0.05 |
| **Sixth layer (ultraviolet absorption layer)** | |
| gelatin | 0.46 |
| ultraviolet absorber (UV-B) | 0.45 |
| compound (S1-4) | 0.0015 |
| solvent (Solv-7) | 0.25 |
| **Seventh layer (protecting layer)** | |
| gelatin | 1.00 |
| polyvinyl alcohol acryl-modified copolymer (degree of modification 17%) | 0.04 |
| liquid paraffin | 0.02 |
| surfactant (Cpd-13) | 0.01 |

(ExY-1) yellow coupler

70:30 (molar ratio) mixture of

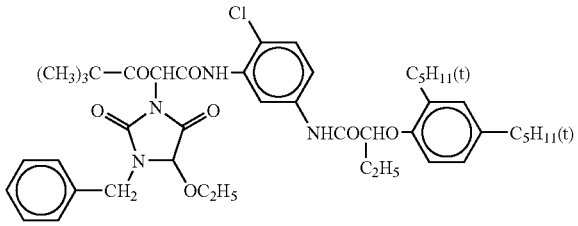

and

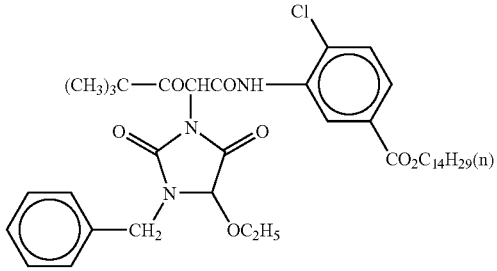

(ExM) magenta coupler

40:40:20 (molar ratio) mixture of

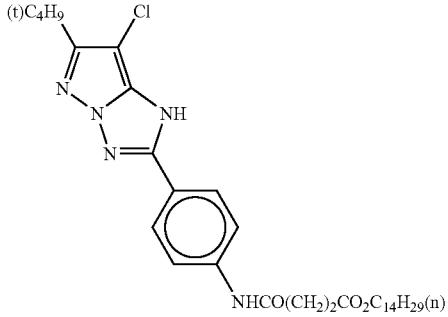

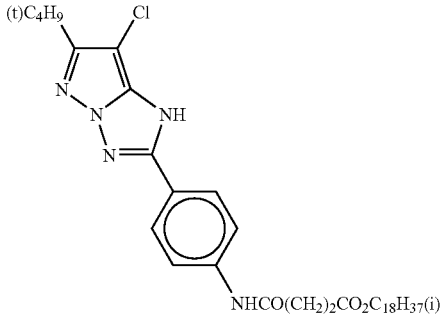

and

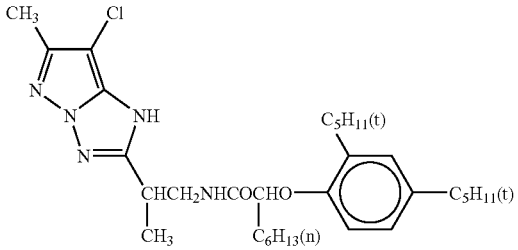

-continued (ExC-2) cyan coupler

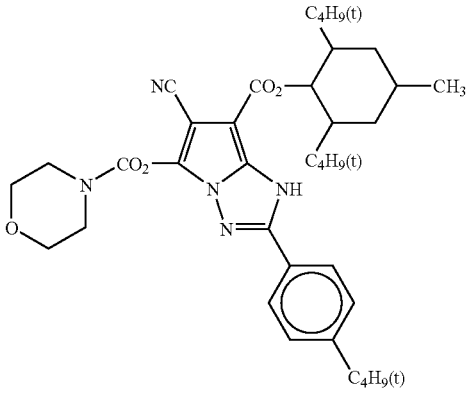

(ExC-3) cyan coupler

50:25:25 (molar ratio) mixture of

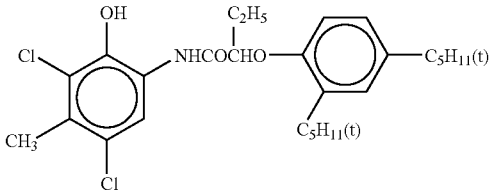

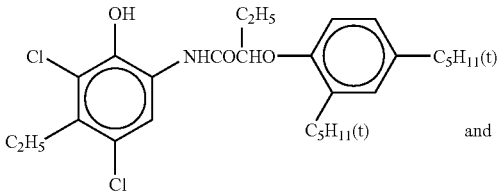

and

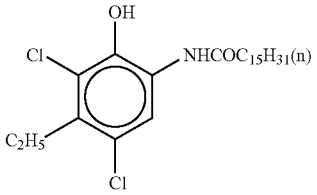

(Cpd-1) color image stabilizer number average molecular weight 60,000

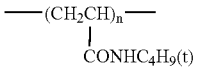

(Cpd-2) color image stabilizer

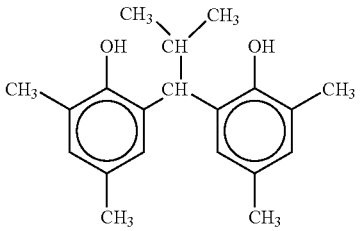

-continued (Cpd-3) color image stabilizer n = 7 to 8 (average value)

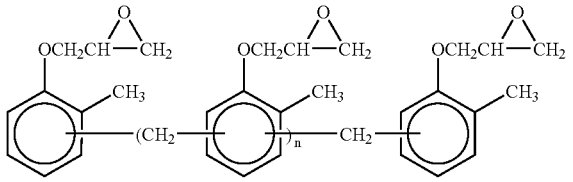

(Cpd-4) color mixing inhibitor

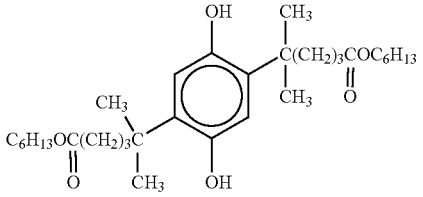

(Cpd-5) color image stabilizer

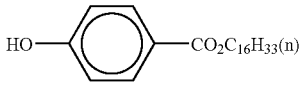

(Cpd-6) color image stabilizer number average molecular weight 600
m/n = 10/90

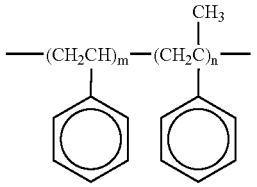

(Cpd-7) color image stabilizer

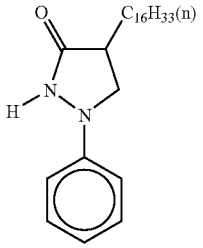

(Cpd-8) color image stabilizer

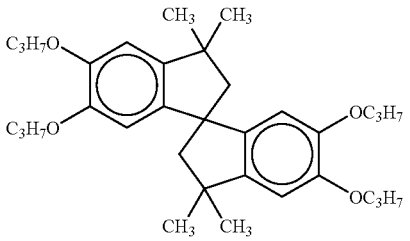

-continued
(Cpd-9) color image stabilizer
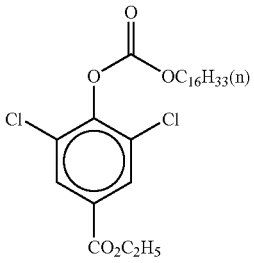
(Cpd-10) color image stabilizer
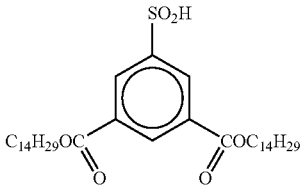
(Cpd-11) color image stabilizer
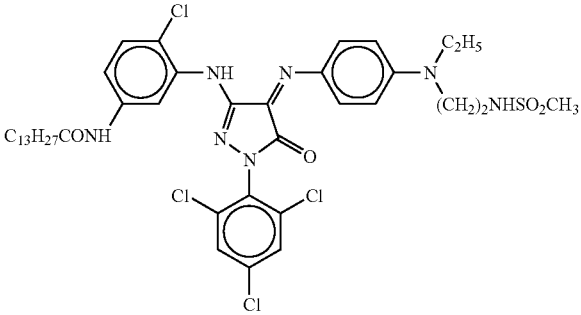
(Cpd-13) surfactant
7:3 (molar ratio) mixture of
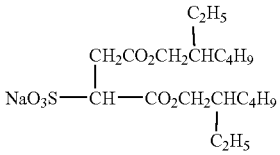
and
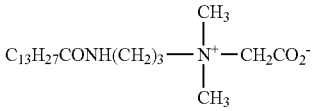
(Cpd-14)
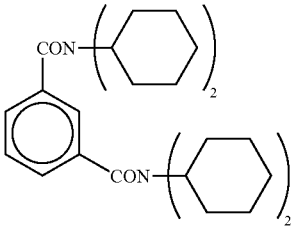
(Cpd-15)
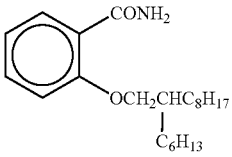
-continued
(Cpd-16)
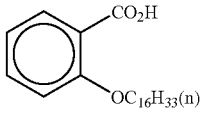
(Cpd-17)
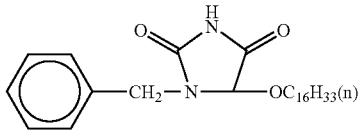
(Cpd-18)
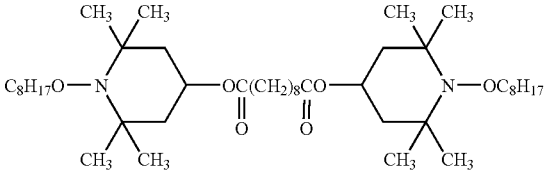
(Cpd-19) color mixing inhibitor
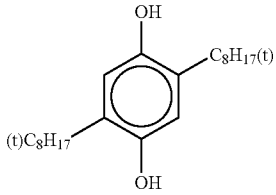
(UV-1) ultraviolet absorber
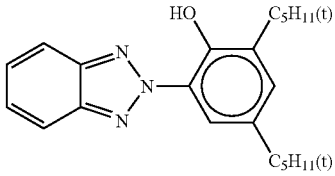
(UV-2) ultraviolet absorber
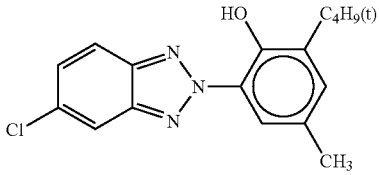
(UV-3) ultraviolet absorber
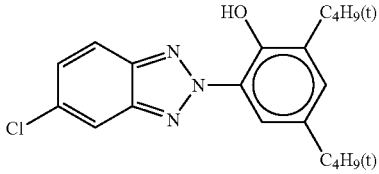
(UV-4) ultraviolet absorber
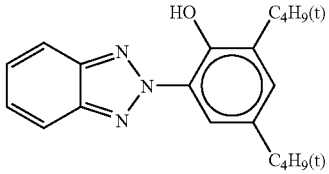

-continued (UV-5) ultraviolet absorber

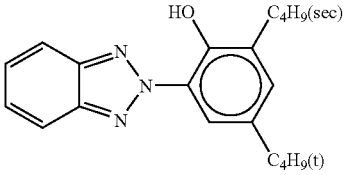

(UV-6) ultraviolet absorber

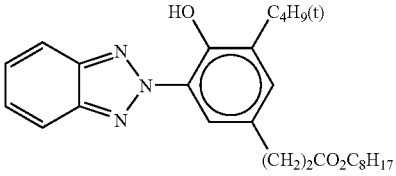

(UV-7) Ultraviolet absorber

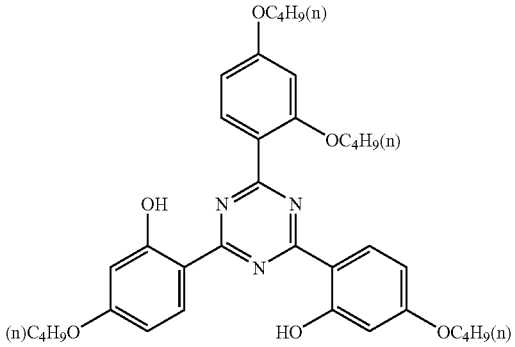

UV-A: UV-1/UV-2/UV-3/UV-4 mixture (4/2/2/3 mass ratio)
UV-B: UV-1/UV-2/UV-3/UV-4/UV-5/UV-6 mixture (9/3/3/4/5/3 mass ratio)
UV-C: UV-2/UV-3/UV-6/UV-7 mixture (1/1/1/2 mass ratio)

(Solv-1)

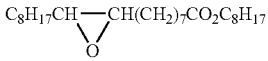

(Solv-2)

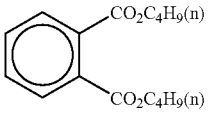

(Solv-3)

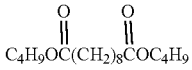

(Solv-4)

(Solv-5)

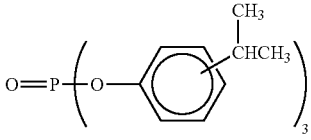

-continued (Solv-7)

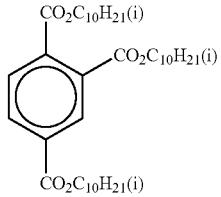

(Solv-8)

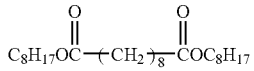

(S1-4)

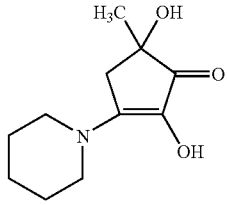

The thus-obtained sample was designated sample G-1. Samples were also produced in the same manner as sample G-1 except that emulsion G-1 of the green sensitive emulsion layer was replaced with emulsions G-2 to G-8, and were designated samples G-2 to G-8.

In order to examine photographic characteristics of these samples, the following experiment was conducted.

Gradation exposure for sensitometry was applied to the coated samples using a sensitometer for high-intensity exposure (trade name: HIE model, manufactured by Yamashita Denso K.K.). A filter (trade name: SP-2, manufactured by Fuji Photo Film Co., Ltd.) was installed, and high-intensity exposure was conducted for $10^{-6}$ second.

After the exposure, the following color development processing A was conducted.

The processing is described below.

Processing A

Each of the photosensitive material samples was molded into a roll having a width of 127 mm. After imagewise exposure using a mini-labo printer processor (trade name: PP1258AR, manufactured by Fuji Photo Film Co., Ltd.), continuous processing (running test) was conducted until the solution was replenished in a volume which was twice a volume of a color development tank in the following processing step. The processing with this running solution was designated processing A.

| Processing step | Temperature | Time | Replenished amount* |
|---|---|---|---|
| color development | 38.5° C. | 45 sec | 45 ml |
| bleach-fixing | 38.0° C. | 45 sec | 35 ml |
| rinsing (1) | 38.0° C. | 20 sec | — |
| rinsing (2) | 38.0° C. | 20 sec | — |
| rinsing (3) | **38.0° C. | 20 sec | — |
| rinsing (4) | **38.0° C. | 30 sec | 121 ml |

*Replenished amount per 1 $m^2$ of a photosensitive material

**A rinse cleaning system (trade name: RC50D, manufactured by Fuji Photo Film Co., Ltd.) was installed in rinsing (3), and a rinse solution was withdrawn from rinsing (3), and fed to a reverse osmosis membrane module (RC50D) with a pump. Permeated water obtained in the tank was fed to rinsing (4), and concentrated water was returned to rinsing (3). A pump pressure was adjusted such that an amount of permeated water to the reverse osmosis module was maintained at 50 to 300 ml/min, and it was circulated for 10 hours a day with the temperature controlled. (Rinsing was conducted in a tank countercurrent system from (1) to (4).)

The composition of each processing solution is as follows.

| | [Tank solution] | [Replenisher] |
|---|---|---|
| [Color developing solution] | | |
| water | 800 ml | 800 ml |
| dimethylpolysiloxane surfactant (trade name: Silicone KF351A made by Shin-etsu Chemical Industry Co., Ltd.) | 0.1 g | 0.1 g |
| tri(isopropanol)amine | 8.8 g | 8.8 g |
| ethylenediamine tetraacetic acid | 4.0 g | 4.0 g |
| polyethylene glycol (molecular weight 300) | 10.0 g | 10.0 g |
| sodium 4,5-dihydroxybenzene-1,3-disulfonate | 0.5 g | 0.5 g |
| potassium chloride | 10.0 g | — |
| potassium bromide | 0.040 g | 0.010 g |
| triazinylaminostilbene fluorescent brightener (trade name: Hakkol FWA-SF made by Showa Kagaku) | 2.5 g | 5.0 g |
| sodium sulfite | 0.1 g | 0.1 g |
| disodium-N,N-bis(sulfonatoethyl)hydroxylamine | 8.5 g | 11.1 g |
| N-ethyl-N-(β-methanesulfonamidoethyl)-3-methyl-4-amino-4-aminoaniline-3/2 sulfuric acid-monohydrate | 5.0 g | 15.7 g |
| potassium carbonate | 26.3 g | 26.3 g |
| addition of water | 1,000 ml | 1,000 ml |
| pH (adjusted at 25° C. with potassium hydroxide and sulfuric acid) | 10.15 | 12.50 |
| [Bleach-fixing solution] | | |
| water | 700 ml | 600 ml |
| iron (III) ammonium ethylenediamine tetraacetate | 47.0 g | 94.0 g |
| ethylenediamine tetraacetic acid | 1.4 g | 2.8 g |
| m-carboxybenzene sulfinic acid | 8.3 g | 16.5 g |
| nitric acid (67%) | 16.5 g | 33.0 g |
| imidazole | 14.6 g | 29.2 g |
| ammonium thiosulfate (750 g/l) | 107.0 ml | 214.0 ml |
| ammonium sulfite | 16.0 g | 32.0 g |
| ammonium bisulfite | 23.1 g | 46.2 g |
| addition of water | 1,000 ml | 1,000 ml |
| pH (adjusted at 25° C. with acetic acid and ammonia) | 6.0 | 6.0 |
| [Rinse solution] | | |
| chlorinated sodium isocyanurate | 0.02 g | 0.02 g |
| deionized water (conductivity 5 μS/cm or less) | 1,000 ml | 1,000 ml |
| pH | 6.5 | 6.5 |

The magenta color density of each processed sample was measured, and a characteristic curve of high-intensity exposure for $10^{-5}$ second was obtained. A sensitivity was defined by a reciprocal of an exposure dose at which to give a color density higher than the lowest color density by 1.5, and expressed in terms of a relative value when a sensitivity of sample G-1 was rated as 100. Further, a gradation was obtained from an inclination of a line by which to connect a density of 1.5 with a density of 2.0. The results are shown in Table 2.

TABLE 2

| | Br layer | | I layer | | | | |
|---|---|---|---|---|---|---|---|
| Sample | Position of addition | Content | Position of Addition | Content | Sensitivity | Gradation | Remarks |
| G-1 | — | — | — | — | 100 | 1.4 | Comparison |
| G-2 | — | — | 90% | 0.1 mol % | 210 | 1.9 | Invention |
| G-3 | 80-90% | 2 mol % | — | — | 140 | 2.2 | Invention |
| G-4 | 90-100% | 2 mol % | — | — | 150 | 1.9 | Invention |
| G-5 | 80-100% | 4 mol % | — | — | 150 | 2.3 | Invention |
| G-6 | 80-90% | 2 mol % | 90% | 0.1 mol % | 270 | 2.9 | Invention |
| G-7 | 90-100% | 2 mol % | 90% | 0.1 mol % | 250 | 2.7 | Invention |
| G-8 | 80-100% | 4 mol % | 90% | 0.1 mol % | 280 | 2.9 | Invention |

As is apparent from the results in Table 2, it was found that samples G-2 to G-8 in which the green sensitive emulsion layer contained the silver iodobromochloride emulsion with the silver bromide-containing phases and/or the silver iodide-containing phases formed in laminar shape in the present invention had a markedly high green sensitivity and a high gradation.

Example 2

A thin layer sample was produced as in Example 1 except that the layer structure was changed as follows.

| Production of a sample | |
|---|---|
| First layer (blue sensitive emulsion layer) | |
| emulsion B-1 | 0.14 |
| gelatin | 0.75 |
| yellow coupler (ExY-2) | 0.34 |
| color image stabilizer (Cpd-1) | 0.04 |
| color image stabilizer (Cpd-2) | 0.02 |
| color image stabilizer (Cpd-3) | 0.04 |
| color image stabilizer (Cpd-8) | 0.01 |
| solvent (Solv-1) | 0.13 |
| Second layer (color mixing inhibition layer) | |
| gelatin | 0.60 |
| color mixing inhibitor (Cpd-19) | 0.09 |
| color image stabilizer (Cpd-5) | 0.007 |
| color image stabilizer (Cpd-7) | 0.007 |
| ultraviolet absorber (UV-C) | 0.05 |
| solvent (Solv-5) | 0.11 |
| Third layer (green sensitive emulsion layer) | |
| emulsion G-1 | 0.14 |
| gelatin | 0.73 |
| magenta coupler (ExM) | 0.15 |
| ultraviolet absorber (UV-A) | 0.05 |
| color image stabilizer (Cpd-2) | 0.02 |
| color image stabilizer (Cpd-7) | 0.008 |
| color image stabilizer (Cpd-8) | 0.07 |
| color image stabilizer (Cpd-9) | 0.03 |
| color image stabilizer (Cpd-10) | 0.009 |
| color image stabilizer (Cpd-11) | 0.0001 |
| solvent (Solv-3) | 0.06 |
| solvent (Solv-4) | 0.11 |
| solvent (Solv-5) | 0.06 |
| Fourth layer (color mixing inhibition layer) | |
| gelatin | 0.48 |
| color mixing inhibition layer (Cpd-4) | 0.07 |
| color image stabilizer (Cpd-5) | 0.006 |
| color image stabilizer (Cpd-7) | 0.006 |
| ultraviolet absorber (UV-C) | 0.04 |
| solvent (Solv-5) | 0.09 |
| Fifth layer (red sensitive emulsion layer) | |
| emulsions R-1 | 0.12 |
| gelatin | 0.59 |
| cyan coupler (ExC-2) | 0.13 |
| cyan coupler (ExC-3) | 0.03 |
| color image stabilizer (Cpd-7) | 0.01 |
| color image stabilizer (Cpd-9) | 0.04 |
| color image stabilizer (Cpd-15) | 0.19 |
| color image stabilizer (Cpd-18) | 0.04 |
| ultraviolet absorber (UV-7) | 0.02 |
| solvent (Solv-5) | 0.09 |
| Sixth layer (ultraviolet absorption layer) | |
| gelatin | 0.32 |
| ultraviolet absorber (UV-C) | 0.42 |
| solvent (Solv-7) | 0.08 |

-continued

| Production of a sample | |
|---|---|
| Seventh layer (protecting layer) | |
| gelatin | 0.70 |
| polyvinyl alcohol acryl-modified copolymer (degree of modification 17%) | 0.04 |
| liquid paraffin | 0.01 |
| surfactant (Cpd-13) | 0.01 |
| polydimethylsiloxane | 0.01 |
| silicon dioxide | 0.003 |
| (ExY-2) | |

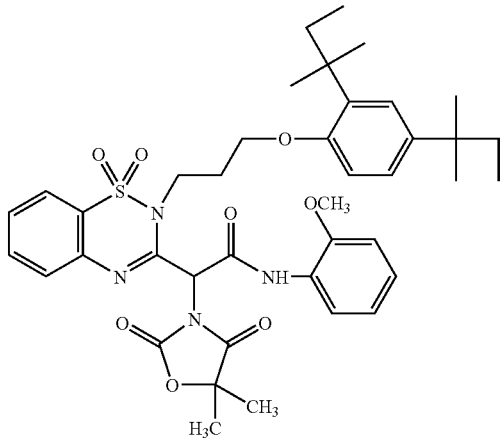

A sample obtained by using emulsion G-1 as an emulsion of a green sensitive emulsion layer was designated sample G-21. A sample was also produced in the same manner as sample G-1 except that emulsion G-1 of the green sensitive emulsion layer was replaced with emulsion G-8, and was designated sample G-28.

In order to examine photographic characteristics of these samples, the following experiment was conducted.

Each of the coated samples was subjected to exposure as in Example 1.

Each of the exposed samples was subjected to superquick color development processing according to the following development processing B.

Processing B

Each of the photosensitive material samples was molded into a roll having a width of 127 mm. The photosensitive material sample was subjected to imagewise exposure from a negative film having an average density upon using a mini-labo printer process or (trade name: PP350, manufactured by Fuji Photo Film Co., Ltd.) which was remodeled to change a processing time and a processing temperature. Continuous processing (running test) was conducted until a volume of a color-developing replenisher used in the following processing step became 0.5 time a volume of a color development tank.

| Processing step | Temperature | Time | Replenished amount* |
|---|---|---|---|
| color development | 45.0° C. | 15 sec | 45 ml |
| bleach-fixing | 40.0° C. | 15 sec | 35 ml |
| rinsing (1) | 40.0° C. | 8 sec | — |
| rinsing (2) | 40.0° C. | 8 sec | — |

-continued

| Processing step | Temperature | Time | Replenished amount* |
|---|---|---|---|
| rinsing (3)** | 40.0° C. | 8 sec | — |
| rinsing (4)** | 38.0° C. | 8 sec | 121 ml |
| drying | 80.0° C. | 15 sec | |

*Replenished amount per 1 $m^2$ of a photosensitive material
**A rinse cleaning system (trade name: RC50D, manufactured by Fuji Photo Film Co., Ltd.) was installed in rinsing (3), and a rinse solution was withdrawn from rinsing (3), and fed to a reverse osmosis membrane module (RC50D) with a pump. Permeated water obtained in the tank was fed to rinsing (4), and concentrated water was returned to rinsing (3). A pump pressure was adjusted such that an amount of permeated water to the reverse osmosis module was maintained at 50 to 300 ml/min, and it was circulated for 10 hours a day with a temperature controlled. Rinsing was conducted in a tank countercurrent system from (1) to (4).

The composition of each processing solution is as follows.

| | [Tank solution] | [Replenisher] |
|---|---|---|
| [Color developing solution] | | |
| water | 800 ml | 600 ml |
| fluorescent brightener (FL-1) | 5.0 g | 8.5 g |
| triisopropanolamine | 8.8 g | 8.8 g |
| sodium p-toluenesulfonate | 20.0 g | 20.0 g |
| ethylenediaminetetraacetic acid | 4.0 g | 4.0 g |
| sodium sulfite | 0.10 g | 0.50 g |
| potassium chloride | 10.0 g | — |
| sodium 4,5-dihydroxybenzene-1,3-disulfonate | 0.50 g | 0.50 g |
| disodium-N,N-bis(sulfonatoethyl)hydroxylamine | 8.5 g | 14.5 g |
| 4-amino-3-methyl-N-ethyl-N-(β-methanesulfonamidoethyl)aniline-3/2 sulfuric acid salt-monohydrate | 10.0 g | 22.0 g |
| potassium carbonate | 26.3 g | 26.3 g |
| total amount with addition of water | 1,000 ml | 1,000 ml |
| pH (adjusted at 25° C. with sulfuric acid and KOH) | 10.35 | 12.6 |
| [Bleach-fixing solution] | | |
| water | 800 ml | 800 ml |
| ammonium thiosulfate (750 g/l) | 107.0 ml | 214.0 ml |
| succinic acid | 29.5 g | 59.0 g |
| iron (III) ammonium ethylenediaminetetraacetate | 47.0 g | 94.0 g |
| ethylenediaminetetraacetic acid | 1.4 g | 2.8 g |
| nitric acid (67%) | 17.5 g | 35.0 g |
| imidazole | 14.6 g | 29.2 g |
| ammonium sulfite | 16.0 g | 32.0 g |
| ammonium metabisulfite | 23.1 g | 46.2 g |
| total amount with addition of water | 1,000 ml | 1,000 ml |
| pH (adjusted at 25° C. with acetic acid and aqueous ammonia) | 6.00 | 6.00 |
| [Rinse solution] | | |
| chlorinated sodium isocyanurate | 0.02 g | 0.02 g |
| deionized water (conductivity 5 μS/cm or less) | 1,000 ml | 1,000 ml |
| pH (25° C.) | 6.5 | 6.5 |

FL-1

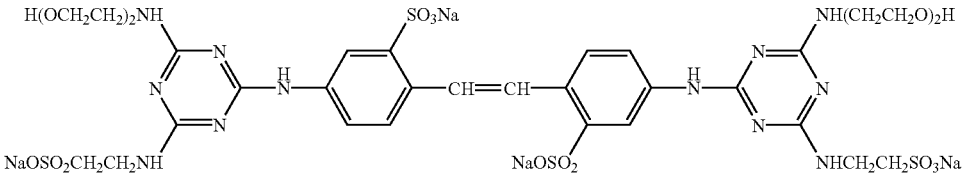

expressed in terms of a relative value when a density of sample G-1 was rated as 100. Further, a gradation was obtained from an inclination of a line by which to connect a density of 1.5 with a density of 2.0.

Further, for measuring a latent image stability, characteristic curves were obtained where processing started 10 seconds after the exposure in an atmosphere of 20° C. and relative humidity of 55% and where processing started 10 minutes after the exposure in the same atmosphere. The change in density at an exposure dose to give a density of 1.5 where processing started 10 seconds after the exposure was examined. Still further, for examining a dependence of exposure on a temperature and humidity, characteristic curves were obtained where processing started 5 seconds after the exposure in an atmosphere of 10° C. and relative humidity of 55% and where processing started 5 seconds after the exposure in an atmosphere of 30° C. and relative humidity of 30%. The change in density at an exposure dose to give a density of 1.5 where processing started 5 seconds after the exposure in an atmosphere of 10° C. and relative humidity of 55% was examined. The results are shown in Table 3.

The magenta color density of each processed sample was measured, and a characteristic curve of high-intensity exposure for $10^{-6}$ second was obtained. A sensitivity was defined by a reciprocal of an exposure dose at which to give a color density higher than the lowest color density by 1.5, and

TABLE 3

| Sample | Br layer Position of addition | Br layer Content | I layer Position of addition | I layer Content | Sensitivity | Gradation | Latent image stability | Dependence of exposure on temperature and humidity | Remarks |
|---|---|---|---|---|---|---|---|---|---|
| G-21 | — | — | — | — | 100 | 1.3 | 0.25 | 0.18 | Comparison |
| G-28 | 80-100% | 4 mol % | 0.9 | 0.1 mol % | 290 | 3.0 | 0.02 | 0.04 | Invention |

As is apparent from the results in Table 3, it was found that sample G-28 in which the green sensitive emulsion layer contained the silver bromide-containing phases and the silver iodide-containing phases formed in laminar shape had a markedly high green sensitivity and a high gradation and was also excellent in latent image stability and dependence of exposure on a temperature and humidity.

Example 3

An image was formed by laser scanning exposure using the photosensitive materials in Example 2.

As a laser beam source, a wavelength of 430 to 450 nm of a blue semiconductor laser (made public by Toa Kagaku in a lecture of 48th Applied Physics Related Association, March 2001) or a wavelength of approximately 470 nm taken out by changing a wavelength of a semiconductor laser (oscillation wavelength approximately 940 nm) with SHG crystals of $LiNbO_3$ having a waveguide-type inverted domain structure, a wavelength of approximately 532 nm taken out by changing a wavelength of a semiconductor laser (oscillation wavelength approximately 1,060 nm) with SHG crystals of $LiNbO_3$ having a waveguide-type inverted domain structure, and a wavelength of approximately 685 nm of a red semiconductor laser (trade name: HL6738MG, manufactured by Hitachi Ltd.) or a wavelength of approximately 650 nm of a red semiconductor laser (trade name: HL6501MG, manufactured by Hitachi Ltd.) were used. The laser beams of the three colors were moved vertically in the scanning direction with a polygon mirror to allow successive scanning exposure on the sample. The change in amount of light owing to the temperature of the semiconductor laser was suppressed by keeping constant the temperature upon using a Peltier element. An effective beam diameter was 80 μm, a scanning pitch was 42.3 μm (600 dpi), and an average exposure time for 1 pixel was $1.7\times10^{-7}$ second.

After the exposure, the processing was conducted according to color development processing B. Consequently, it was found that in sample G-28 of the present invention, the green sensitive layer showed a high sensitivity and a high gradation as in the results of the high-intensity exposure in Example 2, the red sensitive layer also showed a high sensitivity and a high gradation, and they were suited for the image formation using the laser scanning exposure.

Example 4

Preparation of Emulsion B-1'

One thousand milliliters of a lime-treated gelatin 3% aqueous solution was adjusted to pH of 5.5 and pCl of 1.8, and an aqueous solution containing 2.12 mols of silver nitrate and an aqueous solution containing 2.25 mols of sodium chloride were simultaneously added at 68° C. with vigorous stirring for mixing. While the addition of silver nitrate reached 80% to 90%, a $K_4[Ru(CN)_6]$ aqueous solution was added in an Ru amount of $3\times10^{-5}$ mol per mol of a final silver halide. While the addition of silver nitrate reached 83% to 88%, a $K_2[IrCl_6]$ aqueous solution was added in an Ir amount of $3\times10^{-8}$ mol per mol of a final silver halide. While the addition of silver nitrate reached 92% to 98%, a $K_2[Ir(5\text{-methylthiazole})Cl_5]$ aqueous solution was added in an Ir amount of $6\times10^{-7}$ mol per mol of a final silver halide. After desalting was conducted at 40° C., 168 g of lime-treated gelatin was added to adjust pH to 5.7 and pCl to 1.8. An emulsion of silver chloride cubic particles having a side length of 0.63 μm and a variation coefficient of 11% was obtained.

This emulsion was dissolved at 40° C., and glutaryldiaminophenyl sulfide was added in an amount of $3\times10^{-5}$ mol per mol of the silver halide. The mixture was aged at 65° C. for optimum conditions using sodium thiosulfate 5-hydrate and a gold sulfide colloidal dispersion. After the temperature was decreased to 40° C., sensitization dye A was added in an amount of $1.9\times10^{-4}$ mol per mol of the silver halide, sensitization dye B in an amount of $1\times10^{-4}$ mol per mol of the silver halide, 1-phenyl-5-mercaptotetrazole in an amount of $2\times10^{-4}$ mol per mol of the silver halide, 1-(5-methylureidophenyl)-5-mercaptotetrazole in an amount of $2\times10^{-4}$ mol per mol of the silver halide and potassium bromide in an amount of $2\times10^{-3}$ mol per mol of the silver halide respectively. The thus-obtained emulsion was designated emulsion B-1'.

Preparation of Emulsion B-2

An emulsion was prepared in the same manner as emulsion B-1' except that while the addition of silver nitrate reached 80% to 90%, potassium bromide was added in an amount of 1.5 mol % per mol of a final silver halide with vigorous stirring. An emulsion of silver bromochloride cubic particles having a side length of 0.63 μm and a variation coefficient of 11% was obtained. The thus-obtained emulsion was designated emulsion B-2.

The bromide ion concentration distribution of the resulting emulsion B-2 was analyzed by the etching/TOF-SIMS method, and it was found that the bromide ion had a concentration maximum inside the particle. It is indicated that the silver bromide-containing phase is formed in the inside (position in which the addition of silver nitrate reached 80% to 90%) of the particle subjected to the addition of the bromide solution. There is almost no difference in the resulting particle form between emulsions B-1' and B-2, and emulsion B-2 is considered to contain the silver bromochloride particles in which the silver bromide-containing phases are formed in laminar shape within the particles.

Preparation of Emulsion B-3

An emulsion was prepared in the same manner as emulsion B-1' except that while the addition of silver nitrate reached 90% to 100%, potassium bromide was added in an amount of 1.5 mol % per mol of a final silver halide with vigorous stirring. An emulsion of silver bromochloride cubic particles having a side length of 0.63 μm and a variation coefficient of 11% was obtained. The thus-obtained emulsion was designated emulsion B-3.

The bromide ion concentration distribution of the resulting emulsion B-3 was analyzed by the etching/TOF-SIMS method, and it was found that the bromide ion was mainly distributed in the vicinity of the surface of the particle. It is indicated that the silver bromide-containing phase is formed in the vicinity of the surface (position in which the addition of silver nitrate reached 90% to 100%) of the particle subjected to the addition of the bromide solution. There is almost no difference in the resulting particle form between emulsions B-1' and B-3, and emulsion B-3 is considered to contain the silver bromochloride particles in which the silver bromide-containing phases are formed in laminar shape in the vicinity of the surfaces of the particles.

Preparation of Emulsion B-4

An emulsion was prepared in the same manner as emulsion B-1' except that while the addition of silver nitrate reached 80% to 100%, potassium bromide was added in an amount of 3 mol % per mol of a final silver halide with vigorous stirring. An emulsion of silver bromochloride cubic particles having a side length of 0.63 μm and a variation coefficient of 11% was obtained. The thus-obtained emulsion was designated emulsion B-4.

The bromide ion concentration distribution of the resulting emulsion B-4 was analyzed by the etching/TOF-SIMS method, and it was found that the bromide ion was distributed from the inside to the surface of the particle. It is indicated that the silver bromide-containing phase is formed from the inside to the surface of the particle (position in which the addition of silver nitrate reached 80% to 100%) of the particle subjected to the addition of the bromide solution. There is almost no difference in the resulting particle form between emulsions B-1' and B-4, and emulsion B-4 is considered to contain the silver bromochloride particles in which the silver bromide-containing phases are formed in laminar shape from the inside to the surface of the particles.

A surface of a substrate obtained by coating both sides of paper with a polyethylene resin was subjected to corona discharge treatment. Then, a gelatin undercoat layer containing sodium dodecylbenzenesulfonate was formed, and first to seventh photographic layers were further coated in order to produce a sample of a silver halide color photosensitive material having the following layer structure. Coating solutions of the respective photographic layers were prepared as follows.

Preparation of a First Layer Coating Solution

Yellow coupler (ExY-1) (57 g), 7 g of color image stabilizer (Cpd-1), 4 g of color image stabilizer (Cpd-2), 7 g of color image stabilizer (Cpd-3) and 2 g of color image stabilizer (Cpd-8) were dissolved in 21 g of solvent (Solv-1) and 80 ml of ethyl acetate. This solution was emulsion-dispersed in a 23.5 mass % gelatin aqueous solution containing 4 g of sodium dodecylbenzenesulfonate with a high-speed stirring emulsifier (dissolver), and water was added to form 900 g of emulsion dispersion A.

Meanwhile, emulsion dispersion A and emulsion B-1' were mixed and dissolved to prepare a first layer coating solution having the following composition. A coating amount of the emulsion is expressed in terms of a coating amount of silver.

Second to seventh layer coating solutions were also prepared in the same manner as the first layer coating solution. As gelatin hardening agents of the respective layers, 1-oxy-3,5-dichloro-s-triazine sodium salts (H-1), (H-2) and (H-3) were used. Further, Ab-1, Ab-2, Ab-3 and Ab-4 were added to the respective layers such that the total amounts were 15.0 mg/m$^2$, 60.0 mg/m$^2$, 5.0 mg/m$^2$ and 10.0 mg/m$^2$ respectively.

In silver bromochloride emulsions of green and red sensitive emulsion layers, the spectral sensitization dyes were used as described below.

Green Sensitive Emulsion Layer (Sensitization dye D was added to a large-sized emulsion in an amount of $3.0\times10^{-4}$ mol per mol of a silver halide and to a small-sized emulsion in an amount of $3.6\times10^{-4}$ mol per mol of a silver halide. Further, sensitization dye E was added to a large-sized emulsion in an amount of $4.0\times10^{-5}$ mol per mol of a silver halide and to a small-sized emulsion in an amount of $7.0\times10^{-5}$ mol per mol of a silver halide. Sensitization dye F was added to a large-sized emulsion in an amount of $2.0\times10^{-4}$ mol per mol of a silver halide and to a small-sized emulsion in an amount of $2.8\times10^{-4}$ mol per mol of a silver halide.)

Red Sensitive Emulsion Layer (Each of sensitization dyes H and K was added to a large-sized emulsion in an amount of $8.0\times10^{-5}$ mol per mol of a silver halide and to a small-sized emulsion in an amount of $10.7\times10^{-5}$ mol per mol of a silver halide. Further, the following compound I was added to the red sensitive emulsion layer in an amount of $3.0\times10^{-3}$ mol per mol of a silver halide.)

(Sensitization dye K)

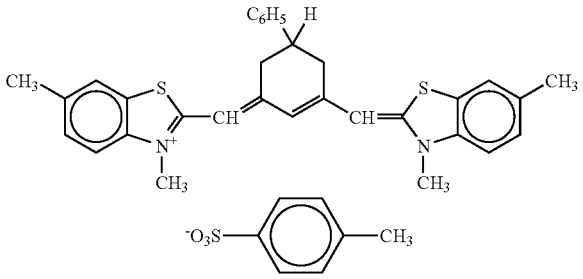

Further, 1- (3-methylureidophenyl)-5-mercaptotetrazole was added to the green sensitive emulsion layer and the red sensitive emulsion layer in amounts of $1.0\times10^{-5}$ mol and $5.9\times10^{-4}$ mol per mol of a silver halide respectively.

Still further, it was also added to the second, fourth, sixth and seventh layers in amounts of 0.2 mg/m$^2$, 0.2 mg/m$^2$, 0.6 mg/m$^2$ and 0.1 mg/m$^2$ per mol of a silver halide respectively.

Furthermore, 4-hydroxy-6-methyl-1,3,3a,7-tetrazaindene was added to the blue sensitive emulsion layer and the green sensitive emulsion layer in amounts of $1\times10^{-4}$ mol and $2\times10^{-4}$ mol per mol of a silver halide respectively.

Moreover, a copolymer latex (mass ratio 1:1, average molecular weight 200,000 to 400,000) of methacrylic acid and butyl acrylate was added to the red sensitive emulsion layer in an amount of 0.05 g/m$^2$.

In addition, disodiumcatecol-3,5-disulfonate was added to the second, fourth and sixth layers in amounts of 6 mg/m$^2$, 6 mg/m$^2$ and 18 mg/m$^2$ respectively.

Besides, the foregoing dyes were added to prevent irradiation.

Layer Structure

The structure of each layer is shown below. A figure indicates a coating amount (g/m$^2$). An amount of a silver halide emulsion is expressed in terms of a coating amount of silver.

Substrate

Polyethylene Resin Laminated Paper

[A polyethylene resin on the first layer side contained a white pigment ($TiO_2$: content 16% by mass, ZnO: content 4% by mass), a fluorescent brightener (4,4'-bis(5-methylbenzoxazolyl)stilbene: content 0.03% by mass) and a blue dye (ultramarine).]

| | |
|---|---|
| **First layer (blue sensitive emulsion layer)** | |
| emulsion B-1' | 0.24 |
| gelatin | 1.25 |
| yellow coupler (ExY-1) | 0.57 |
| color image stabilizer (Cpd-1) | 0.07 |
| color image stabilizer (Cpd-2) | 0.04 |
| color image stabilizer (Cpd-3) | 0.07 |
| color image stabilizer (Cpd-8) | 0.02 |
| solvent (Solv-1) | 0.21 |
| **Second layer (color mixing inhibition layer)** | |
| gelatin | 0.99 |
| color mixing inhibitor (Cpd-4) | 0.09 |
| color image stabilizer (Cpd-5) | 0.018 |
| color image stabilizer (Cpd-6) | 0.13 |
| color image stabilizer (Cpd-7) | 0.01 |
| solvent (Solv-1) | 0.06 |
| solvent (Solv-2) | 0.22 |
| **Third layer (green sensitive emulsion layer)** | |
| silver bromochloride emulsion B [a 1:3 (silver molar ratio) of a large-sized cubic emulsion with an average particle size of 0.45 μm and a small-sized cubic emulsion with an average particle size of 0.35 μm which were subjected to gold and sulfur sensitizations. Variation coefficients of the particle size distributions were 0.10 and 0.08 respectively. In both of the large-sized and small-sized emulsions, 0.15 mol % of silver iodide was contained in the vicinity of the surface of the particle, and 0.4 mol % of silver bromide was locally contained in the surface of the particle.] | 0.14 |
| gelatin | 1.36 |
| magenta coupler (ExM) | 0.15 |
| ultraviolet absorber (UV-A) | 0.14 |
| color image stabilizer (Cpd-2) | 0.02 |
| color image stabilizer (Cpd-4) | 0.002 |
| color image stabilizer (Cpd-6) | 0.09 |
| color image stabilizer (Cpd-8) | 0.02 |
| color image stabilizer (Cpd-9) | 0.03 |
| color image stabilizer (Cpd-10) | 0.01 |
| color image stabilizer (Cpd-11) | 0.0001 |
| solvent (Solv-3) | 0.11 |
| solvent (Solv-4) | 0.22 |
| solvent (Solv-5) | 0.20 |
| **Fourth layer (color mixing inhibition layer)** | |
| gelatin | 0.71 |
| color mixing inhibition layer (Cpd-4) | 0.06 |
| color image stabilizer (Cpd-5) | 0.013 |
| color image stabilizer (Cpd-6) | 0.10 |
| color image stabilizer (Cpd-7) | 0.007 |
| solvent (Solv-1) | 0.04 |
| solvent (Solv-2) | 0.16 |
| **Fifth layer (red sensitive emulsion layer)** | |
| silver bromochloride emulsion C [a 5:5 (silver molar ratio) of a large-sized cubic emulsion with an average particle size of 0.40 μm and a small-sized cubic emulsion with an average particle size of 0.30 μm which were subjected to gold and sulfur sensitizations. Variation coefficients of the particle size distributions were 0.09 and 0.11 respectively. In both of the large-sized and small-sized emulsions, 0.1 mol % of silver iodide was contained in the vicinity of the surface of the particle, and 0.8 mol % of silver bromide was locally contained in the surface of the particle.] | 0.12 |
| gelatin | 1.11 |
| cyan coupler (ExC-2) | 0.13 |
| cyan coupler (ExC-3) | 0.03 |
| color image stabilizer (Cpd-1) | 0.05 |
| color image stabilizer (Cpd-6) | 0.06 |
| color image stabilizer (Cpd-7) | 0.02 |
| color image stabilizer (Cpd-9) | 0.04 |
| color image stabilizer (Cpd-10) | 0.01 |
| color image stabilizer (Cpd-14) | 0.01 |
| color image stabilizer (Cpd-15) | 0.12 |
| color image stabilizer (Cpd-16) | 0.03 |
| color image stabilizer (Cpd-17) | 0.09 |
| color image stabilizer (Cpd-18) | 0.07 |
| solvent (Solv-5) | 0.15 |
| solvent (Solv-8) | 0.05 |
| **Sixth layer (ultraviolet absorption layer)** | |
| gelatin | 0.46 |
| ultraviolet absorber (UV-B) | 0.45 |
| compound (S1-4) | 0.0015 |
| solvent (Solv-7) | 0.25 |
| **Seventh layer (protecting layer)** | |
| gelatin | 1.00 |
| polyvinyl alcohol acryl-modified copolymer (degree of modification 17%) | 0.04 |
| liquid paraffin | 0.02 |
| surfactant (Cpd-13) | 0.01 |

The thus-obtained sample was designated sample B-1'. Samples were also produced in the same manner as sample B-1' except that emulsion B-1' of the blue sensitive emulsion layer was replaced with emulsions B-2 to B-4, and were designated samples B-2 to B-4 respectively.

In order to examine photographic characteristics of these samples, the following experiment was conducted.

Gradation exposure for sensitometry was applied to the coated samples using a sensitometer for high-intensity exposure (trade name: HIE model, manufactured by Yamashita Denso K.K.). A filter (trade name: SP-1, manufactured by Fuji Photo Film Co., Ltd.) was installed, and high-intensity exposure was conducted for $10^{-6}$ second.

After the exposure, the foregoing color development processing A was conducted.

The yellow color density of each processed sample was measured, and a characteristic curve of high-intensity exposure for $10^{-6}$ second was obtained. A sensitivity was defined by a reciprocal of an exposure dose at which to give a color density higher than the lowest color density by 0.7, and expressed in terms of a relative value when a density of sample B-1' was rated as 100. Further, a gradation was obtained from an inclination of a line by which to connect a density of 0.5 with a density of 2.0.

Moreover, for measuring a latent image stability, characteristic curves were obtained where processing started 10 seconds after the exposure and where processing started 10 minutes after the exposure. The change in density at an exposure dose to give a density of 1.0 where processing started 10 seconds after the exposure was examined. Further, for examining a dependence of exposure on a temperature and humidity, characteristic curves were obtained where processing started 10 seconds after the exposure in an atmosphere of 10° C. and relative humidity of 55% and where processing started 10 seconds after the exposure in an atmosphere of 30° C. and relative humidity of 30%. The change in density at an exposure dose to give a density of 1.0 where processing started 10 seconds after the exposure in an atmosphere of 10° C. and relative humidity of 55% was examined. The results are shown in Table 4.

TABLE 4

| Sample | Br layer: Position of addition | Br layer: Content | Sensitivity | Gradation | Latent image stability | Dependence of exposure on temperature and humidity | Remarks |
|---|---|---|---|---|---|---|---|
| B-1' | — | — | 100 | 1.7 | 0.18 | 0.23 | Comparison |
| B-2' | 80-90% | 1.5 mol % | 180 | 2.3 | 0.03 | 0.04 | Invention |
| B-3' | 90%-100% | 1.5 mol % | 180 | 2.2 | 0.04 | 0.08 | Invention |
| B-4' | 80%-100% | 3 mol % | 190 | 2.2 | 0.04 | 0.07 | Invention |

As is apparent from the results in Table 4, it was found that samples B-2, B-3 and B-4 in which the blue sensitive emulsion layer contained the silver bromochloride emulsion with the silver bromide-containing layers formed in laminar shape in the present invention had a markedly high blue sensitivity and a high gradation and were excellent in latent image stability and dependence of exposure on a temperature and humidity.

Example 5

Preparation of Emulsion G-1'

One thousand milliliters of an oxidized gelatin 5% aqueous solution was adjusted to pH of 5.5 and pCl of 1.7, and an aqueous solution containing 2.12 mols of silver nitrate and an aqueous solution containing 2.25 mols of sodium chloride were simultaneously added at 55° C. with vigorous stirring for mixing. While the addition of silver nitrate reached 80% to 90%, a $K_4[Ru(CN)_6]$ aqueous solution was added in an Ru amount of $5\times10^{-5}$ mol per mol of a final silver halide. While the addition of silver nitrate reached 83% to 88%, a $K_2[IrCl_6]$ aqueous solution was added in an Ir amount of $5\times10^{-8}$ mol per mol of a final silver halide. While the addition of silver nitrate reached 92% to 98%, a $K_2[Ir(5\text{-methylthiazole})Cl_5]$ aqueous solution was added in an Ir amount of $1\times10^{-6}$ mol per mol of a final silver halide. After desalting was conducted at 40° C., 168 g of lime-treated gelatin was added to adjust pH to 5.7 and pCl to 1.8. An emulsion of silver chloride cubic particles having a side length of 0.38 μm and a variation coefficient of 11% was obtained.

This emulsion was dissolved at 40° C., and glutaryldiaminophenyl sulfide was added in an amount of $4\times10^{-5}$ mol per mol of the silver halide. The mixture was aged at 65° C. for optimum conditions using sodium thiosulfate 5-hydrate and a gold sulfide colloidal dispersion. After the temperature was decreased to 40° C., sensitization dye D was added in an amount of $5\times10^{-4}$ mol per mol of the silver halide, 1-phenyl-5-mercaptotetrazole in an amount of $2\times10^{-4}$ mol per mol of the silver halide, 1-(5-methylureidophenyl)-5-mercaptotetrazole in an amount of $4\times10^{-4}$ mol per mol of the silver halide and potassium bromide in an amount of $4\times10^{-3}$ mol per mol of the silver halide respectively. The thus-obtained emulsion was designated emulsion G-1'.

Preparation of Emulsion G-2'

An emulsion was prepared in the same manner as emulsion G-1' except that while the addition of silver bromide reached 80% to 90%, potassium bromide was added in an amount of 2.5 mol % per mol of a final silver halide with vigorous stirring. An emulsion of silver bromochloride cubic particles having a side length of 0.38 μm and a variation coefficient of 11% was obtained. The thus-obtained emulsion was designated emulsion G-2'.

Preparation of Emulsion G-3'

An emulsion was prepared in the same manner as emulsion G-1' except that while the addition of silver nitrate reached 90% to 100%, potassium bromide was added in an amount of 2.5 mol % per mol of a final silver halide with vigorous stirring. An emulsion of silver bromochloride cubic particles having a side length of 0.38 μm and a variation coefficient of 11% was obtained. The thus-obtained emulsion was designated emulsion G-3'.

Preparation of Emulsion G-4'

An emulsion was prepared in the same manner as emulsion G-1' except that while the addition of silver nitrate reached 80% to 100%, potassium bromide was added in an amount of 5 mol % per mol of a final silver halide with vigorous stirring. An emulsion of silver bromochloride cubic particles having a side length of 0.38 μm and a variation coefficient of 11% was obtained. The thus-obtained emulsion was designated emulsion G-4'.

A thin layer sample was produced as in Example 4 except that the layer structure was changed as follows.

| Production of a sample | |
|---|---|
| **First layer (blue sensitive emulsion layer)** | |
| emulsion B-1' | 0.24 |
| gelatin | 1.25 |
| yellow coupler (ExY-1) | 0.57 |
| color image stabilizer (Cpd-1) | 0.07 |
| color image stabilizer (Cpd-2) | 0.04 |
| color image stabilizer (Cpd-3) | 0.07 |
| color image stabilizer (Cpd-8) | 0.02 |
| solvent (Solv-1) | 0.21 |
| **Second layer (color mixing inhibition layer)** | |
| gelatin | 0.60 |
| color mixing inhibitor (Cpd-19) | 0.09 |
| color image stabilizer (Cpd-5) | 0.007 |
| color image stabilizer (Cpd-7) | 0.007 |
| ultraviolet absorber (UV-C) | 0.05 |
| solvent (Solv-5) | 0.11 |
| **Third layer (green sensitive emulsion layer)** | |
| emulsion G-1' | 0.14 |
| gelatin | 0.73 |
| magenta coupler (ExM) | 0.15 |

-continued

| Production of a sample | |
|---|---|
| ultraviolet absorber (UV-A) | 0.05 |
| color image stabilizer (Cpd-2) | 0.02 |
| color image stabilizer (Cpd-7) | 0.008 |
| color image stabilizer (Cpd-8) | 0.07 |
| color image stabilizer (Cpd-9) | 0.03 |
| color image stabilizer (Cpd-10) | 0.009 |
| color image stabilizer (Cpd-11) | 0.0001 |
| solvent (Solv-3) | 0.06 |
| solvent (Solv-4) | 0.11 |
| solvent (Solv-5) | 0.06 |
| Fourth layer (color mixing inhibition layer) | |
| gelatin | 0.48 |
| color mixing inhibition layer (Cpd-4) | 0.07 |
| color image stabilizer (Cpd-5) | 0.006 |
| color image stabilizer (Cpd-7) | 0.006 |
| ultraviolet absorber (UV-C) | 0.04 |
| solvent (Solv-5) | 0.09 |
| Fifth layer (red sensitive emulsion layer) | |
| silver bromochloride emulsion C [the same emulsion as in sample B-1') | 0.12 |
| gelatin | 0.59 |
| cyan coupler (ExC-2) | 0.13 |
| cyan coupler (ExC-3) | 0.03 |
| color image stabilizer (Cpd-7) | 0.01 |
| color image stabilizer (Cpd-9) | 0.04 |
| color image stabilizer (Cpd-15) | 0.19 |
| color image stabilizer (Cpd-18) | 0.04 |
| ultraviolet absorber (UV-7) | 0.02 |
| solvent (Solv-5) | 0.09 |
| Sixth layer (ultraviolet absorption layer) | |
| gelatin | 0.32 |
| ultraviolet absorber (UV-C) | 0.42 |
| solvent (Solv-7) | 0.08 |
| Seventh layer (protecting layer) | |
| gelatin | 0.70 |
| polyvinyl alcohol acryl-modified copolymer (degree of modification 17%) | 0.04 |
| liquid paraffin | 0.01 |
| surfactant (Cpd-13) | 0.01 |
| polydimethylsiloxane | 0.01 |
| carbon dioxide | 0.003 |

The sample using emulsion G-1' as the emulsion of the green sensitive emulsion layer was designated sample G-1'. Samples were also produced in the same manner as sample G-1' except that emulsion G-1' of the green sensitive emulsion layer was replaced with emulsions G-2' to G-4', and were designated samples G-2' to G-4'.

In order to examine photographic characteristics of these samples, the following experiment was conducted.

Each of the coated samples was subjected to exposure as in Example 1.

Each of the exposed samples was subjected to superquick color development processing according to the foregoing development processing B.

The magenta color density of each processed sample was measured, and a characteristic curve of high-intensity exposure for $10^{-6}$ second was obtained. A sensitivity was defined by a reciprocal of an exposure dose at which to give a color density higher than the lowest color density by 0.7, and expressed in terms of a relative value when a density of sample G-1' was rated as 100. Further, a gradation was obtained from an inclination of a line by which to connect a density of 1.5 with a density of 2.0. The results are shown in Table 5.

TABLE 5

| | Br layer | | | | |
|---|---|---|---|---|---|
| Sample | Position | Content | Sensitivity | Gradation | Remarks |
| G-1' | — | — | 100 | 1.8 | Comparison |
| G-2' | 80%-90% | 2.5 mol % | 160 | 2.4 | Invention |
| G-3' | 90%-100% | 2.5 mol % | 160 | 2.3 | Invention |
| G-4' | 80%-100% | 5 mol % | 170 | 2.2 | Invention |

As is apparent from the results in Table 5, it was found that samples G-2', G-3' and G-4' in which the green sensitive emulsion layer contained the silver bromochloride emulsion with the silver bromide-containing phases formed in laminar shape in the present invention had a markedly high green sensitivity and a high gradation.

Moreover, samples G-2' to G-4' corresponding to samples G-2 to G-4 were produced except that emulsion B-1' of the first layer was changed to emulsion B-4' in samples G-2' to G-4'. As a result of the foregoing evaluation, approximately the same results as in samples G-2 to G-4 were provided.

Example 6

An image was formed by laser scanning exposure using the sample in Example 5.

As a laser beam source, 473 nm taken out by changing a wavelength of a YAG solid state laser (oscillation wavelength 946 nm) using a semiconductor laser GaAlAs (oscillation wavelength 808.5 nm) as an excitation light source with SHG crystals of $LiNbO_3$ having an inverted domain structure, 532 nm taken out by changing a wavelength of a $YVO_4$ solid state laser (oscillation wavelength 1,064 nm) using a semiconductor laser GaAlAs (oscillation wavelength 808.7 nm) as an excitation light source with SHG crystals of $LiNbO_3$ having an inverted domain structure, and AlGaInP (oscillation wavelength approximately 680 nm, trade name: LN9R20 manufactured by Matsushita Electric Industrial Co., Ltd.) were used. The laser beams of the three colors were moved vertically in the scanning direction with a polygon mirror to allow successive scanning exposure on the sample. The change in amount of light owing to the temperature of the semiconductor laser was suppressed by keeping constant the temperature upon using a Peltier element. An effective beam diameter was 80 μm, a scanning pitch was 42.3 μm (600 dpi), and an average exposure time for 1 pixel was $1.7\times10^{-7}$ second.

After the exposure, the processing was conducted according to color development processing B. Consequently, it was found that in samples G-2', G-3' and G-4' of the present invention, the green sensitive layer showed a high sensitivity and a high gradation as in the results of the high-intensity exposure in Example 5, the blue sensitive layer and the green sensitive layer showed a high sensitivity and a high gradation and they were suited also for the image formation using the laser scanning exposure.

Example 7

Preparation of Emulsion B-1Δ

One thousand milliliters of a lime-treated gelatin 3% aqueous solution was adjusted to pH of 5.5 and pCl of 1.7, and an aqueous solution containing 2.12 mols of silver nitrate and an aqueous solution containing 2.2 mols of sodium chloride were simultaneously added at 66° C. with vigorous stirring for mixing. While the addition of silver nitrate reached 80% to 90%, a $K_4[Ru(CN)_6]$ aqueous solution was added in an Ru amount of $3\times10^{-5}$ mol per mol of a final silver halide. While the addition of silver nitrate reached 83% to 88%, a $K_2[IrCl_6]$ aqueous solution was added in an Ir amount of $3\times10^{-8}$ mol per mol of a final silver halide. Further, while the addition of silver nitrate reached 92% to 98%, a $K_2$[Ir(5-methylthiazole)$Cl_5$] aqueous solution was added in an Ir amount of $1\times10^{-6}$ mol per mol of a final silver halide.

After desalting was conducted at 40° C., 168 g of lime-treated gelatin was added to adjust pH to 5.5 and pCl to 1.8. An emulsion of silver chloride cubic particles having a sphere-equivalent diameter of 0.75 μm and a variation coefficient of 11% was obtained.

This emulsion was dissolved at 40° C., and sodium thiosulfonate was added in an amount of $2\times10^{-5}$ mol per mol of the silver halide. Sodium thiosulfate 5-hydrate was used as a sulfur sensitizer and (S-2) as a gold sensitizer, and the mixture was aged at 60° C. for optimum conditions. After the temperature was decreased to 40° C., sensitization dye A was added in an amount of $2\times10^{-4}$ mol per mol of the silver halide, sensitization dye B in an amount of $1\times10^{-4}$ mol per mol of the silver halide, 1-phenyl-5-mercaptotetrazole in an amount of 2×10-mol per mol of the silver halide, 1-(5-methylureidophenyl)-5-mercaptotetrazole in an amount of $2\times10^{-4}$ mol per mol of the silver halide and potassium bromide in an amount of $2\times10^{-4}$ mol per mol of the silver halide respectively. The thus-obtained emulsion was designated emulsion B-1".

Preparation of Emulsion B-2"

An emulsion was prepared in the same manner as emulsion B-1" except that while the addition of silver nitrate reached 90% to 100%, potassium bromide was added in an amount of 2 mol % per mol of a final silver halide with vigorous stirring and the addition of the $K_2[IrCl_6]$ aqueous solution was conducted simultaneously with the addition of potassium bromide. An emulsion of silver bromochloride cubic particles having a sphere-equivalent diameter of 0.75 μm and a variation coefficient of 11% was obtained. The thus-obtained emulsion was designated emulsion B-2".

Preparation of Emulsion B-3"

An emulsion was prepared in the same manner as emulsion B-1" except that while the addition of silver nitrate reached 80% to 90%, potassium bromide was added in an amount of 2 mol % per mol of a final silver halide with vigorous stirring and the addition of the $K_2[IrCl_6]$ aqueous solution was conducted simultaneously with the addition of potassium bromide. An emulsion of silver bromochloride cubic particles having a sphere-equivalent diameter of 0.75 μm and a variation coefficient of 11% was obtained. The thus-obtained emulsion was designated emulsion B-3".

Preparation of Emulsion B-4"

An emulsion was prepared in the same manner as emulsion B-1" except that while the addition of silver nitrate reached 70% to 80%, potassium bromide was added in an amount of 2 mol % per mol of a final silver halide with vigorous stirring and the addition of the $K_2[IrCl_6]$ aqueous solution was conducted simultaneously with the addition of potassium bromide. An emulsion of silver bromochloride cubic particles having a sphere-equivalent diameter of 0.75 μm and a variation coefficient of 11% was obtained. The thus-obtained emulsion was designated emulsion B-4".

Preparation of Emulsion B-5"

An emulsion was prepared in the same manner as emulsion B-1" except that while the addition of silver nitrate reached 50% to 60%, potassium bromide was added in an amount of 2 mol % per mol of a final silver halide with vigorous stirring and the addition of the $K_2[IrCl_6]$ aqueous solution was conducted simultaneously with the addition of potassium bromide. An emulsion of silver bromochloride cubic particles having a sphere-equivalent diameter of 0.75 μm and a variation coefficient of 11% was obtained. The thus-obtained emulsion was designated emulsion B-5".

Preparation of Emulsion B-6"

An emulsion was prepared in the same manner as emulsion B-1" except that while the addition of silver nitrate reached 80% to 90%, potassium bromide was added in an amount of 2 mol % per mol of a final silver halide with vigorous stirring and the addition of the $K_2[IrCl_6]$ aqueous solution was conducted simultaneously with the addition of potassium bromide and the temperature of the subsequent addition of silver nitrate and sodium chloride was decreased to 40° C. An emulsion of silver bromochloride cubic particles having a sphere-equivalent diameter of 0.75 μm and a variation coefficient of 11% was obtained. The thus-obtained emulsion was designated emulsion B-6".

Preparation of Emulsion B-7"

An emulsion was prepared in the same manner as emulsion B-1" except that while the addition of silver nitrate reached 80% to 90%, potassium bromide was added in an amount of 2 mol % per mol of a final silver halide with vigorous stirring upon decreasing the addition temperature to 40° C., the addition of the $K_2[IrCl_6]$ aqueous solution was conducted simultaneously with the addition of potassium bromide and the temperature of the subsequent addition of silver nitrate and sodium chloride was maintained at 40° C. An emulsion of silver bromochloride cubic particles having a sphere-equivalent diameter of 0.75 μm and a variation coefficient of 11% was obtained. The thus-obtained emulsion was designated emulsion B-7".

Preparation of Emulsion B-8"

An emulsion was prepared in the same manner as emulsion B-1" except that while the addition of silver nitrate reached 80% to 90%, potassium bromide was added in an amount of 2 mol % per mol of a final silver halide with vigorous stirring, the addition of the $K_2[IrCl_6]$ aqueous solution was conducted simultaneously with the addition of potassium bromide and while the addition of silver nitrate reached 99% to 100%, potassium bromide was added in an amount of 0.1 mol % per mol of a final silver halide. An emulsion of silver bromochloride cubic particles having a sphere-equivalent diameter of 0.75 μm and a variation coefficient of 11% was obtained. The thus-obtained emulsion was designated emulsion B-8".

Preparation of Emulsion B-9"

An emulsion was prepared in the same manner as emulsion B-1" except that while the addition of silver nitrate reached 80% to 90%, silver halide fine particles containing a bromide ion in an amount of 2 mol % per mol of a final silver halide were added and the $K_2$ $[IrCl_6]$ aqueous solution was contained in the silver halide fine particles. An emulsion of silver bromochloride cubic particles having a sphere-equivalent diameter of 0.75 μm and a variation coefficient of 11% was obtained. The thus-obtained emulsion was designated emulsion B-9".

Preparation of Emulsion G-1"

One thousand milliliters of a lime-treated gelatin 3% aqueous solution was adjusted to pH of 5.5 and pCl of 1.7, and an aqueous solution containing 2.12 mols of silver nitrate and an aqueous solution containing 2.2 mols of sodium chloride were simultaneously added at 45° C. with vigorous stirring for mixing. While the addition of silver nitrate reached 80% to 90%, potassium bromide was added in an amount of 2 mol % per mol of a final silver halide with vigorous stirring. Further, while the addition of silver nitrate reached 80% to 90%, a $K_4[Ru(CN)_6]$ aqueous solution was added in an Ru amount of $3\times10^{-5}$ mol per mol of a final silver halide. While the addition of silver nitrate reached 83% to 88%, a $K_2[IrCl_6]$ aqueous solution was added in an Ir amount of $5\times10^{-8}$ mol per mol of a final silver halide. While the addition of silver nitrate reached 92% to 95%, a $K_2[Ir(5\text{-methylthiazole})Cl_5]$ aqueous solution was added in an Ir amount of $5\times10^{-7}$ mol per mol of a final silver halide. While the addition of silver nitrate reached 95% to 98%, a $K_2[Ir(H_2O)Cl_5]$ aqueous solution was added in an Ir amount of $5\times10^{-7}$ mol per mol of a final silver halide. After desalting was conducted at 40° C., 168 g of lime-treated gelatin was added to adjust pH to 5.5 and pCl to 1.8. An emulsion of silver chloride cubic particles having a sphere-equivalent diameter of 0.35 μm and a variation coefficient of 10% was obtained.

This emulsion was dissolved at 40° C., and sodium thiosulfonate was added in an amount of $2\times10^{-5}$ mol per mol of the silver halide. Sodium thiosulfate 5-hydrate was used as a sulfur sensitizer and (S-2) as a gold sensitizer, and the mixture was aged at 60° C. for optimum conditions. After the temperature was decreased to 40°, sensitization dye D was added in an amount of $6\times10^{-4}$ mol per mol of the silver halide, 1-phenyl-5-mercaptotetrazole in an amount of $2\times10^{-4}$ mol per mol of the silver halide, 1-(5-methylureidophenyl)-5-mercaptotetrazole in an amount of $8\times10^{-4}$ mol per mol of the silver halide and potassium bromide in an amount of $7\times10^{-3}$ mol per mol of the silver halide respectively. The thus-obtained emulsion was designated emulsion G-1".

Preparation of Emulsion R-1"

One thousand milliliters of a lime-treated gelatin 3% aqueous solution was adjusted to pH of 5.5 and pCl of 1.7, and an aqueous solution containing 2.12 mols of silver nitrate and an aqueous solution containing 2.2 mols of sodium chloride were simultaneously added at 45° C. with vigorous stirring for mixing. While the addition of silver nitrate reached 80% to 100%, potassium bromide was added in an amount of 4 mol % per mol of a final silver halide with vigorous stirring. Further, while the addition of silver nitrate reached 80% to 90%, a $K_4[Ru\ (CN)_6]$ aqueous solution was added in an Ru amount of $3\times10^{-5}$ mol per mol of a final silver halide. While the addition of silver nitrate reached 83% to 88%, a $K_2[IrCl_6]$ aqueous solution was added in an Ir amount of $5\times10^{-7}$ mol per mol of a final silver halide. When the addition of silver nitrate was completed by 90%, a potassium iodide aqueous solution was added in an I amount of 0.1 mol % per mol of a final silver halide with vigorous stirring. While the addition of silver nitrate reached 92% to 95%, a $K_2[Ir(5\text{-methylthiazole})Cl_5]$ aqueous solution was added in an Ir amount of $5\times10^{-7}$ mol per mol of a final silver halide. While the addition of silver nitrate reached 95% to 98%, a $K_2[Ir(H_2O)Cl^5]$ aqueous solution was added in an Ir amount of $5\times10^{-7}$ mol per mol of a final silver halide.

After desalting was conducted at 40° C., 168 g of lime-treated gelatin was added to adjust pH to 5.5 and pCl to 1.8. An emulsion of silver iodobromochloride cubic particles having a sphere-equivalent diameter of 0.35 μm and a variation coefficient of 10% was obtained.

This emulsion was dissolved at 40° C., and sodium thiosulfonate was added in an amount of $2\times10^{-5}$ mol per mol of the silver halide. Sodium thiosulfate 5-hydrate was used as a sulfur sensitizer and (S-2) as a gold sensitizer, and the mixture was aged at 60° C. for optimum conditions. After the temperature was decreased to 40° C., sensitization dye K was added in an amount of $2\times10^{-4}$ mol per mol of the silver halide, 1-phenyl-5-mercaptotetrazole in an amount of $2\times10^{-4}$ mol per mol of the silver halide, 1-(5-methylureidophenyl)-5-mercaptotetrazole in an amount of $8\times10^{-4}$ mol per mol of the silver halide, compound I in an amount of $1\times10^{-3}$ mol per mol of the silver halide and potassium bromide in an amount of $7\times10^{-3}$ mol per mol of the silver halide respectively. The thus-obtained emulsion was designated emulsion R-1".

Subsequently, a sample of a silver halide color photosensitive material was produced as in Example 1. The layer structure and the structural layer coating solutions of the sample were the same as in Example 1 except that emulsions B-1, G-1 and R-1 were replaced with emulsions B-1", G-1" and R-1" respectively.

The thus-obtained sample was designated sample B-1". Samples were also produced in the same manner as sample B-1" except that emulsion B-1" of the blue sensitive emulsion layer was replaced with emulsions B-2" to B-9" respectively. They were designated samples B-2" to B-9" respectively.

In order to examine photographic characteristics of these samples, the following experiment was conducted.

Each of the coated samples was subjected to exposure as in Example 1. After the exposure, the foregoing development processing A was conducted.

Figure 3:
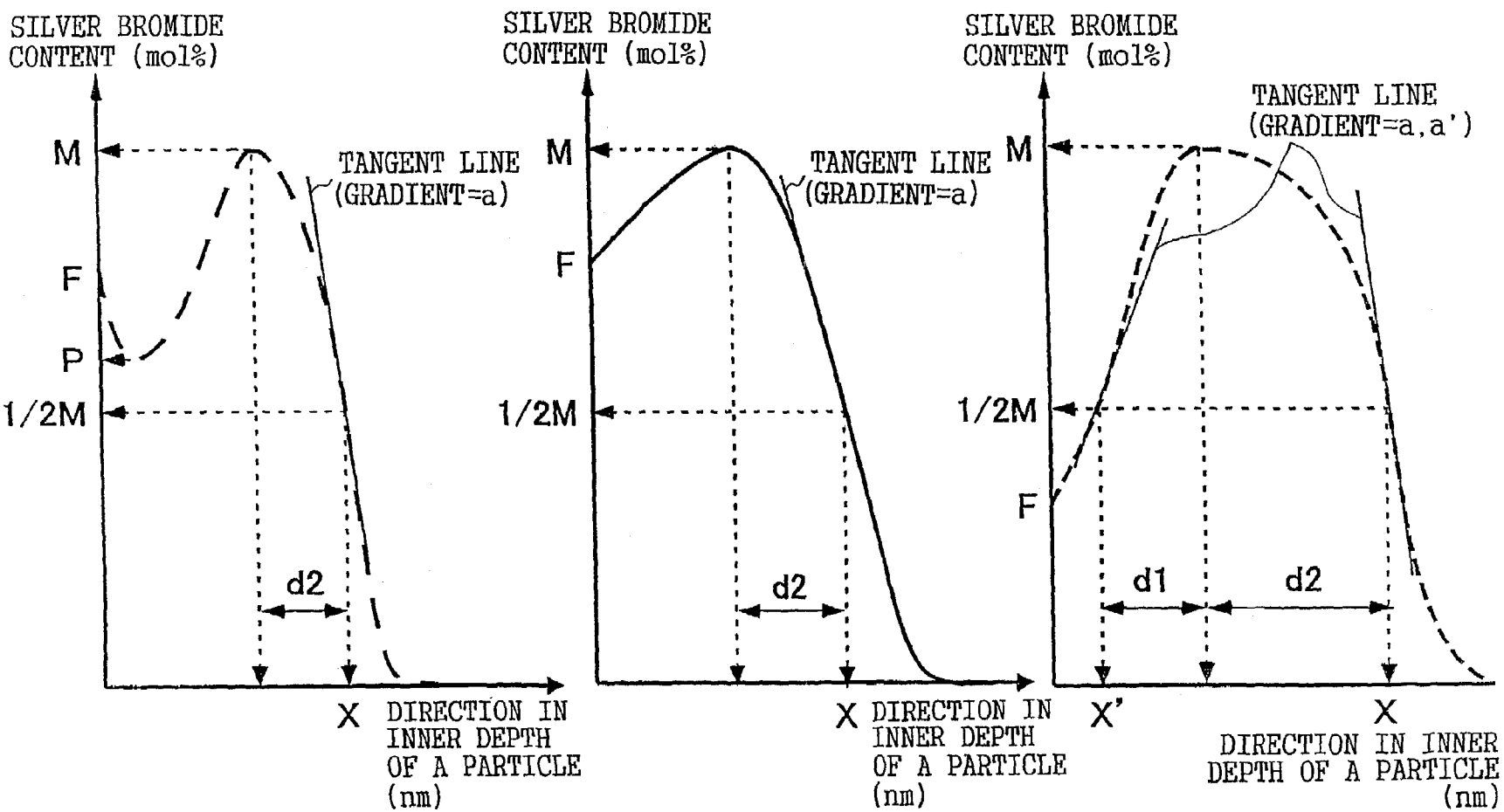
FIG. 3 shows graphs of parameters regarding the silver bromide containing phase of the present invention.

The yellow color density of each processed sample was measured, and a characteristic curve of high-intensity exposure for $10^{-6}$ second was obtained. A sensitivity was defined by a reciprocal of an exposure dose at which to give a color density higher than the lowest color density by 1.5, and expressed in terms of a relative value when a density of sample B-1" was rated as 100. Further, a gradation was obtained from an inclination of a line by which to connect a density of 0.5 with a density of 2.0. Moreover, for measuring a latent image stability, characteristic curves were obtained where processing started 10 seconds after the exposure in an atmosphere of 20° C. and relative humidity of 55% and where processing started 10 minutes after the exposure in the same atmosphere. The change in density at an exposure dose to give a density of 1.5 where processing started 10 seconds after the exposure was examined. Further, for examining a dependence of exposure on a temperature and humidity, characteristic curves were obtained where processing started 5 seconds after the exposure in an atmosphere of 10° C. and relative humidity of 55% and where processing started 5 seconds after the exposure in an atmosphere of 30° C. and relative humidity of 30%. The change in density at an exposure dose to give a density of 1.5 where processing started 5 seconds after the exposure in an atmosphere of 10° C. and relative humidity of 55% was examined. The results are shown in Table 6. Moreover, the silver bromide-containing phase was analyzed by etching/TOF-SIMS, and the results of the obtained parameter values are also shown in Table 6. The details of the parameter values are as shown in FIG. 3.

| Sample No. | Emulsion No. | Parameter values of a silver bromide-containing phase M mol % | F mol % | P mol % | a mol %/nm | d1 nm | d2 nm | Relative sensitivity | Gradation | Latent image stability | Dependence of exposure on temperature and humidity |
|---|---|---|---|---|---|---|---|---|---|---|---|
| B-1" | B-1" | — | — | — | — | — | — | 100 | 1.9 | 0.18 | 0.23 |
| B-2" | B-2" | 20 | 20 | — | 1.4 | — | 9 | 180 | 1.7 | 0.04 | 0.20 |
| B-3" | B-3" | 20 | 14 | — | 1.4 | — | 9 | 181 | 2.0 | 0.04 | 0.12 |
| B-4" | B-4" | 14 | 5.6 | — | 1.1 | 14 | 16 | 173 | 2.1 | 0.08 | 0.07 |
| B-5" | B-5" | 7.6 | 0.8 | — | 0.5 | 28 | 30 | 160 | 2.1 | 0.15 | 0.07 |
| B-6" | B-6" | 25 | 10 | — | 1.8 | 7 | 9 | 190 | 2.2 | 0.03 | 0.08 |
| B-7" | B-7" | 25 | 9 | — | 2.1 | 5 | 7 | 195 | 2.4 | 0.03 | 0.07 |
| B-8" | B-8" | 20 | 17 | 12 | 1.4 | — | 7 | 192 | 1.8 | 0.04 | 0.15 |
| B-9" | B-9" | 25 | 7.5 | — | 2.5 | 5 | 6 | 200 | 2.5 | 0.03 | 0.07 |

As is apparent from the results in Table 6, it was identified that samples B-3" to B-9" in which the blue sensitive emulsion layer contained the silver bromochloride emulsion with the silver bromide-containing phase formed as examples of the above-described preferable embodiment (1-4) the present invention had a markedly high blue sensitivity and a high gradation.

Example 8

Further, a sample of a silver halide color photosensitive material was produced as in Example 2. The layer structure and the structural layer coating solutions of the sample were the same as in Example 2 except that emulsions B-1, G-1 and R-1 were replaced with emulsions B-1", G-1" and R-1" respectively.

The sample using emulsion B-1" as the emulsion of the blue sensitive emulsion layer was designated sample B-21". A sample was also produced in the same manner as sample B-1" except that emulsion B-1" of the blue sensitive emulsion layer was replaced with emulsions B-9", and it was designated sample B-29".

In order to examine photographic characteristics of these samples, the following experiment was conducted.

Each of the coated samples was subjected to exposure as in Example 1. After the exposure, each of the exposed samples was subjected super quick processing according to the foregoing development processing B.

The yellow color density of each processed sample was measured, and a characteristic curve of high-intensity exposure for $10^{-6}$ second was obtained. A sensitivity was defined by a reciprocal of an exposure dose at which to give a color density higher than the lowest color density by 1.5, and expressed in terms of a relative value when a density of sample B-1" was rated as 100. Further, a gradation was obtained from an inclination of a line by which to connect a density of 0.5 with a density of 2.0.

Moreover, for measuring a latent image stability, characteristic curves were obtained where processing started 10 seconds after the exposure in an atmosphere of 20° C. and relative humidity of 55% and where processing started 10 minutes after the exposure in the same atmosphere. The change in density at an exposure dose to give a density of 1.5 where processing started 10 seconds after the exposure was examined. Further, for examining a dependence of exposure on a temperature and humidity, characteristic curves were obtained where processing started 5 seconds after the exposure in an atmosphere of 10° C. and relative humidity of 55% and where processing started 5 seconds after the exposure in an atmosphere of 30° C. and relative humidity of 30%. The change in density at an exposure dose to give a density of 1.5 where processing started 5 seconds after the exposure in an atmosphere of 10° C. and relative humidity of 55% was examined. The results are shown in Table 7.

TABLE 7

| Sample No. | Emulsion No. | Relative sensitivity | Gradation | Latent image stability | Dependence of exposure on temperature and humidity |
|---|---|---|---|---|---|
| B-21" | B-1" | 100 | 1.7 | 0.20 | 0.25 |
| B-29" | B-9" | 195 | 2.3 | 0.03 | 0.08 |

As is apparent from the results in Table 7, it was identified that sample B-29" in which the blue sensitive emulsion layer contained the silver bromochloride emulsion with the silver bromide-containing phase formed as fulfilling the above-described preferable embodiment (1-4) of the present invention had a markedly high blue sensitivity and a high gradation and was excellent in latent image stability and dependence of exposure on a temperature and humidity.

Example 9

An image was formed by laser scanning exposure using the sample in Example 2.

As a laser beam source, a blue semiconductor laser having a wavelength of approximately 440 nm (made public by Toa Kagaku in a lecture of 48th Applied Physics Related Association, March 2001), a green laser having a wavelength of approximately 530 nm taken out by changing a wavelength of a semiconductor laser (oscillation wavelength approximately 1,060 nm) with SHG crystals of $LiNbO_3$ having a waveguide-type inverted domain structure and a red semiconductor laser having a wavelength of approximately 650 nm (trade name: HL6501MG, manufactured by Hitachi Ltd.). The laser beams of the three colors were moved vertically in the scanning direction with a polygon mirror to allow successive scanning exposure on the sample. The change in amount of light owing to the temperature of the semiconductor laser was suppressed by keeping constant the temperature upon using a Peltier element. An effective beam diameter was 80 μm, a scanning pitch was 42.3 μm (600 dpi), and an average exposure time for 1 pixel was $1.7\times10^{-7}$ second.

After exposure, processing was conducted according to color development processing B. Consequently, it was found that in sample B-29", that is an example of the above-described preferable embodiment (1-4) of the present invention, the blue sensitive layer showed a high sensitivity and a high gradation as in the results of the high-intensity exposure in Example 8, the red sensitive layer also showed a high sensitivity and a high gradation and it was suited for the image formation using the laser scanning exposure.

Example 10

Preparation of Emulsion B-1'''

One thousand milliliters of a lime-treated gelatin 3% aqueous solution was adjusted to pH of 5.5 and pCl of 1.7, and an aqueous solution containing 2.12 mols of silver nitrate and an aqueous solution containing 2.2 mols of sodium chloride were simultaneously added at 55° C. with vigorous stirring for mixing. While the addition of silver nitrate reached 80% to 90%, a $K_4[Ru(CN)_6]$ aqueous solution was added in an Ru amount of $3\times10^{-5}$ mol per mol of a final silver halide. While the addition of silver nitrate reached 82% to 85%, a $K_2[IrCl_6]$ aqueous solution was added in an Ir amount of $5\times10^{-8}$ mol per mol of a final silver halide. While the addition of silver nitrate reached 92% to 98%, a $K_2[Ir(5\text{-methylthiazole})Cl_6]$ aqueous solution was added in an Ir amount of $1.7\times10^{-6}$ mol per mol of a final silver halide. After desalting was conducted at 40° C., 168 g of lime-treated gelatin was added to adjust pH to 5.5 and pCl to 1.8. An emulsion of silver chloride cubic particles having a sphere-equivalent diameter of 0.55 μm and a variation coefficient of 11% was obtained.

This emulsion was dissolved at 40° C., and sodium thiosulfonate was added in an amount of $2\times10^{-5}$ mol per mol of the silver halide. Sodium thiosulfate 5-hydrate was used as a sulfur sensitizer and (S-2) as a gold sensitizer, and the mixture was aged at 60° C. for optimum conditions. After the temperature was decreased to 40° C., sensitization dye A was added in an amount of $2.7\times10^{-4}$ mol per mol of the silver halide, sensitization dye B in an amount of $1.4\times10^{-4}$ mol per mol of the silver halide, 1-phenyl-5-mercaptotetrazole in an amount of $2.7\times10^{-4}$ mol per mol of the silver halide, 1-(5-methylureidophenyl)-5-mercaptotetrazole in an amount of $2.7\times10^{-4}$ mol per mol of the silver halide and potassium bromide in an amount of $2.7\times10^{-3}$ mol per mol of the silver halide respectively. The thus-obtained emulsion was designated emulsion B-1'''.

Preparation of Emulsion B-2'''

An emulsion was prepared in the same manner as emulsion B-1''' except that when the addition of silver nitrate was completed by 80%, a potassium iodide aqueous solution was added in an I amount of 0.3 mol % per mol of a final silver halide. This was designated emulsion B-2'''.

Preparation of Emulsion B-3'41

An emulsion was prepared in the same manner as emulsion B-1''' except that when the addition of silver nitrate was completed by 90%, a potassium iodide aqueous solution was added in an I amount of 0.3 mol % per mol of a final silver halide. This was designated emulsion B-3'''.

Preparation of Emulsion B-4'''

An emulsion was prepared in the same manner as emulsion B-1''' except that while the addition of silver nitrate reached 80% to 85%, potassium bromide was added in a Br amount of 3 mol % per mol of a final silver halide. This was designated emulsion B-4'''.

Preparation of Emulsion B-5'''

An emulsion was prepared in the same manner as emulsion B-1''' except that while the addition of silver nitrate reached 85% to 90%, potassium bromide was added in a Br amount of 3 mol % per mol of a final silver halide. This was designated emulsion B-5'''.

Preparation of Emulsion B-6'''

An emulsion was prepared in the same manner as emulsion B-1''' except that while the addition of silver nitrate reached 92% to 97%, potassium bromide was added in a Br amount of 3 mol % per mol of a final silver halide. This was designated emulsion B-6'''.

Preparation of emulsion B-7'''

An emulsion was prepared in the same manner as emulsion B-1''' except that while the addition of silver nitrate reached 80% to 85%, potassium bromide was added in a Br amount of 3 mol % per mol of a final silver halide. Further, when the addition of silver nitrate was completed by 90%, a potassium iodide aqueous solution was added in an I amount of 0.3 mol % per mol of a final silver halide. This was designated emulsion B-7'''.

Preparation of Emulsion B-8'''

An emulsion was prepared in the same manner as emulsion B-1''' except that while the addition of silver nitrate reached 85% to 90%, potassium bromide was added in a Br amount of 3 mol % per mol of a final silver halide. Further, when the addition of silver nitrate was completed by 90%, a potassium iodide aqueous solution was added in an I amount of 0.3 mol % per mol of a final silver halide. This was designated emulsion B-8'''.

Preparation of Emulsion B-9'''

An emulsion was prepared in the same manner as emulsion B-1''' except that when the addition of silver nitrate was completed by 90%, a potassium iodide aqueous solution was added in an I amount of 0.3 mol % per mol of a final silver halide. Further, while the addition of silver nitrate reached 92% to 97%, potassium bromide was added in a Br amount of 3 mol % per mol of a final silver halide. This was designated emulsion B-9'''.

Preparation of Emulsion B-10'''

An emulsion was prepared in the same manner as emulsion B-1''' except that when the addition of silver nitrate was completed by 80%, a potassium iodide aqueous solution was added in an I amount of 0.3 mol % per mol of a final silver halide. Further, while the addition of silver nitrate reached 85% to 90%, potassium bromide was added in a Br amount of 3 mol % per mol of a final silver halide. This was designated emulsion B-10'''.

Preparation of Emulsion G-1'''

One thousand milliliters of a lime-treated gelatin 3% aqueous solution was adjusted to pH of 5.5 and pCl of 1.7, and an aqueous solution containing 2.12 mols of silver nitrate and an aqueous solution containing 2.2 mols of sodium chloride were simultaneously added at 45° C. with vigorous stirring for mixing. While the addition of silver nitrate reached 80% to 100%, potassium bromide was added in an amount of 4.3 mol % per mol of a final silver halide with vigorous stirring. Further, while the addition of silver nitrate reached 80% to 90%, a $K_4[Ru(CN)_6]$ aqueous solution was added in an Ru amount of $3\times10^{-5}$ mol per mol of a final silver halide. While the addition of silver nitrate reached 83% to 88%, a $K_2[IrCl_6]$ aqueous solution was added in an Ir amount of $5\times10^{-8}$ mol per mol of a final silver halide. When the addition of silver nitrate was completed by 90%, a potassium iodide aqueous solution was added in an I amount of 0.15 mol % per mol of a final silver halide with vigorous stirring. While the addition of silver nitrate reached 92% to 95%, a $K_2[Ir(5\text{-methylthiazole})Cl_5]$ aqueous solution was added in an Ir amount of $5\times10^{-7}$ mol per mol of a final silver halide. While the addition of silver nitrate reached 95% to 98%, a $K_2[Ir(H_2O)Cl_5]$ aqueous solution was added in an Ir amount of $5\times10^{-7}$ mol per mol of a final silver halide. After desalting was conducted at 40° C., 168 g of lime-treated gelatin was added to adjust pH to 5.5 and pCl to 1.8. An emulsion of silver iodobromochloride cubic particles having a sphere-equivalent diameter of 0.35 μm and a variation coefficient of 10% was obtained.

This emulsion was dissolved at 40° C., and sodium thiosulfonate was added in an amount of $2\times10^{-5}$ mol per mol of the silver halide. Sodium thiosulfate 5-hydrate was used as a sulfur sensitizer and (S-2) as a gold sensitizer, and the mixture was aged at 60° C. for optimum conditions. After the temperature was decreased to 40° C., sensitization dye D was added in an amount of $6\times10^{-4}$ mol per mol of the silver halide, 1-phenyl-5-mercaptotetrazole in an amount of $2\times10^{-4}$ mol per mol of the silver halide, 1-(5-methylureidophenyl)-5-mercaptotetrazole in an amount of $8\times10^{-4}$ mol per mol of the silver halide and potassium bromide in an amount of $7\times10^{-3}$ mol per mol of the silver halide respectively. The thus-obtained emulsion was designated emulsion G-1'''.

Preparation of Emulsion R-1'''

One thousand milliliters of a lime-treated gelatin 3% aqueous solution was adjusted to pH of 5.5 and pCl of 1.7, and an aqueous solution containing 2.12 mols of silver nitrate and an aqueous solution containing 2.2 mols of sodium chloride were simultaneously added at 45° C. with vigorous stirring for mixing. While the addition of silver nitrate reached 80% to 100%, potassium bromide was added in an amount of 4.3 mol % per mol of a final silver halide with vigorous stirring. While the addition of silver nitrate reached 80% to 90%, a $K_4[Ru(CN)_6]$ aqueous solution was added in an Ru amount of $3\times10^{-5}$ mol per mol of a final silver halide. While the addition of silver nitrate reached 83% to 88%, a $K_2[IrCl_6]$ aqueous solution was added in an Ir amount of $5\times10^{-8}$ mol per mol of a final silver halide. When the addition of silver nitrate was completed by 90%, a potassium iodide aqueous solution was added in an I amount of 0.1 mol % per mol of a final silver halide with vigorous stirring. While the addition of silver nitrate reached 92% to 95%, a $K_2[Ir(5\text{-methylthiazole})Cl_5]$ aqueous solution was added in an Ir amount of $5\times10^{-7}$ mol per mol of a final silver halide. While the addition of silver nitrate reached 95% to 98%, a $K_2$ $[Ir(H_2O)Cl_5]$ aqueous solution was added in an Ir amount of $5\times10^{-7}$ mol per mol of a final silver halide. After desalting was conducted at 40° C., 168 g of lime-treated gelatin was added to adjust pH to 5.5 and pCl to 1.8. An emulsion of silver chloride cubic particles having a sphere-equivalent diameter of 0.35 μm and a variation coefficient of 10% was obtained.

This emulsion was dissolved at 40° C., and sodium thiosulfonate was added in an amount of $2\times10^{-5}$ mol per mol of the silver halide. Sodium thiosulfate 5-hydrate was used as a sulfur sensitizer and (S-2) as a gold sensitizer, and the mixture was aged at 60° C. for optimum conditions. After the temperature was decreased to 40° C., sensitization dye H was added in an amount of $2\times10^{-4}$ mol per mol of the silver halide, 1-phenyl-5-mercaptotetrazole in an amount of $2\times10^{-4}$ mol per mol of the silver halide, 1-(5-methylureidophenyl)-5-mercaptotetrazole in an amount of $8\times10^{-4}$ mol per mol of the silver halide, compound I in an amount of $1\times10^{-3}$ mol per mol of the silver halide and potassium bromide in an amount of $7\times10^{-3}$ mol per mol of the silver halide respectively. The thus-obtained emulsion was designated emulsion R-1'''.

Subsequently, a sample of a silver halide color photosensitive material was produced as in Example 1. The layer structure and the structural layer coating solutions of the sample were the same as in Example 1 except that emulsions B-1, G-1 and R-1 and coating amounts thereof were changed to 0.26 g/m$^2$ of emulsion B-1", 0.14 g/m$^2$ of G-1" and 0.12 g/m$^2$ of R-1" respectively.

The thus-obtained sample was designated sample 101. Samples were also produced in the same manner as sample 101 except that the emulsion of the blue sensitive emulsion layer was changed as shown in Table 8.

TABLE 8

| | Blue sensitive emulsion | | | | |
|---|---|---|---|---|---|
| | | potassium bromide | | potassium iodide | |
| Sample | Emulsion | Position of addition | Amount | Position of addition | Amount |
| 101 | B-1''' | — | — | — | — |
| 102 | B-2''' | — | — | 80% | 0.3 mol % |
| 103 | B-3''' | — | — | 90% | 0.3 mol % |
| 104 | B-4''' | 80-85% | 3 mol % | — | — |
| 105 | B-5''' | 85-90% | 3 mol % | — | — |
| 106 | B-6''' | 92-97% | 3 mol % | — | — |
| 107 | B-7''' | 80-85% | 3 mol % | 90% | 0.3 mol % |
| 108 | B-8''' | 85-90% | 3 mol % | 90% | 0.3 mol % |
| 109 | B-9''' | 92-97% | 3 mol % | 90% | 0.3 mol % |
| 110 | B-10''' | 85-90% | 3 mol % | 80% | 0.3 mol % |

Evaluation

In order to examine photographic characteristics of these samples, the following experiment was conducted.

Each of the coated samples was subjected to exposure as in Example 1. After the exposure, the foregoing development processing A was conducted.

The yellow color density of each processed sample was measured, and a characteristic curve of high-intensity exposure for $10^{-6}$ second was obtained. A sensitivity (S) was defined by a reciprocal of an exposure dose at which to give a color density higher than the lowest color density by 0.7, and expressed in terms of a relative value when a sensitivity of sample 101 was rated as 100. A larger value means a higher sensitivity which is preferable. A gradation (γ) was obtained from an inclination of a line by which to connect a density of 1.0 with a density of 2.0. The larger the value, the higher the gradation, and this is preferable. A fogging density (Dmin) refers to a yellow density of an unexposed area. The smaller the value, the finer the white area. An increase in the fogging density (Δmin) after storage of the photosensitive material indicates an increase in the yellow density of the unexposed area when each sample is processed after stored in an atmosphere of 40° C. and 55% RH for 2 months. The smaller the value, the finer the white area even after the storage. A change in the sensitivity (ΔS) when a developing time varies is a change between a sensitivity provided in a color developing time of 60 seconds and a sensitivity provided in a color developing time of 45 seconds, and a difference in a reciprocal of an exposure dose at which to provide a color density which is higher than the lowest color density by 0.7 is represented by logarithm. The smaller the value, the more stable, and this is preferable. The results are shown in Table 9.

TABLE 9

| Sample | S | γ | Dmin | ΔDmin | ΔS |
|---|---|---|---|---|---|
| 101 | 100 | 1.92 | 0.15 | 0.03 | 0.18 |
| 102 | 180 | 1.81 | 0.19 | 0.06 | 0.23 |
| 103 | 210 | 1.73 | 0.20 | 0.08 | 0.25 |
| 104 | 120 | 1.99 | 0.15 | 0.03 | 0.18 |

TABLE 9-continued

| Sample | S | γ | Dmin | ΔDmin | ΔS |
|---|---|---|---|---|---|
| 105 | 130 | 1.96 | 0.15 | 0.03 | 0.18 |
| 106 | 140 | 1.94 | 0.15 | 0.03 | 0.18 |
| 107 | 200 | 2.12 | 0.11 | 0.03 | 0.09 |
| 108 | 210 | 2.23 | 0.10 | 0.03 | 0.07 |
| 109 | 205 | 1.75 | 0.20 | 0.09 | 0.26 |
| 110 | 205 | 1.85 | 0.20 | 0.07 | 0.23 |

As is apparent from the results in Table 9, it was identified that in samples 107 and 108, which are examples of the above-described preferable embodiment (4-1) of the present invention, the yellow color layer had a high sensitivity and a high gradation, the white area was fine whether before or after the storage, the change in the sensitivity when the developing time varied was also small and the processability was excellent.

Example 11

Production of a Sample of a Photosensitive Material

Further, sample 111 of a silver halide color photoensitive material was produced as in Example 2. The layer structure and the structural layer coating solutions of the sample were the same as in Example 2 except that emulsions B-1, G-1 and R-1 were replaced with emulsions B-1''', G-1''' and R-1''' respectively.

Samples were also produced in the same manner as sample 111 except that the emulsion of the blue sensitive emulsion layer was changed as shown in Table 10, and they were designated samples 112 to 120.

TABLE 10

| | Blue sensitive emulsion | | | | |
|---|---|---|---|---|---|
| | | potassium bromide | | potassium iodide | |
| Sample | Emulsion | Position of addition | Amount | Position of addition | Amount |
| 111 | B-1''' | — | — | — | — |
| 112 | B-2''' | — | — | 80% | 0.3 mol % |
| 113 | B-3''' | — | — | 90% | 0.3 mol % |
| 114 | B-4''' | 80—85% | 3 mol % | — | — |
| 115 | B-5''' | 85—90% | 3 mol % | — | |
| 116 | B-6''' | 92—97% | 3 mol % | — | — |
| 117 | B-7''' | 80—85% | 3 mol % | 90% | 0.3 mol % |
| 118 | B-8''' | 85—90% | 3 mol % | 90% | 0.3 mol % |
| 119 | B-9''' | 92—97% | 3 mol % | 90% | 0.3 mol % |
| 120 | B-10''' | 85—90% | 3 mol % | 80% | 0.3 mol % |

Evaluation

In order to examine photographic characteristics of these samples by laser scanning exposure, the following experiment was conducted.

Gradation exposure for gray color sensitometry was conducted by the same exposure method as in Example 9, and each of the exposed samples was subjected to superquick processing according to the color development processing B.

The yellow color density of each processed sample was measured, and a characteristic curve of laser exposure was obtained as in Example 10. At this time, a sensitivity (S) was expressed in terms of a relative value when a sensitivity of sample 111 was rated as 100. A change in the sensitivity (ΔS) when a developing time varies is a change between a sensitivity in a color developing time of 20 seconds and a sensitivity in a color developing time of 15 seconds. The results are shown in Table 11.

TABLE 11

| Sample | S | γ | Dmin | ΔDmin | ΔS |
|---|---|---|---|---|---|
| 111 | 100 | 1.83 | 0.20 | 0.05 | 0.10 |
| 112 | 200 | 1.53 | 0.25 | 0.09 | 0.11 |
| 113 | 230 | 1.43 | 0.27 | 0.11 | 0.13 |
| 114 | 125 | 1.85 | 0.18 | 0.05 | 0.09 |
| 115 | 130 | 1.85 | 0.17 | 0.05 | 0.09 |
| 116 | 135 | 1.84 | 0.16 | 0.05 | 0.09 |
| 117 | 225 | 2.23 | 0.11 | 0.04 | 0.05 |
| 118 | 225 | 2.45 | 0.10 | 0.04 | 0.04 |
| 119 | 220 | 1.59 | 0.24 | 0.10 | 0.10 |
| 120 | 205 | 1.57 | 0.25 | 0.09 | 0.13 |

As is apparent from the results in Table 11, it was identified that in samples 117 and 118, which are examples of the above-described preferable embodiment (4-1) of the present invention, the yellow color layer had a high sensitivity and a high gradation, and the white area was fine whether before or after the storage, the change in the sensitivity when the developing time varied was also small and the quick processability was excellent. It was further found that the effects of Example 11 were greater than those of Example 10 and the photosensitive material was suited for image formation in which to allow laser scanning exposure and superquick processing of a thin layer photosensitive material.

What is claimed is:

1. A silver halide emulsion comprising silver halide particles, wherein a content of silver chloride in the silver halide particles is at least 89 mol %, and wherein the silver halide particles comprising at least one of (i) at least one phase selected from the group consisting of a laminar phase comprising silver bromide and a six-coordinate complex in which all of six ligands are made of Cl, Br or I and Ir is a central metal, and having a maximum point where a silver bromide content ratio is at a maximum value, which maximum point is inside the silver halide particles, and a content of the silver bromide in the surroundings of the maximum point decreases in a direction from the maximum point toward the surface of the silver halide particles and the direction from the maximum point toward the inside of the silver halide particles, and a laminar phase comprising silver iodide and a six-coordinate complex having $H_2O$, OH, O, OCN, thiazole or substituted thiazole as a ligand and containing Ir as a central metal, and (ii) a phase comprising silver iodide and a phase comprising silver bromide, which phase comprising silver bromide is disposed further inside of the silver halide particles than the phase comprising silver iodide, wherein the phase (ii) satisfies either of the conditions wherein the phase comprising silver bromide is a laminar phase having a maximum point where a silver bromide content ratio is at a maximum value, which maximum point is inside the silver halide particles, and a content of the silver bromide in the surroundings of the maximum point decreases in a direction from the maximum point toward the surface of the silver halide particles and the direction from the maximum point toward the inside of the silver halide particles, or at least one of the phase comprising silver iodide and the phase comprising silver bromide comprises a six-coordinate complex having $H_2O$, OH, O, OCN, thiazole or substituted thiazole as a ligand and containing Ir as a central metal.

2. The silver halide emulsion according to claim 1, wherein the silver halide particles are cubic or tetradecahedral particles.

3. The silver halide emulsion according to claim 1, wherein, in the silver halide particles, the content of silver chloride is from 89 mol % to 99.7 mol %, a content of silver bromide is from 0.25 mol % to 10 mol %, and a content of silver iodide is from 0.05 mol % to 1 mol %.

4. The silver halide emulsion according to claim 1, wherein the silver halide emulsion is gold-sensitized with at least one of a colloidal gold sulfide and a gold sensitizer in which a complex stability constant log $\beta_2$ of gold is from 21 and to 35.

5. The silver halide emulsion according to claim 1, wherein the silver halide particles comprise a laminar phase comprising silver bromide having a maximum point where the silver bromide content ratio is at a maximum value, which maximum point is inside the silver halide particles, and the content of the silver bromide in the surroundings of the maximum point decreases in the direction from the maximum point toward the surface of the silver halide particles and the direction from the maximum point toward the inside of the silver halide particles, and wherein the silver bromide content of the laminar phase containing silver bromide is changed from decreasing to increasing in a direction from the maximum point toward the surface of the silver halide particles and the silver bromide content decreases in a direction toward the inside of the silver halide particles.

6. The silver halide emulsion according to claim 1, wherein the laminar phase comprising silver bromide is formed using silver halide fine particles containing silver bromide, which are formed by adding and mixing an aqueous solution of a water-soluble silver salt and an aqueous solution of a bromide ion-containing water-soluble halide in a mixer disposed separately from a reaction vessel for at least one of nucleating and growing silver halide particles.

7. The silver halide emulsion according to claim 1, wherein a variation coefficient of a sphere-equivalent diameter for all of the silver halide particles is no more than 20%, and the silver halide particles comprise a sphere-equivalent diameter of no more than 0.4 μm, at least one of the laminar phase comprising silver bromide and the laminar phase comprising silver iodide, a content of The silver chloride of at least 90 mol % and occupy at least 50% of a total projected area of all of the silver halide particles.

8. The silver halide emulsion according to claim 1, wherein a variation coefficient of a sphere-equivalent diameter of all of the silver halide particles is no more than 20%, and The silver halide particles comprise a sphere-equivalent diameter of no more than 0.4 μm, the laminar phase containing silver bromide, a content of silver chloride of at least 90 mol % and occupy at least 50% of a total projected area of all of the silver halide particles.

9. The silver halide emulsion according to claim 1, wherein a variation coefficient of a sphere-equivalent diameter of all of the silver halide particles is no more than 20%, and the silver halide particles comprise a sphere-equivalent diameter of no more than 0.4 μm, the laminar phase containing silver iodide, a content of silver chloride of at least 90 mol % and occupy at least 50% of a total projected area of all of the silver halide particles.

10. The silver halide emulsion according to claim 7, wherein the silver halide particles comprise a laminar phase comprising silver bromide and a laminar phase comprising silver iodide.

11. The silver halide emulsion according to claim 1, wherein in the silver halide particles, the silver chloride content is from 89 mol % to 99.7 mol %, the silver bromide content is from 0.25 mol % to 10 mol %, the silver iodide content is from 0.05 mol % to 1 mol %, and wherein the silver halide particles comprise said phase (ii).

12. The silver halide emulsion according to claim 1, wherein a variation coefficient of a sphere-equivalent diameter for all of the silver halide particles is no more than 20%.

13. The silver halide emulsion according to claim 1, wherein the silver bromide-containing phase is doped with a six-coordinate complex having iridium as a central metal.

14. The silver halide emulsion according to claim 13, wherein the six-coordinate complex has $H_2O$, OH, O, OCN, thiazole or substituted thiazole as a ligand.

15. The silver halide emulsion according to claim 13, wherein all of the ligands of the six-coordinate complex are made of only halogen.

16. A silver halide photosensitive material comprising a silver halide emulsion that comprises silver halide particles, wherein a content of a silver chloride is at least 89 mol %, and wherein the silver halide particles comprising at least one of (i) at least one phase selected from the group consisting of a laminar phase containing silver bromide and a six-coordinate complex in which all of six ligands are made of Cl, Br or I and Jr is a central metal, and having a maximum point where a silver bromide content ratio is at a maximum value, which maximum point is inside the silver halide particles, and a content of the silver bromide in the surroundings of the maximum point decreases in a direction from the maximum point toward the surface of the silver halide particles and the direction from the maximum point toward the inside of the silver halide particles, and a laminar phase comprising silver iodide and a six-coordinate complex having $H_2O$, OH, O, OCN, thiazol.e or substituted thiazole as a ligand and containing Ir as a central metal, and (ii) a phase comprising silver iodide and a phase comprising silver bromide, which phase comprising silver bromide is disposed further inside of the silver halide particles than the phase comprising silver iodide, wherein the phase (ii) satisfies either of the conditions of the phase comprising silver bromide is a laminar phase and having a maximum point where a silver bromide content ratio is at a maximum value, which maximum point is inside the silver halide particles, and a content of the silver bromide in the surroundings of the maximum point decreases in a direction from the maximum point toward the surface of the silver halide particles and the direction from the maximum point toward the inside of the silver halide particles, or at least one of the phase comprising silver iodide and the phase comprising silver bromide comprises a six-coordinate complex having $H_2O$, OH, O, OCN, thiazole or substituted thiazole as a ligand and containing ft as a central metal.

17. The silver halide photosensitive material according to claim 16, wherein the content of silver chloride is from 89 mol % to 99.7 mol %, a content of silver bromide is from 0.25 mol % to 10 mol %, and a content of silver iodide is from 0.05 mol % to 1 mol %, and wherein the silver halide particles comprise said phase (ii).

18. The silver halide photosensitive material according to claim 16, wherein the silver halide particles comprises said phase (i).

19. A silver halide emulsion comprising silver halide particles, wherein a content of silver chloride in the silver halide particles is at least 90 mol %, a variation coefficient of a sphere-equivalent diameter for all of the silver halide particles is no more than 20%, and a sphere-equivalent diameter of the silver halide particles is no more than 0.4 μm, and occupy at least 50% of a total projected area of all of the particles, and wherein the silver halide particles comprising a laminar phase comprising silver iodide, which has a maximum point where the silver iodide content ratio is at a maximum value, which maximum point is on the surface of the silver halide particles, and which is fonned by addition of an iodide solution tat is completed in an inner portion of less than 98% of a particle volume of the silver halide particles.

20. A silver halide photosensitive material comprising a silver halide emulsion that comprises silver halide particles, wherein a content of silver chloride in the silver halide particles is at least 90 mol %, a variation coefficient of a sphere-equivalent diameter for all of the silver halide particles is no more than 20%, and a sphere-equivalent diameter of the silver halide particles is no more than 0.4 μm, and occupy at least 50% of total projected area of all of the particles, and wherein the silver halide particles comprising a laminar phase comprising silver iodide, which has a maximum point where the silver iodide content ratio is at a maximum value, which maximum point is on the surface of the silver halide particles, and which is formed by addition of an iodide solution tat is completed in an inner portion of less than 98% of a particle volume of the silver halide particles.

21. A silver halide emulsion comprising silver halide particles comprising a laminar phase comprising silver bromide and a laminar phase comprising silver iodide, wherein a content of silver chloride in the silver halide particles is at least 89 mol %, the laminar phase comprising silver bromide comprises a six-coordinate complex in which all of six ligands are made of Cl, Br or I and Ir is a central metal, and the laminar phase comprising silver iodide comprises a six-coordinate complex having at least one ligand other than a halogen or a cyanogen and containing iridium as a central metal.

22. A silver halide photosensitive material comprising a silver halide emulsion that comprises silver halide particles comprising a laminar phase comprising silver bromide and a laminar phase comprising silver iodide, wherein a content of silver chloride in the silver halide particles is at least 89 mol %, the laminar phase comprising silver bromide comprises a six-coordinate complex in which all of six ligands are made of Cl, Br or I and Ir is a central metal, and the laminar phase comprising silver iodide comprises a six-coordinate complex having at least one ligand other than a halogen or a cyanogen and containing iridium as a central metal.

23. A silver halide emulsion comprising silver halide particles, wherein a content of silver chloride in the silver halide particles is at least 89 mol %, and wherein the silver halide particles comprising at least one of (i) a laminar phase comprising silver iodide and a six-coordinate complex having $H_2O$, OH, O, OCN, thiazole or substituted thiazole as a ligand and containing Ir as a central metal, wherein the six-coordinate complex is contained in a position outside 90% of silver halide particle volume, and (ii) a phase comprising silver iodide and a phase comprising silver bromide, which phase comprising silver bromide is disposed further inside of the silver halide particles than the phase comprising silver iodide, wherein the phase (ii) satisfies either of the conditions wherein the phase comprising silver bromide is a laminar phase having a maximum point where a silver bromide content ratio is at a maximum value, which maximum point is inside the silver halide particles, and a content of the silver bromide in the surroundings of the maximum point decreases in a direction from the maximum point toward the surface of the silver halide particles and the direction from the maximum point toward the inside of the silver halide particles, or at least one of the phase comprising silver iodide and the phase comprising silver bromide comprises a six-coordinate complex having $H_2O$, OH, O, OCN, thiazole or substituted thiazole as a ligand and containing Ir as a central metal, wherein the six-coordinate complex is contained in a position outside 90% of silver halide particle volume.

24. A silver halide photosensitive material comprising the silver halide emulsion of claim 23.

25. A silver halide emulsion comprising silver halide particles, wherein a content of silver chloride in the silver halide particles is at least 89 mol %, the silver halide particles comprise a laminar phase comprising silver bromide and a laminar phase comprising silver iodide, the laminar phase comprising silver bromide has a maximum point where a silver bromide content is at a maximum value, which maximum point is inside the silver halide particles, and the silver bromide content in the surroundings of the maximum point decreases in a direction from the maximum point toward the surface of the silver halide particles and the direction from the maximum point toward the inside of the silver halide particles, and the phase containing silver bromide is disposed further inside of the silver halide particle than the phase comprising silver iodide.

26. A silver halide photosensitive material comprising the silver halide emulsion of claim 25.

27. A silver halide emulsion comprising silver halide particles, wherein a content of silver chloride in the silver halide particles is at least 89 mol %, the silver halide particles comprise a six-coordinate complex having thiazole or substituted thiazole as at least one ligand and containing Ir as a central metal, and the silver halide particles comprise a laminar phase comprising silver iodide so that a concentration maximum of the silver iodide is disposed on the surface of the silver halide particles.

28. The silver halide emulsion according to claim 27, wherein the six-coordinate complex is contained in the laminar phase comprising silver iodide.

29. The silver halide emulsion according to claim 27, wherein the silver halide particles comprise a combination of a six-coordinate complex in which all of six ligands are made of Cl Br or I and Ir is a central metal and a six-coordinate complex having at least one ligand except a halogen or a cyan and containing Ir as a central metal.

30. The silver halide emulsion according to claim 27, wherein the silver halide particles further comprise a metal ion other than iridium.

31. The silver halide emulsion according to claim 30, wherein the metal ion other than iridium is one selected from the group consisting of iron, ruthenium, osmium, lead, cadmium and zinc.

32. The silver halide emulsion according to claim 27, wherein the silver halide particles are subjected to gold sensitization.

33. A silver halide photosensitive material comprising the silver halide emulsion of claim 27.

34. A silver halide photosensitive material comprising the silver halide emulsion of claim 28.

* * * * *